US012173464B2

(12) United States Patent
Foley et al.

(10) Patent No.: US 12,173,464 B2
(45) **Date of Patent: *Dec. 24, 2024**

(54) TRENCH BOX AND METHOD OF ASSEMBLY

(71) Applicant: 2307050 Alberta Ltd., Edmonton (CA)

(72) Inventors: James Foley, Red Deer County (CA); Devon Graham, Innisfail (CA); Benedikt Mayer, Innisfail (CA); Darryl Krochak, Innisfail (CA)

(73) Assignee: 2307050 Alberta Ltd., Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/706,534

(22) Filed: Mar. 28, 2022

(65) Prior Publication Data

US 2022/0220689 A1 Jul. 14, 2022

Related U.S. Application Data

(62) Division of application No. 16/797,458, filed on Feb. 21, 2020, now Pat. No. 11,286,634, which is a (Continued)

(30) Foreign Application Priority Data

Jul. 22, 2015 (CA) ..... CA 2898002

(51) Int. Cl.
*E02D 17/00* (2006.01)
*E02D 17/08* (2006.01)

(52) U.S. Cl.
CPC ..... *E02D 17/08* (2013.01); *E02D 17/083* (2013.01)

(58) Field of Classification Search
CPC ..... E02D 17/00; E02D 17/08; E02D 17/086; E04B 1/4178; E04B 1/4185; E04B 1/48; (Continued)

(56) References Cited

U.S. PATENT DOCUMENTS 1,329,292 A * 1/1920 Christin ..... E04C 2/06 249/98
2,482,367 A * 9/1949 Ravers, Jr. ..... E02D 17/086 405/282

(Continued)

FOREIGN PATENT DOCUMENTS

| | | | |
|---|---|---|---|
| DE | 2509675 | A1 | 9/1976 |
| DE | 102009042356 | A1 | 4/2011 |
| EP | 0095193 | A1 | 11/1983 |
| EP | 0464774 | B1 | 2/1996 |
| GB | 2053314 | A | 2/1981 |
| JP | H0813496 | A | 1/1996 |
| WO | 9602712 | A1 | 2/1996 |
| WO | 2015126767 | A1 | 8/2015 |

OTHER PUBLICATIONS

International Search Report Corresponding to PCT/CA2016/050868 mailed Nov. 1, 2016.

(Continued)

*Primary Examiner* — Edwin J Toledo-Duran
(74) *Attorney, Agent, or Firm* — Finch & Maloney PLLC

(57) ABSTRACT

A trench box which has first and second side panels connected in parallel spaced relation by first and second lateral supports. Each lateral support comprises connection points at each end of each lateral support that connect the side panels to the lateral supports. The connection points maintain the side panels in parallel spaced relation and the lateral supports in parallel spaced relation between the side panels. Each connection point comprises a pivot connection that permits pivotal movement of the side panels relative to the lateral supports about a pivot axis, and a releasable connection spaced from the pivot connection in a direction perpendicular to the pivot axis. The releasable connection is selectively releasable to permit the respective first or second side panel to pivot about the pivot axis such that the panels are not parallel.

21 Claims, 41 Drawing Sheets

Related U.S. Application Data division of application No. 15/746,177, filed as application No. PCT/CA2016/050868 on Jul. 22, 2016, now Pat. No. 10,604,906.

(58) Field of Classification Search

CPC ... E04B 1/483; E04B 2/30; E04B 2/44; E04B 2/86; E04B 2/8617; E04B 2/8635; E04B 2/8647; E04B 2/8652; E04B 2001/4192; E04B 2002/867; E04C 1/40

USPC ..... 405/272, 282, 283; 52/426, 562, 563

See application file for complete search history.

(56) References Cited

U.S. PATENT DOCUMENTS 2,741,341 A * 6/1956 Anderson ..... F25D 23/063 292/109
2,922,283 A * 1/1960 Porter ..... E02D 17/08 405/283
2,940,296 A * 6/1960 Gaspar ..... E04B 2/8635 52/712
3,029,607 A * 4/1962 Millerbernd ..... E02D 17/08 405/283
3,274,739 A * 9/1966 Gregoire ..... E04D 3/30 52/287.1
3,276,797 A * 10/1966 Humes, Jr. ..... F16B 12/46 52/715
3,300,919 A * 1/1967 Hiller ..... E04B 2/7411 52/461
3,331,210 A * 7/1967 Wenninger ..... E02D 17/08 248/68.1
3,348,459 A * 10/1967 Harvey ..... E01C 9/083 404/35
3,362,168 A * 1/1968 Dotlich ..... E02D 17/08 405/283
3,379,018 A * 4/1968 Frentzel ..... E02D 17/083 24/523
3,572,224 A * 3/1971 Perry ..... E01C 11/14 404/40
3,574,981 A * 4/1971 Henschen ..... E04G 21/26 248/354.3
3,621,660 A * 11/1971 Krings ..... E04G 17/06 405/282
3,755,982 A * 9/1973 Schmidt ..... E04B 1/14 52/584.1
3,782,052 A * 1/1974 Vetovitz ..... E04B 1/35 248/354.3
3,784,043 A * 1/1974 Presnick ..... B65D 88/528 52/285.3
3,788,026 A * 1/1974 Cook ..... E04G 21/1841 52/712
3,888,055 A * 6/1975 Gallo ..... E04H 13/006 52/378
3,967,454 A * 7/1976 Barnes ..... E02D 17/086 405/282
3,981,116 A * 9/1976 Reed ..... E04F 13/12 52/506.1
4,056,940 A * 11/1977 Fisher ..... E02D 17/08 405/282
4,068,427 A * 1/1978 Camardo ..... E04G 21/26 52/749.1
4,199,278 A * 4/1980 Koehl ..... E02D 17/08 405/282
4,204,375 A * 5/1980 Good ..... E04B 2/7427 403/387
4,211,043 A * 7/1980 Coday ..... E04B 1/34823 52/234
4,294,051 A * 10/1981 Hughes, Jr. ..... E04B 1/14 52/223.7
4,372,709 A 2/1983 Krings
4,541,509 A * 9/1985 D'Alessio ..... E04G 1/14 182/186.7
4,594,829 A * 6/1986 Herrgord ..... E05D 1/04 52/282.3
4,659,260 A * 4/1987 Morelli ..... E02D 17/08 405/283
4,676,039 A 6/1987 Leiter et al.
4,685,837 A * 8/1987 Cicanese ..... E02D 17/08 405/282
4,722,146 A * 2/1988 Kemeny ..... E04B 2/7429 52/800.11
4,813,196 A 3/1989 Bokelund et al.
4,897,976 A * 2/1990 Williams ..... E04B 2/7453 52/481.1
4,905,334 A 3/1990 Oppenhuizen
4,959,937 A * 10/1990 Mayer, ..... E04C 1/42 403/403
4,993,880 A * 2/1991 Collins ..... E02D 17/08 405/282
5,035,099 A * 7/1991 Lapish ..... E04F 13/0808 52/568
5,062,246 A * 11/1991 Sykes ..... E04B 2/7424 52/220.7
5,096,334 A * 3/1992 Plank ..... E02D 17/08 405/282
5,105,594 A * 4/1992 Kirchner ..... G09F 15/0068 52/239
5,123,785 A * 6/1992 Orfei ..... E02D 17/086 405/283
5,134,826 A 8/1992 La Roche et al.
5,226,755 A 8/1993 Tweedt
5,247,773 A * 9/1993 Weir ..... E04B 1/615 403/381
5,310,290 A * 5/1994 Spencer ..... E02D 17/086 405/282
5,456,555 A 10/1995 Bökeler
5,477,595 A 12/1995 LePage
5,503,504 A * 4/1996 Hess ..... E02D 17/08 405/282
5,526,628 A * 6/1996 Knudson ..... E04B 7/022 52/537
5,533,838 A 7/1996 Kundel
5,657,583 A * 8/1997 Tennant ..... E04B 1/34321 52/270
5,806,258 A * 9/1998 Miedema ..... E04B 2/7437 52/239
5,816,001 A * 10/1998 Goodman ..... A47B 57/425 52/36.6
5,839,240 A * 11/1998 Elsholz ..... E04B 2/7433 52/287.1
5,839,707 A 11/1998 Barringer
5,852,904 A * 12/1998 Yu ..... E04B 2/7422 52/239
5,890,337 A * 4/1999 Boeshart ..... E04B 2/8652 52/432
6,000,179 A * 12/1999 Musculus ..... E04B 2/7425 403/231
6,023,907 A * 2/2000 Pervan ..... E04F 13/0801 52/480
6,047,508 A * 4/2000 Goodman ..... E04B 2/745 52/584.1
6,085,469 A * 7/2000 Wolfe ..... E04B 7/04 52/270
6,119,410 A * 9/2000 Wolfe ..... E04B 1/14 52/277
6,119,427 A * 9/2000 Wyman ..... E04C 2/292 52/584.1
6,122,880 A * 9/2000 Kolb ..... E04C 1/40 52/503
6,128,877 A * 10/2000 Goodman ..... E04F 13/081 52/745.1
6,151,856 A * 11/2000 Shimonohara ..... F16B 19/002 52/426
6,155,750 A * 12/2000 Wu ..... E02D 17/08 405/282
6,185,878 B1 * 2/2001 Bullard, III ..... E04B 1/6179 312/265.5

(56) References Cited

U.S. PATENT DOCUMENTS 6,216,410 B1* 4/2001 Haberman ..... E04F 13/12 52/592.1
6,230,462 B1* 5/2001 Beliveau ..... E04B 2/8617 52/592.6
6,295,764 B1 10/2001 Berridge et al.
6,298,619 B1* 10/2001 Davie ..... E04B 7/22 52/270
6,318,040 B1* 11/2001 Moore, Jr. ..... E04B 5/32 52/379
6,349,516 B1* 2/2002 Powell ..... E04B 2/7437 52/239
6,352,657 B1* 3/2002 Veldhuis ..... B28B 19/003 425/117
6,367,212 B1* 4/2002 Manning ..... E04B 1/945 52/271
6,401,419 B1* 6/2002 Beliveau ..... E04B 2/8617 52/592.1
6,443,665 B1* 9/2002 Kundel, Sr. ..... E02D 17/08 405/282
6,446,414 B1 9/2002 Bullard, III et al.
6,493,995 B2 12/2002 McKenzie
6,502,357 B1* 1/2003 Stuthman ..... E04C 2/20 52/522
6,543,164 B1 4/2003 Sperl et al.
6,619,008 B1 9/2003 Shivak et al.
6,789,977 B2* 9/2004 Layfield ..... F16B 12/12 403/294
6,915,613 B2* 7/2005 Wostal ..... E04B 2/8617 52/592.6
6,962,027 B2* 11/2005 Zawinsky ..... E04G 23/02 52/745.21
7,055,287 B2 6/2006 Yu et al.
7,258,511 B1* 8/2007 Cerda ..... E02D 17/08 405/282
7,537,417 B2 5/2009 Meyer
7,603,821 B2* 10/2009 Eberlein ..... E04B 2/7425 52/261
7,837,413 B1* 11/2010 Kundel, Sr. ..... E02D 17/08 248/644
8,015,767 B2 9/2011 Glick et al.
8,024,901 B2 9/2011 Gosling et al.
8,037,652 B2* 10/2011 Marshall ..... E02D 27/02 52/564
8,161,697 B1* 4/2012 McDonald ..... E04C 2/16 428/292.4
8,468,761 B2* 6/2013 Marshall ..... E04B 2/8635 52/564
8,479,469 B2* 7/2013 Ciccarelli ..... E04B 2/8635 52/428
8,534,003 B2* 9/2013 Curry, III ..... E04C 2/40 52/592.1
8,845,238 B1* 9/2014 Fontaine ..... E02D 17/04 405/282
8,845,239 B2 9/2014 Taylor et al.
8,869,492 B2 10/2014 Leahy
8,919,726 B2* 12/2014 Hendricks ..... E04G 11/065 52/796.1
9,127,429 B2 9/2015 Pateuk
9,228,337 B2 1/2016 Chong
9,297,138 B2 3/2016 Stenger
2001/0025460 A1* 10/2001 Auer ..... E04B 2/744 52/592.2
2001/0027631 A1* 10/2001 Moore, Jr. ..... E04G 17/06 52/562
2002/0026761 A1* 3/2002 Moore, Jr. ..... E04G 17/06 52/565
2002/0092253 A1* 7/2002 Beliveau ..... E04B 2/8617 52/592.6
2002/0116889 A1* 8/2002 Moore, Jr. ..... E04B 2/8641 52/379
2003/0031514 A1* 2/2003 Nicholson ..... E02D 17/083 405/133
2003/0041540 A1* 3/2003 Gravel ..... E04B 2/7422 52/656.1
2003/0066943 A1* 4/2003 Daniels ..... E04G 17/12 249/34
2004/0103609 A1* 6/2004 Wostal ..... E04B 2/8635 249/190
2005/0028466 A1* 2/2005 Titishov ..... E04B 2/8617 52/474
2005/0074300 A1* 4/2005 Kadiu ..... E02D 17/083 405/274
2005/0284093 A1* 12/2005 Foucher ..... E04B 1/04 52/782.1
2006/0024137 A1* 2/2006 Cerda ..... E02D 17/08 405/282
2006/0174577 A1* 8/2006 O'Neil ..... E04B 1/6145 52/586.1
2007/0175108 A1 8/2007 Stein et al.
2007/0294970 A1* 12/2007 Marshall ..... E02D 27/02 52/309.11
2008/0005991 A1* 1/2008 Meilleur ..... E04B 2/8647 52/426
2008/0115433 A1* 5/2008 Towersey ..... E04B 2/7425 52/284
2008/0155929 A1* 7/2008 Herron ..... E04H 9/04 52/582.1
2008/0168735 A1* 7/2008 Guevremont ..... E04G 21/142 52/582.1
2009/0013629 A1* 1/2009 Boeshart ..... E04B 2/8617 52/309.4
2009/0100780 A1* 4/2009 Mathis ..... E04C 2/296 52/794.1
2009/0110490 A1* 4/2009 Hess ..... E02D 17/08 405/282
2009/0308014 A1* 12/2009 Muehlebach ..... E04F 15/02 52/592.4
2010/0034597 A1* 2/2010 Kundel, Sr. ..... E02D 17/086 405/283
2010/0251657 A1* 10/2010 Richardson ..... E04B 2/86 52/745.21
2011/0000161 A1* 1/2011 Aube ..... E04B 2/46 52/745.1
2011/0099932 A1* 5/2011 Saulce ..... E04C 5/18 52/745.13
2011/0131916 A1* 6/2011 Chen ..... E04F 15/02 52/582.1
2011/0192107 A1* 8/2011 Farquhar ..... F16B 21/02 52/794.1
2011/0203202 A1* 8/2011 Uhl ..... E04B 2/8635 52/309.1
2011/0265414 A1* 11/2011 Ciccarelli ..... E04B 2/8635 52/426
2012/0085047 A1* 4/2012 Hiscock ..... E04B 1/168 52/287.1
2014/0248093 A1* 9/2014 Breen ..... E02F 5/10 405/284
2014/0259990 A1* 9/2014 Pfeiffer ..... B29C 44/1233 52/127.7
2014/0298745 A1 10/2014 Rechenmacher et al.
2014/0298747 A1* 10/2014 Castonguay ..... E04B 2/44 52/562
2015/0259897 A1* 9/2015 Carroll ..... A01K 1/03 52/582.1
2016/0108599 A1 4/2016 Spry

OTHER PUBLICATIONS

Written Opinion Corresponding to PCT/CA2016/050868 mailed Nov. 1, 2016.

European Search Report issued in corresponding European Patent Application No. 16826975.1 dated Jan. 7, 2019.

Shapira, A. and Goldfinger , D., "Work-input model for assembly and disassembly of high shoring lowers" Construction Management and Economics 18, 467-477 (2000).

(56) References Cited

OTHER PUBLICATIONS

Efficiency Production, Inc. "Build-a-box™ Modular Aluminum Trench Shielding System" www.efficiencyproduction.com/build-a-box (Jul. 20, 2016).
Direct Equipment West "Aluminum Shoring & Shielding" http://dewest.ca/aluminum-shoring-shielding/ (Jul. 20, 2016).

* cited by examiner

FIG. 33
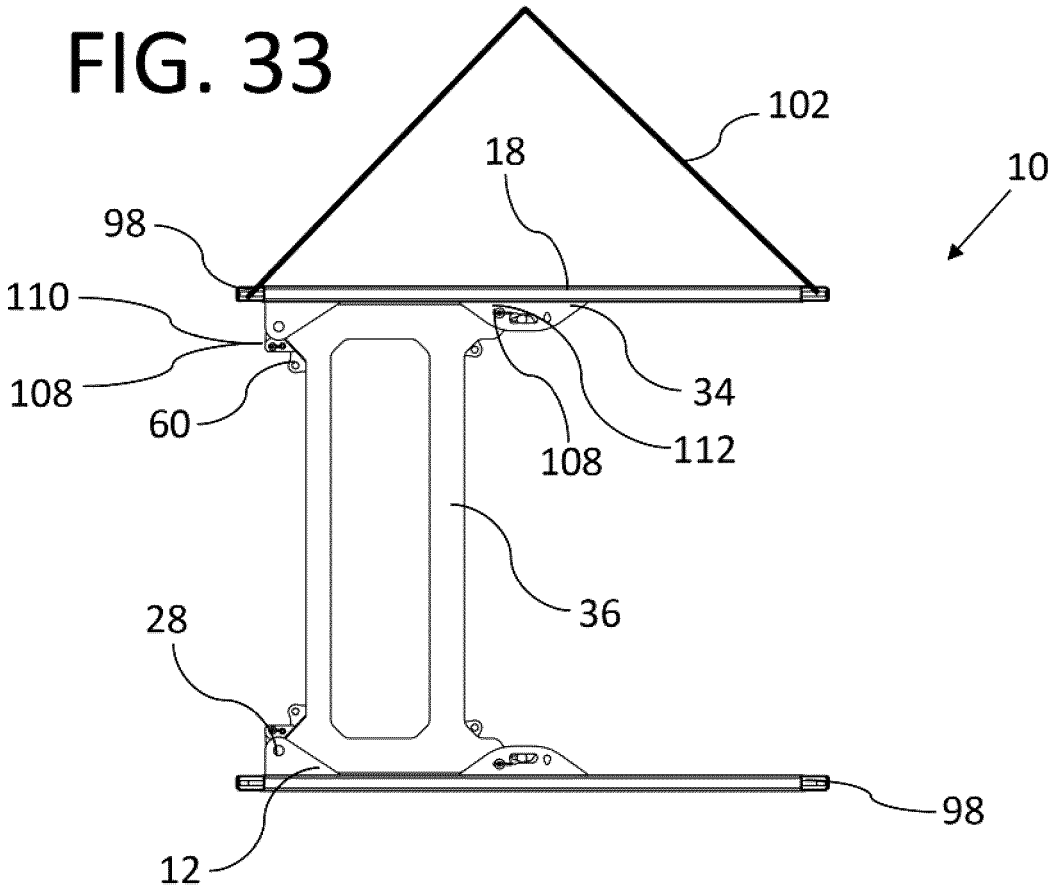
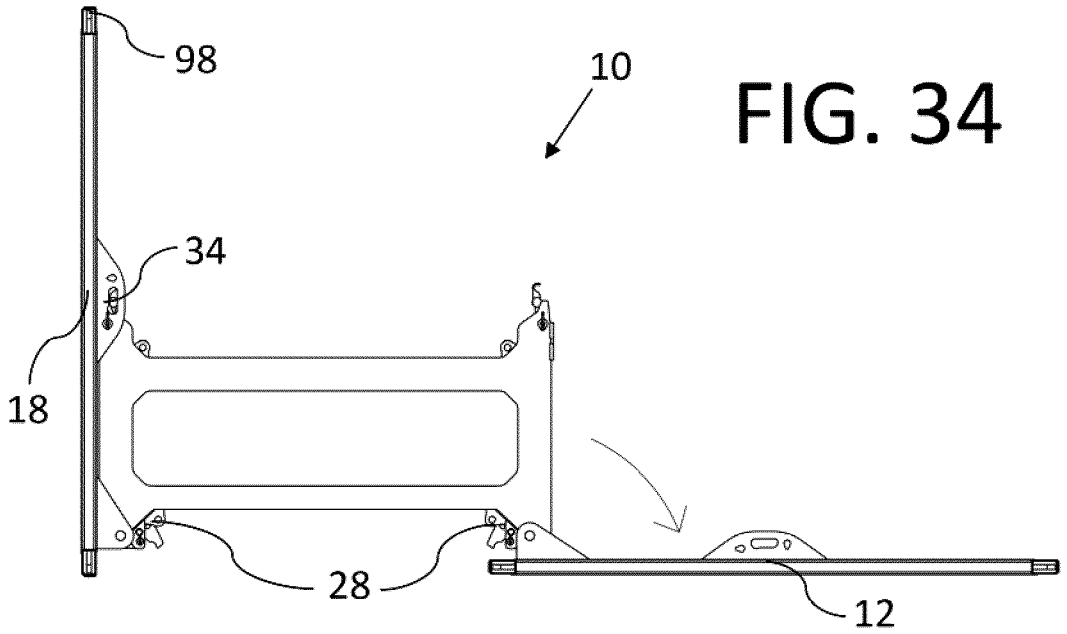
FIG. 34

TRENCH BOX AND METHOD OF ASSEMBLY

TECHNICAL FIELD

This relates to a trench box and a method of assembling a trench box.

BACKGROUND

Trench boxes are used for protection during excavation. Trench boxes may be used when installing pipelines, underground cabling, or performing other operations that require below-ground access.

A typical trench box will include side panels that are separated and held in place by struts, which may be length-adjustable to meet the needs of the particular trench. It is necessary to construct the panels and struts from materials that are able withstand the loads that will be applied.

Trench boxes are generally assembled by laying a side panel flat on the ground, attaching the struts so they extend up from the side panel, and then lowering the other side panel onto the struts. Given the weight of the various components, lifting equipment is normally required, and personnel are required to ensure the various pieces are properly aligned as they are manipulated by the lifting equipment.

SUMMARY

According to an aspect, there is provided a trench box, comprising first and second side panels connected in parallel spaced relation by one or more lateral supports. Each lateral support comprises connection points at a first end and a second end of each lateral support that connect the first and second side panels to the one or more lateral supports, the connection points maintaining the first and second side panels in parallel spaced relation and the one or more lateral supports in parallel spaced relation between the first and second side panels. Each connection point comprises a pivot connection that permits pivotal movement of the side panels relative to the one or more lateral supports about a pivot axis, and a releasable connection spaced from the pivot connection in a direction perpendicular to the pivot axis, the releasable connection being selectively releasable to permit the respective first or second side panel to pivot about the pivot axis such that the panels are not parallel.

According to another aspect, the trench box may further comprise side supports mounted between the side panels and the one or more lateral supports, the side supports extending along the side panels in a direction perpendicular to the pivot axis. The connection points may connect the lateral support to the side supports. The side panels may be removably mounted to the side supports. When the releasable connections are released, the side supports may pivot sufficiently about the pivot axis to permit the one or more stands to engage the ground surface, or the side supports may be fixedly mounted to the lateral supports such that the side panels pivot relative to the lateral supports and the side supports.

According to another aspect, there may be one or more stands that support the lateral support when on a ground surface. The pivot connection is spaced from the releasable connection and may be above the releasable connection.

According to another aspect, the releasable connections may be spring-loaded connections.

According to another aspect, the lateral supports may be length-adjustable to adjust a spacing between the first and second side panels.

According to another aspect, the height of the first and second side panels may be greater than a height of the lateral supports, such that, when the lateral support is supported by the one or more stands on the ground surface, the first and second side panels are angled downward and outward relative to the lateral supports.

According to another aspect, each lateral support may comprise lifting lugs that permit the lateral supports to be suspended by a lifting device such that the side panels are free to pivot about the pivot connections when the lateral supports are lifted sufficiently.

According to another aspect, the trench box may further comprise one or more third side panel that attaches to one or more of the first and second side panels. The one or more third side panel may attach to the first side panels using a corner engagement member, the corner engagement member having an engagement profile that secures the one or more third side panel perpendicularly to the first side panel. The one or more third side panels may attach to a top edge of the first or second side panel using an engagement member, the engagement member having an engagement profile that secures the one or more third side panels in a common plane with at least one of the first and second side panels.

According to another aspect, a perimeter of the first and second side panels may comprise a universal engagement profile that is engaged by a universal engagement member.

According to another aspect, each side panel may comprise at least one snubber for controlling the pivotal movement of each side panel relative to the lateral supports.

According to an aspect, there is provided a method of assembling a trench box, comprising the steps of: positioning one or more lateral supports in parallel spaced relation and in a vertical orientation. Each lateral support comprises connection points at a first end and a second end of each lateral support, each connection point comprising a pivot connection, and a releasable connection spaced below the pivot connection when the lateral support is in the vertical orientation; and one or more stands for supporting the support structure in the vertical orientation. The method further comprises the steps of pivotally attaching a first side panels to the pivot connections at the first end of each lateral support, and a second side panel to the pivot connections at the second end of each lateral support, the side panels being angled down and away relative to the lateral supports; lifting the lateral supports such that the first and second side panels pivot toward the lateral supports; and engaging the releasable connection such that the first and second side panels are secured in parallel spaced relation with the one or more lateral supports in parallel spaced relation between the first and second side panels.

According to an aspect, there is provided a method of disassembling a trench box, the method comprising the steps of: providing a trench box, comprising one or more side panels connected in parallel spaced relation by first and second lateral supports. Each lateral support comprising connection points at a first end and a second end of each lateral support that attach the first and second side panels to the one or more lateral supports, the connection points maintaining the first and second side panels in parallel spaced relation and the one or more lateral supports in parallel spaced relation between the first and second side panels; each connection point comprising a pivot connection that permits pivotal movement of the side panels relative to the lateral supports about a pivot axis, and a releasable connection spaced from the pivot connection in a direction perpendicular to the pivot axis, the releasable connection being selectively releasable to permit the respective first or second side panel to pivot about the pivot axis such that the panels are not parallel; at least one snubber for controlling the pivotal movement of each side panel relative to the lateral supports; and one or more stands that support the lateral support when on a ground surface with the pivot connection spaced from the releasable connection. The method further comprises the steps of positioning the trench box on a ground surface such that the trench box is supported on a bottom edge of the first and second side panels with the lateral supports parallel to the ground surface; releasing the releasable connection of the first side panel, and applying a force to the first side panel that causes it to pivot about the pivot connection until it is angled downward and away from the lateral support, the pivotal movement of the first side panel being controlled by one or more of the snubbers; releasing the releasable connection of the second side panel, and applying a force to the second side panel that causes it to pivot about the pivot connection until it is angled downward and away from the lateral support and such that the one or more stands engages the ground surface, the pivotal movement of the second side panel being controlled by one or more of the snubbers; and removing the first and second side panels from the lateral support.

According to another aspect, the releasable connection of the first and second side panels may be released together such that the first and second side panels pivot at the same time.

According to an aspect, there is provided a method of disassembling a trench box, the method comprising the steps of: providing a trench box, comprising first and second side panels connected in parallel spaced relation by one or more lateral supports. Each lateral support comprises connection points at a first end and a second end of each lateral support that attach the first and second side panels to the one or more lateral supports, the connection points maintaining the first and second side panels in parallel spaced relation and the one or more lateral supports in parallel spaced relation between the first and second side panels; each connection point comprising a pivot connection that permits pivotal movement of the side panels relative to the lateral supports about a pivot axis, and a releasable connection spaced from the pivot connection in a direction perpendicular to the pivot axis, the releasable connection being selectively releasable to permit the respective first or second side panel to pivot about the pivot axis such that the panels are not parallel. The method may further comprise the steps of: positioning the trench box such that a top edge of the first and second side panels engages a ground surface; releasing the releasable connections of the first and second side panels; and pivotally lowering the first and second side panels until an outer face of the first side panel and an outer face of the second side panel engage the ground surface.

According to an aspect, there is provided a method of disassembling a trench box, the method comprising the steps of:

providing a trench box that comprises first and second side panels connected in parallel spaced relation by one or more lateral supports, each lateral support comprising connection points at a first end and a second end of each lateral support that attach the first and second side panels to the one or more lateral supports, the connection points maintaining the first and second side panels in parallel spaced relation and the one or more lateral supports in parallel spaced relation between the first and second side panels; and each connection point comprising a pivot connection that permits pivotal movement of the side panels relative to the one or more lateral supports about a pivot axis, and a releasable connection spaced from the pivot connection in a direction perpendicular to the pivot axis, the releasable connection being selectively releasable to permit the respective first or second side panel to pivot about the pivot axis such that the panels are not parallel;

positioning the trench box such that an outer surface of the first side panels engages a ground surface;

lifting the second side panel such that the second side panel moves pivotally relative to the first side panel, and lowering the second side panel until an outer surface of the second side panel engages the ground surface spaced from the first side panel by the one or more lateral supports, the releasable connections being released to permit relative movement of the first and second side panels; and removing the one or more lateral supports from the first and second side panels.

According to an aspect, there is provided a trench box, comprising first and second side panels, each side panel having an inner face and an outer face, the inner face having an upper attachment point having a first part of an upper attachment and a lower attachment having a first part of a lower attachment, one or more support structures, each support structure comprising first and second sides supports separated by a lateral support, wherein in use, the lateral support maintains the first side support in a fixed position and orientation relative to the second side support, each of the first and second side supports carrying a second part of the upper attachment and a second part of a lower attachment, the second part of the upper attachment pivotally engaging the first part of the upper attachment and the second part of the lower attachment fixedly engaging the first part of the lower attachment, each of the upper attachment and the lower attachment being selectively engaged and disengaged, and a stand for supporting the support structure in a vertical orientation with the second part of the upper attachment above the second part of the lower attachment.

According to another aspect, at least one of the upper attachment and the lower attachment may be pin connected.

According to another aspect, at least one of the upper attachment and the lower attachment may be spring-loaded connectors.

According to another aspect, the lateral support of the support structures may be length-adjustable to adjust a spacing between the first and second side supports.

According to another aspect, the stand may be removably attached to the second part of the lower attachment, the stand being removed to permit the first parts of the lower attachments to connect to the respective second part of the lower attachments.

According to another aspect, one of the first part and the second part of the lower attachment may comprise an engagement face and the other of the second part and the first part of the lower attachment may comprise a receiver having a pin that slides along the engagement face to retain the engagement face that is received within the receiver.

According to another aspect, a first distance between the first part of the upper attachment and a lower edge of the respective panel may be greater than a second distance between the second part of the upper attachment and the stand, such that, when the first and second parts of the upper attachment are connected and the stand supports the support structure on a ground surface, the first and second panels are angled downward and outward relative to the support structure.

According to another aspect, each support structure may comprise lifting lugs that permit the support structures to be suspended by a lifting device such that the panels are free to pivot about the upper attachments when the support structure is lifted sufficiently.

According to another aspect, the trench box may further comprise one or more third side panels that attach to and extend between the first and second side panels.

According to another aspect, the one or more third side panels may attach to the first side panel using a corner engagement member, the corner engagement member having an engagement profile that secures the one or more third side panel perpendicularly to the first panel.

According to another aspect, the trench box may further comprise one or more third side panels, each third side panel being attached to and extending above a top edge of one of the first and second side panels.

According to another aspect, the one or more third side panels may attach to the top edge of the respective side panels using an engagement member having an engagement profile that secures the one or more third side panels in a common plane with at least one of the first and second side panels.

According to another aspect, a perimeter of the side panels may comprise a universal engagement profile that is engaged by a universal engagement member.

According to an aspect, there is provided a method of assembling a trench box, comprising the steps of positioning one or more support structures in spaced relation and in a vertical orientations, each support structure comprising first and second sides supports separated by a lateral support, wherein in use, the lateral support maintains the first side support in a fixed position and orientation relative to the second side support, one or more stands for supporting the support structure in the vertical orientation, attaching first and second side panels to the one or more support structures using a pivotal attachment, the pivotal attachment being positioned toward a top of each of the first and second side panels and the one or more support structures, the first and second side panels being angled down and away from the one or more support structures, lifting the support structures such that the first and second side panels pivot toward the support structures, removing the one or more stands, and attaching the first and second side panels to the support structures at a point below the pivotal attachments.

According to another aspect, attaching the first and second side panels to the one or more support structures may comprise using at least one pin connection.

According to another aspect, attaching the first and second side panels to the one or more support structures may comprise using at least one spring-loaded connector.

According to another aspect, attaching the first and second side panels to the support structure at a point below the pivotal attachments may comprise inserting a pin connector into a pin receiver.

According to another aspect, the lateral supports of the support structures may be length-adjustable, and the method may further comprising the step of adjusting a spacing between the first and second side supports by adjusting the length of the lateral supports.

According to another aspect, the stand may be removably attached to the second part of the lower attachment, and the method may further comprise removing the stand and connecting the first parts of the lower attachments to the respective second part of the lower attachments.

According to another aspect, attaching the first and second side panels to the support structures at a point below the pivotal attachments may comprise sliding a pin being carried by a receiver on one of the first part and the second part of the lower attachment along an engagement face, the other of the first part and the second part of the lower attachment comprising the engagement face, to retain the engagement face within the receiver.

According to another aspect, a first distance between the first part of the upper attachment and a lower edge of the respective panel may be greater than a second distance between the second part of the upper attachment and the stand, such that, when the first and second parts of the upper attachment are connected and the stand supports the support structure on a ground surface, the first and second panels are angled downward and outward relative to the support structure.

According to another aspect, the method may further comprise the step of suspending the support structures with a lifting device connected to lifting lugs on each support structure such that the panels are free to pivot about the upper attachments.

According to another aspect, the method may further comprise the step of attaching one or more one third side panels to the first and second side panels such that the one or more third side panels extend between the first and second side panels.

According to another aspect, the one or more third side panels may attach to the first side panel using a corner engagement member, the corner engagement member having an engagement face that secures the one or more third side panels perpendicularly to the first side panel.

According to another aspect, the method may further comprise the step of attaching one or more third side panels to a top edge of one of the first and second side panels such that the one or more third side panels extend above a top edge of at least one of the first and second side panels.

According to another aspect, the one or more third side panels may attach to the top edge of the respective side panels using an engagement member.

According to another aspect, a perimeter of the first and second side panels may comprise an engagement profile that is engaged by an engagement member having an engagement profile that secures the one or more third side panels in a common plane with at least one of the first and second side panels.

According to an aspect, there is provided a trench box, comprising first and second side panels, each side panel having an inner face, an outer face and an outer peripheral edge, one or more support structures attached between the inner faces of the first and second side panels to maintain the first side panel in a fixed position and orientation relative to the second side panel, a universal connector on the outer peripheral edge of each of the first and second side panels, the universal connector comprising a plurality of connection points that are evenly spaced along the outer peripheral edge, and a removable connector that selectively connects to the universal connector.

According to an aspect, there is provided a trench box assembled for use in an excavation, the trench box comprising a plurality of panels comprising at least a first panel, a second panel, and a third panel. Each panel comprises a connection profile comprising a plurality of straight edge segments along the peripheral edges of the panel, each straight edge segment having a plurality of evenly spaced connection points, wherein the spacing of connection points on each straight edge segment is equal. The first and second panels are secured in parallel, spaced relation. A plurality of connectors connect between connection profiles. At least one connector connects the third panel and the first panel to secure the third panel relative to the first and second panels.

According to another aspect, the first and second panels may be secured in parallel, spaced relation by one or more lateral supports that have a first end connected to the first panel and a second end connected to the second panel.

According to an aspect, the plurality of connectors further connect the third panel and the second panel. The plurality of connectors may further connect a fourth panel to the first and second panels, wherein the first and second panels are secured in parallel, spaced relation by the third and fourth panels. The third and fourth panels may be in parallel spaced relation.

According to another aspect, the third panel may be connected parallel to and in alignment with the first panel, or at an angle to the first panel.

According to another aspect, each panel may be rectangular and have a length and a width, the connection profile extending along each of the length and the width of each panel, wherein at least the length and the width of the third panel are non-equal, such that each of the length and the width of the third panel can be connected to each of the length and the width of the first panel.

According to an aspect, there is provided a method of installing a trench box or use in an excavation having sidewalls, the method comprising the step of: providing a plurality of panels comprising at least a first panel, a second panel, and a third panel, each panel comprising a connection profile having a plurality of straight edge segments along the peripheral edges of the panel, each straight edge segment having a plurality of evenly spaced connection points, wherein the spacing of connection points on each straight edge segment is equal; providing a plurality of connectors that connect between connection profiles; assembling the trench box by: securing the first and second panels together in parallel, spaced relation; and using one or more connectors to connect the third panel and the first panel to secure the third panel relative to the first and second panels.

According to an aspect, the first and second panels may be secured in parallel, spaced relation by one or more lateral supports that have a first end connected to the first panel and a second end connected to the second panel.

According to another aspect, one or more connectors may be used to connect the third panel and the second panel. The method may further comprise the step of using the connectors to connect a fourth panel to the first and second panels, wherein the first and second panels are secured in parallel, spaced relation by the third and fourth panels. The third and fourth panels may be in parallel spaced relation.

According to another aspect, the third panel may be connected parallel to and in alignment with the first panel, or at an angle to the first panel.

According to another aspect, each panel may be rectangular and have a length and a width, the connection profile extending along each of the length and the width of each panel, wherein at least the length and the width of the third panel are non-equal, and further comprising the steps of: identifying a plurality of arrangements in which the length and the width of the third panel can be connected to each of the length and the width of the first panel, and selecting one of the plurality of arrangements.

According to another aspect, the method may further comprise the step of installing the trench box in the excavation to support at least a portion of the sidewalls of the excavation.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 33 is a side elevation view of the trench box of FIG. 22 on its side.

FIG. 34 is a side elevation view of the trench box of FIG. 22 showing the process of a side panel rotating about a lower attachment to lay flat.

DETAILED DESCRIPTION

There will be given below a general description of a trench box, after which two examples of trench boxes will be given, namely, a smaller format trench box, described with respect to FIG. 1 through 36, and a larger format trench box, described with respect to FIG. 37 through 46. Additional details regarding a universal connection system for both the smaller format and larger format trench box will be described with respect to FIGS. 24-30 and FIG. 50-65. The terms "smaller format" and "larger format" are intended to be relative to each other, and may be designed to the particular size required by the end user. It will also be understood that, while the overall designs of the different formats share many design concepts, there are some differences that arise based on the particular considerations related to the size and weight of the respective trench box. It will be understood that these design considerations are transferrable between designs, and may be incorporated in either one or the other, or another example of a trench box may be designed. The end design will depend, of course, on the dimensions and specifications required by the end user, the available materials and resources, the equipment available for installing and/or removing the trench box, etc. As such, unless it is clear that particular features are mutually exclusive, the options described with respect to one design may be incorporated into the other design.

Figure 1:
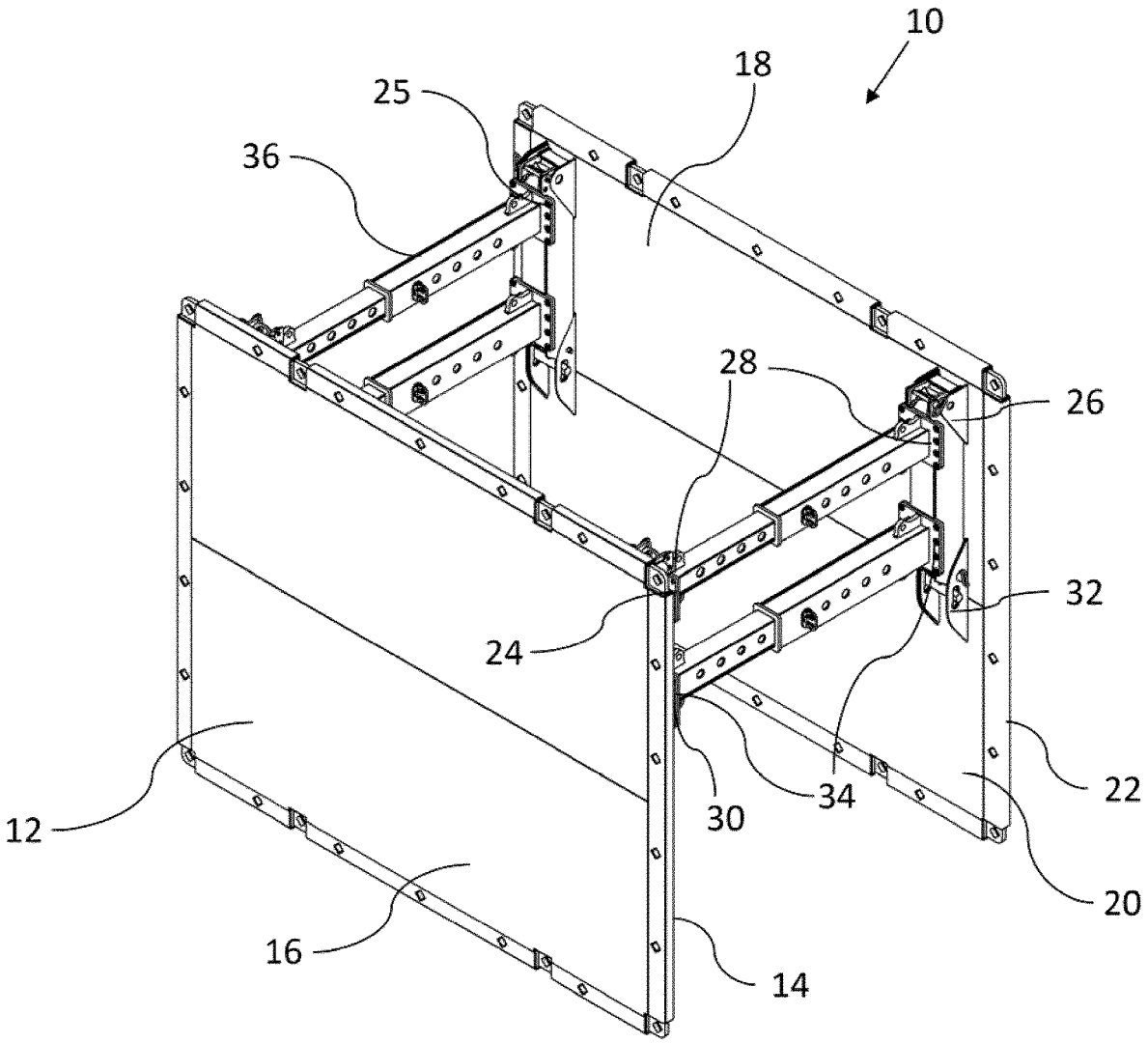
FIG. 1 is a perspective view of an embodiment of a trench box.
Figure 2:
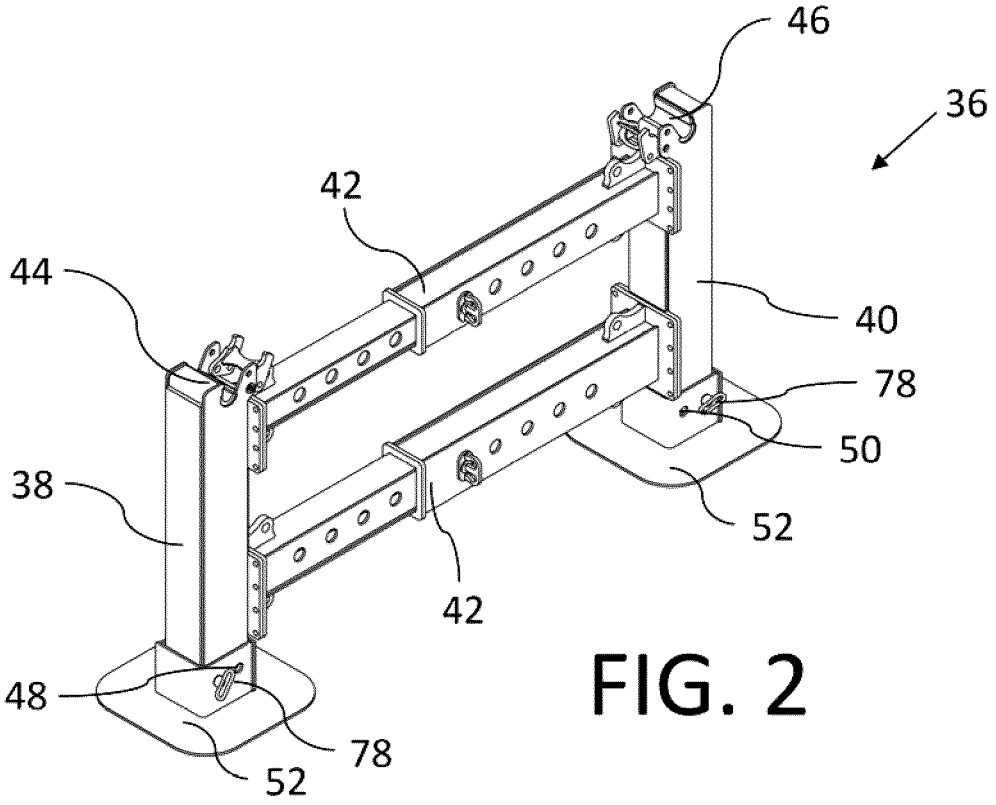
FIG. 2 is a perspective view of a support structure.
Figure 6:
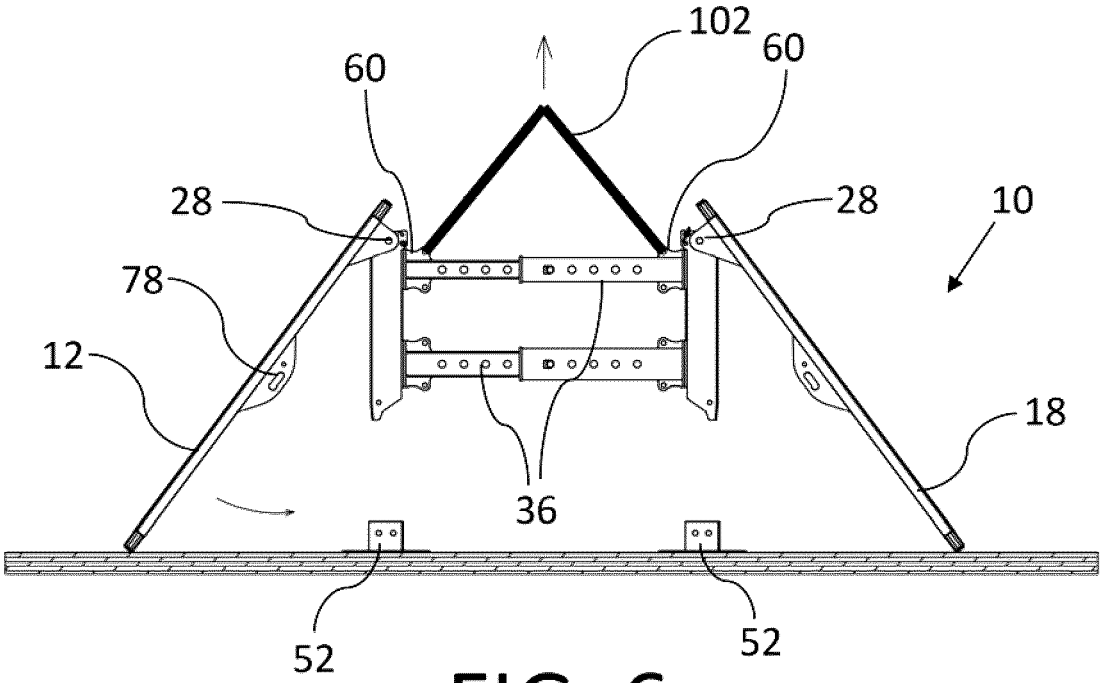
FIG. 6 is a side elevation view of the trench box of FIG. 1 being lifted away from a stand.
Figure 41:
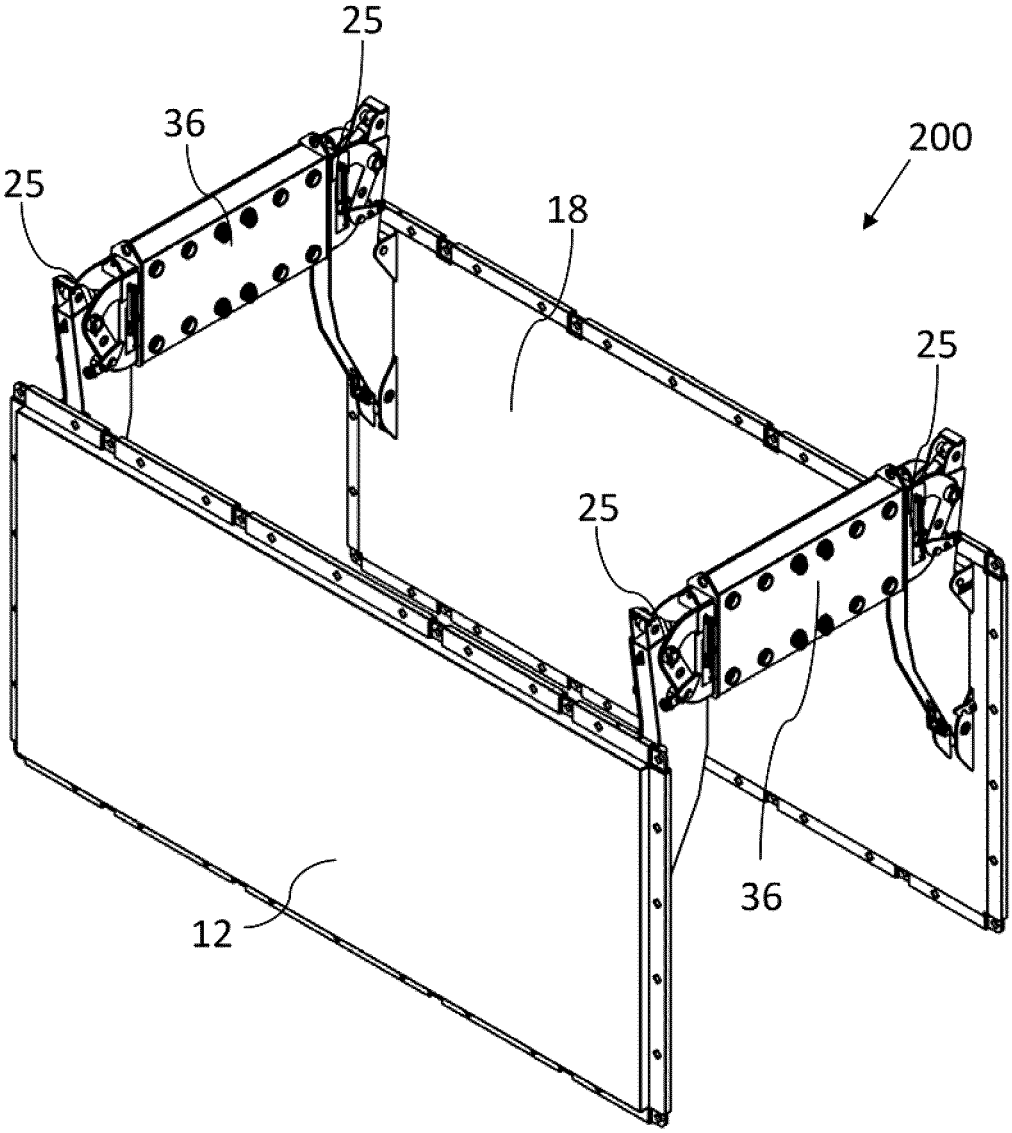
FIG. 41 is a perspective view of a larger format trench box in an operational position.
Figure 44:
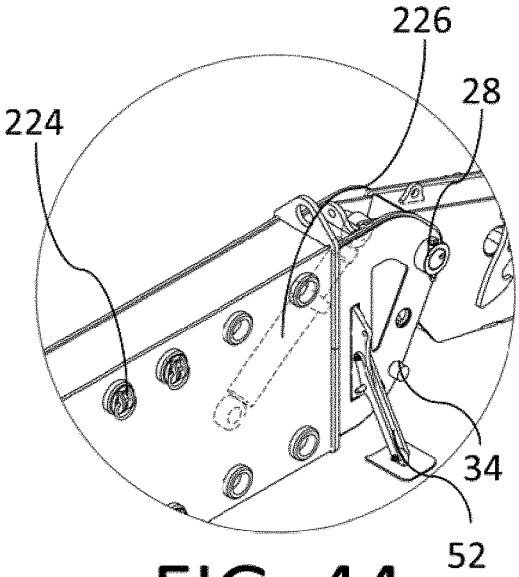
FIGS. 44 and 45 are detailed perspective views of a snubbing device.
Figure 45:
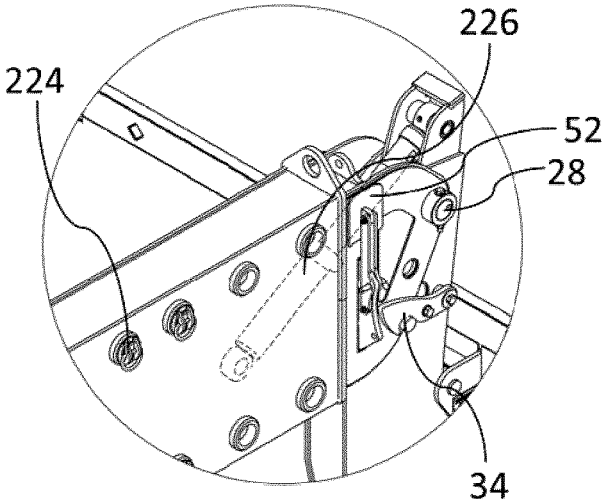

Referring to FIG. 1, a smaller format trench box 10 is shown, while in FIG. 41, a larger format trench box 200 is shown. Elements that perform a similar function are identified by similar reference numbers. Trench boxes 10 and 200 have a first side panel 12 with an inner face 14 and an outer face 16, and a second side panel 18 with an inner face 20 and an outer face 22. Trench boxes 10 and 200 are assembled with side panels 12 and 18 being attached to lateral supports 36, of which there are shown two, but there may be only one, or three or more. Each lateral support 36 has connection points 25 at either end of the lateral support that connect first and second side panels 12 and 18 to lateral supports 36. Each connection point has a pivot connection 28 and a releasable connection 34. Pivot connection 28 permits pivotal movement of the side panels relative to lateral supports 36 about a pivot axis that is parallel to side panels 12 or 18 and perpendicular to lateral supports 36. Releasable connection 34 is spaced from pivot connection 28 in a direction perpendicular to the pivot axis, and generally below pivot connection 28 to facilitate construction and operation. Releasable connection 34 is selectively releasable to permit side panels 12 and 18 to pivot about the pivot axis. Referring to FIGS. 2 and 41, lateral support 36 may have stands 52 that support the lateral support with pivot connection 28 above releasable connection 34. In other embodiments, trench boxes 10 and 200 may be designed with pivot connection 28 below releasable connection 34. Stands 52 may be integrally formed (not shown), removable (as shown in FIG. 6), or retractable (as shown in FIGS. 44 and 45). The number, location, and size of stands 52 may vary depending on the requirements or preferences of the user. Stands 52 permit lateral supports to remain upright on a ground surface. If lateral supports were suspended from above, stands 52 may not be required.

Small Format Trench Box

Referring to FIG. 1, smaller inner faces 14 and 20 have upper attachment points 24 and 26, respectively. Upper attachment points 24 and 26 are the first part of a two-part upper attachment 28. Inner faces 14 and 20 also have lower attachment points 30 and 32, respectively. Lower attachment points 30 and 32 are the first part of a two-part lower attachment 34.

Figure 9:
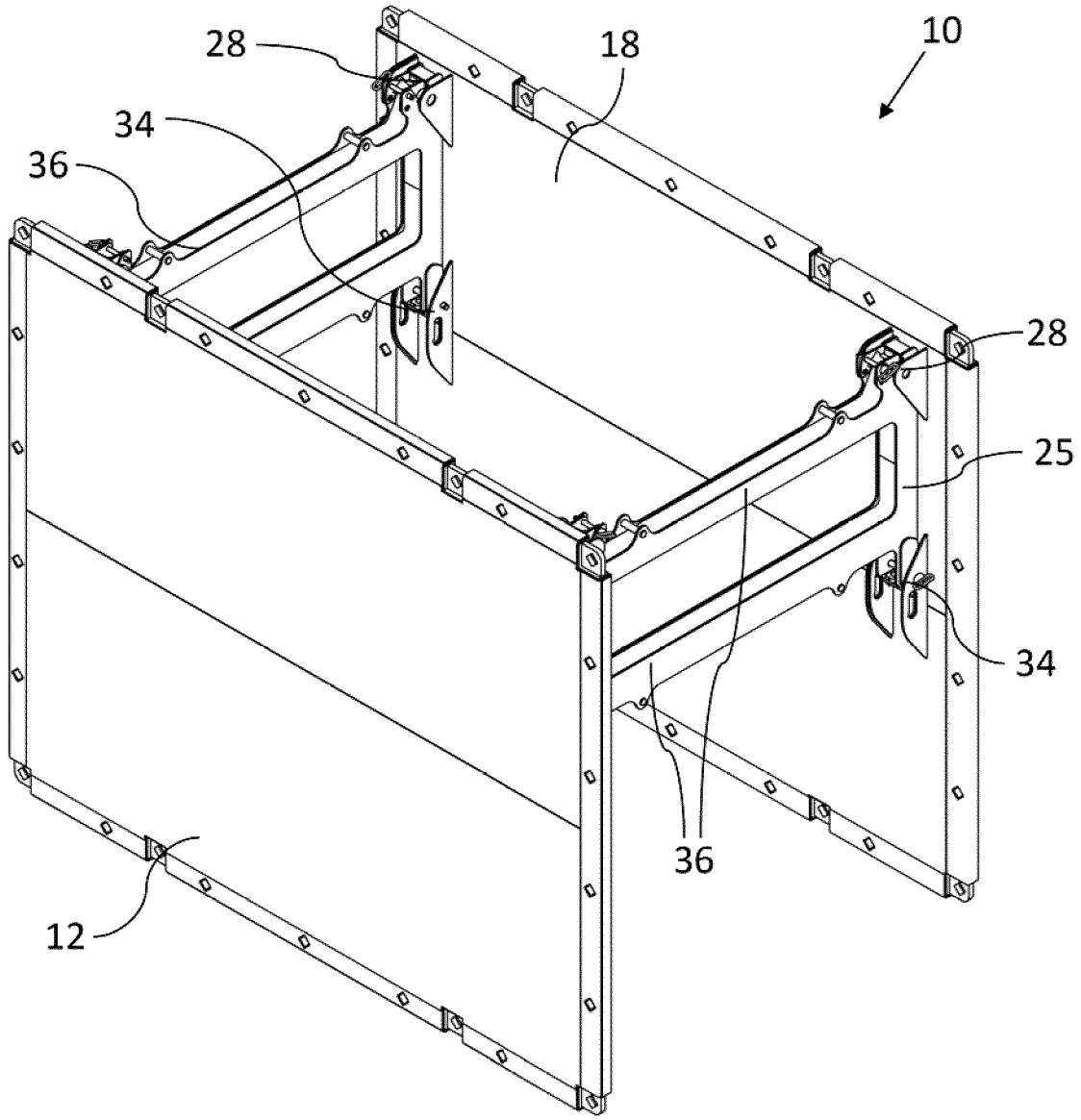
FIG. 9 is a perspective view of a trench box with an alternate support structure.

Trench box 10 is assembled and secured using lateral supports 36. As shown in FIG. 1, trench box 10 has two lateral supports 36. It will be understood that, depending on the application and factors such as the length of trench box needed 10, there may be only one lateral support 36, or additional lateral supports 36 may be used. Referring to FIG. 2, lateral support 36 has a first side support 38 and a second side support 40. Side supports 38 and 40 are separated and stabilized by lateral supports 36. Lateral supports 36 may be formed from two separate lateral components 42 as shown in FIG. 2. Lateral supports 36 maintain first side support 38 in a fixed position and orientation relative to second side support 40. Side supports 38 and 40 may be fixedly attached to lateral supports 36, removable, or pivotally movable relative to lateral supports 36, as will be described elsewhere. As shown in FIG. 2, lateral supports 36 may be length-adjustable to adjust the spacing between the first and second side supports. Once the length has been adjusted, lateral supports 36 maintain the relative positions of side supports 38 and 40 at the desired spacing. Alternatively, lateral supports 36 may be of a fixed length and constructed as a single piece, as shown in FIG. 9. In this case, different sizes of lateral supports may be provided to allow for different sizes of trench boxes.

First and second side supports 38 and 40 have upper attachment points 44 and 46, respectively. Upper attachments points 44 and 46 are the second part of the two-part upper attachments 28, and pivotally engage the first parts 24 and 26 of upper attachments 28. First and second side supports 38 and 40 also have lower attachment points 48 and 50, respectively. Lower attachments points 48 and 50 are the second parts of the two-part lower attachments 34, and fixedly engage the first parts 30 and 32 of lower attachment 34. Each of upper attachment 28 and lower attachment 34 selectively engage and disengage. Upper attachment 28 and lower attachment 34 may be a variety of types of connections, as will be understood by a person skilled in the art. For example, either or both of upper attachment 28 and lower attachment 34 may be pin connected, as shown. In one example, referring to FIG. 8, second parts 48 and 50 of lower attachment 34 have an engagement surface 54, such as an angled face in a preferred example, and first parts 30 and 32 of lower attachment 34 have a receiver 56 having a pin 58 that slides along engagement surface 54 to retain engagement surface 54 where it is received within receiver 56. Upper attachment 28 is a pin connection, which permits a pivotal movement, and lower attachment 34 also preferably has a pin connection to provide an additional connection point, while engagement surface 54 and pin 58 provide a tighter and stronger connection. While the drawings show engagement surfaces 54 on lateral supports 36 and pin 58 on panels 12 and 18, it will be understood that this could be reversed, e.g. with engagement surfaces 54 on panels 12 and 18 and pins 58 could be on lateral supports 36.

Figure 4:
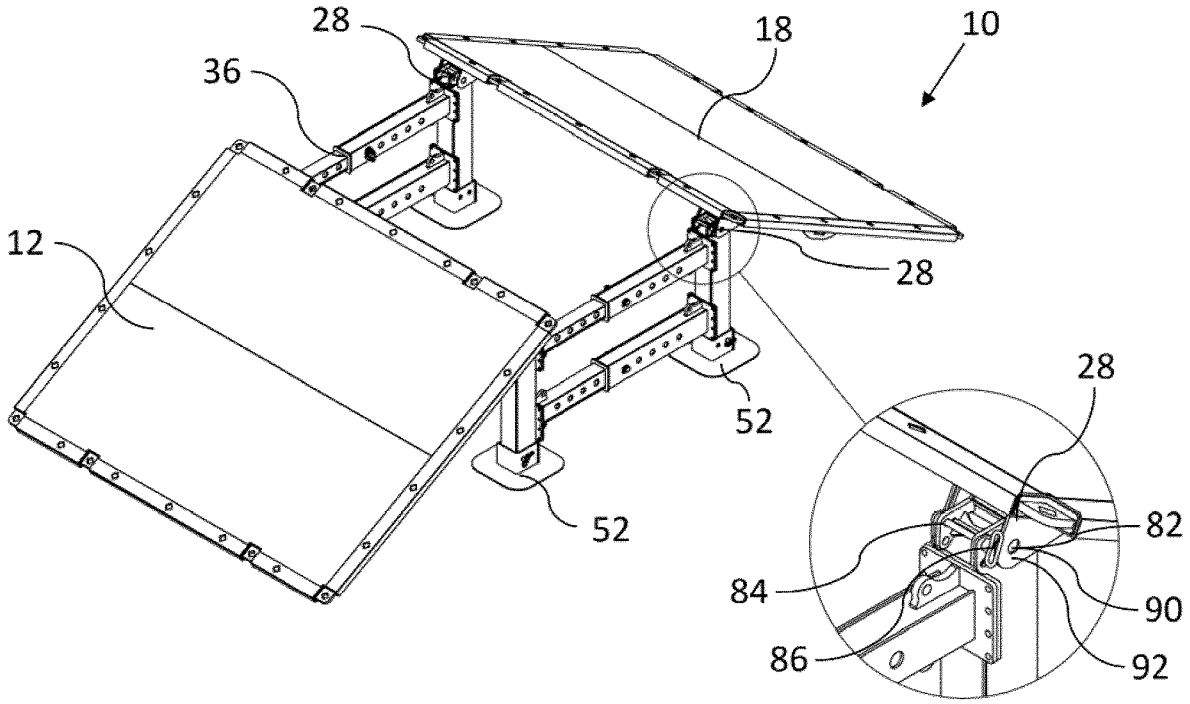
FIG. 4 is a perspective view of the trench box of FIG. 1 with panels attached to upper attachments.
Figure 22:
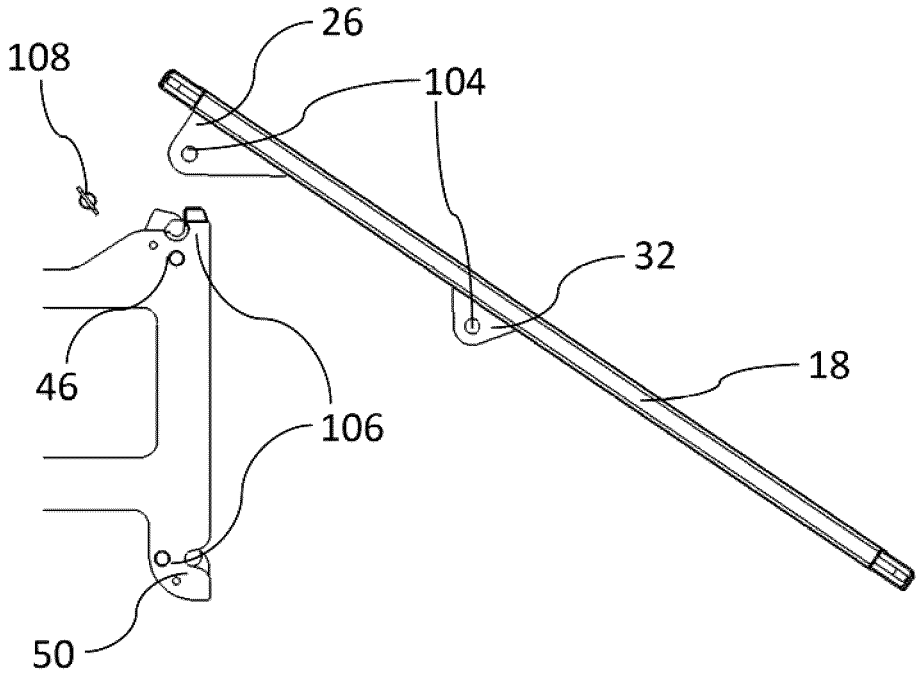
FIG. 22 is a side elevation view in section of a trench box with an alternate attachment system.
Figure 23A:
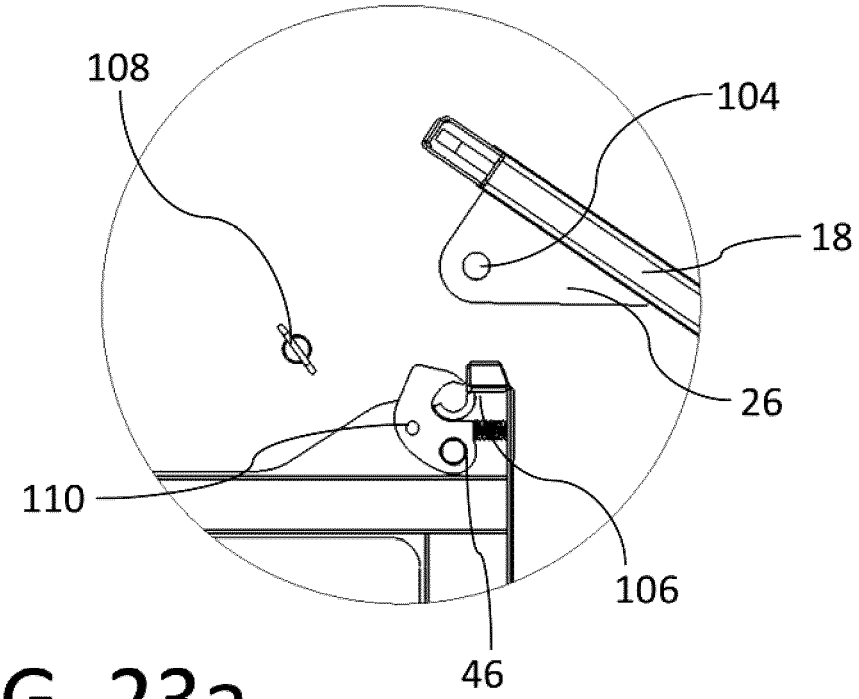
FIG. 23*a* is a side elevation view of the trench box of FIG. 22 showing a detailed view of an upper attachment.
Figure 23B:
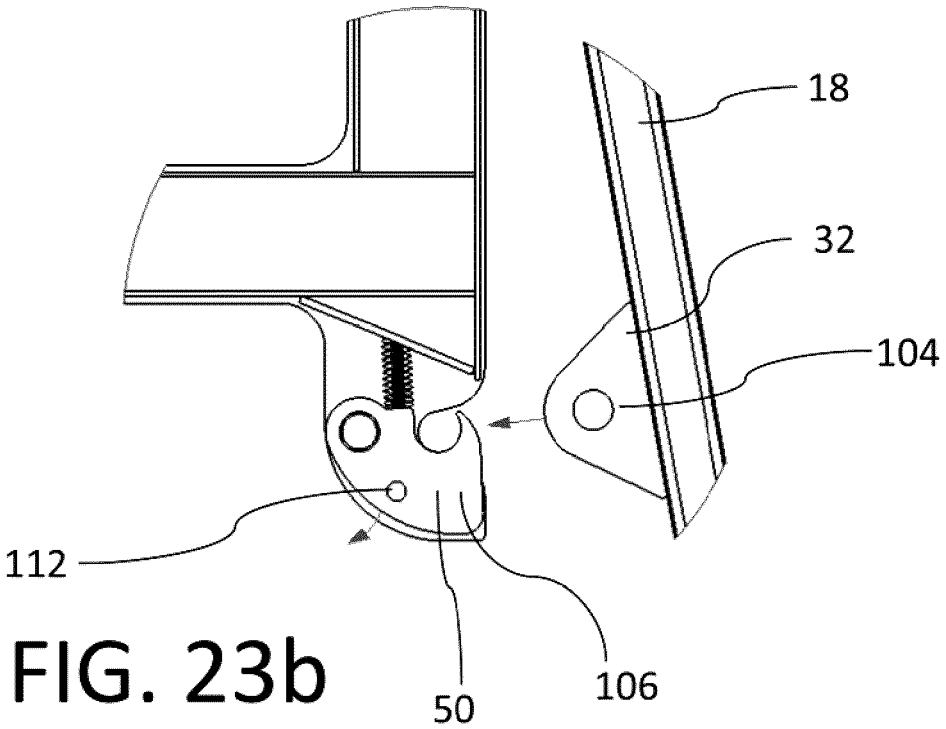
FIG. 23*b* is a side elevation view of the trench box of FIG. 22 showing a detailed view of a lower attachment.

In another example, either or both of upper attachment 28 and lower attachment 34 may be spring loaded attachments as shown in FIG. 22 and FIG. 23. Referring to FIG. 22, upper attachment point 26 and lower attachment point 32 of second side panel 18 have brackets and posts 104 allowing them to be placed into spring loaded connectors 106 of upper attachment point 46 and lower attachment point 50. As previously discussed, the brackets and posts 104 may also be carried by upper attachment point 44 and lower attachment point 50, while upper attachment point 26 and lower attachment point 32 may be spring loaded connectors 106. Referring to FIG. 23*a*, upper attachment 28 is formed by engaging bracket and post 104 with spring loaded connector 106. A safety pin 108 may then be inserted into opening 110 to prevent accidental disengagement of upper attachment 28. Referring to FIG. 23*b*, lower attachment 34 may be formed by engaging bracket and post 104 with spring loaded connector 106. Safety pin 108 may be inserted into opening 112. It will be understood that upper attachment 28 and lower attachment 34 may both be spring loaded attachments, or they may be used in combination with other attachments, such as those previously described. For example, upper attachment 28 may be a fixed attachment as shown in FIG. 4, while lower attachment 34 may be a spring loaded attachment as shown in FIG. 23*b*. Other combinations may be used, as will be understood by those skilled in the art.

Trench box 10 further has stands 52 for supporting lateral support 36 in a vertical orientation with second parts 44 and 46 of upper attachments 28 above second parts 48 and 50 of lower attachments 34. As shown in FIG. 2, stand 52 is removably attached to the second parts 48 and 50 of lower attachment 34. However, it will be understood that stand 52 may also be shaped to be integrally formed with lateral support 36, or may be attached to different areas of lateral support 36, depending on the application. For example, stand 52 may be flanges that are attached to the sides or bottom of lateral support 36, may be attached by a hinge such that they can be folded back, or lateral support 36 may have a flat bottom that is wide enough to stand on its own on some surfaces. Stand 52 is useful for allowing lateral support 36 to be self-supporting in order to facilitate the connection of upper attachments 28 between lateral supports 36 and panels 12 and 18 with lateral supports 36 in an upright position. As shown, stand 52 may be removably connected to second parts 48 and 50 of lower attachment 34. Stand 52 may then be removed to allow lower attachment 34 to be connected.

Referring to FIG. 4, support stands 52 are preferably shorter than the height of panels 12 and 18, and are connected below the upper edge of first and second panels 12 and 18 such that, when the first parts 12 and 18, and second parts 44 and 46, of the upper attachment 28 are connected and the stand 52 supports lateral support 36 on a ground surface, first and second panels 12 and 18 are angled downward and outward relative to lateral support 36. Preferably, upper attachment 28 is positioned on first and second panels 12 and 18 such that a first distance between the first parts 24 and 26 of upper attachment 28 and a lower edge of the respective panel 12 or 18 is greater than a second distance between the second parts 44 and 46 of upper attachment 28 and the stand 52.

Referring to FIG. 6, each lateral support 36 preferably has lifting lugs 60 that permit lateral supports 36 to be suspended by a lifting device (not shown) such as a crane, excavator bucket, etc. so that the panels 12 and 18 are free to pivot about upper attachments 28 when lateral support 36 is lifted sufficiently, i.e. to about the height of the panels 12 and 18.

Figure 24:
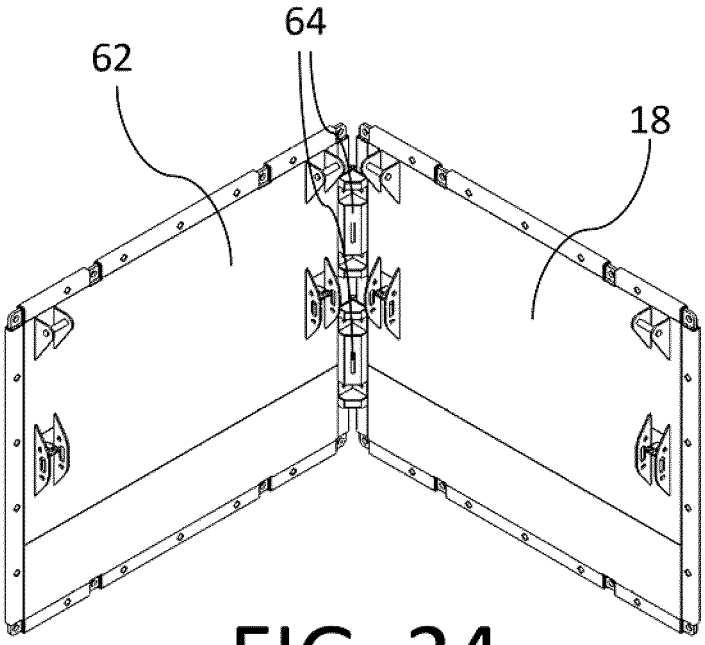
FIG. 24 is a perspective view of two side panels assembled using a corner bracket.
Figure 25:
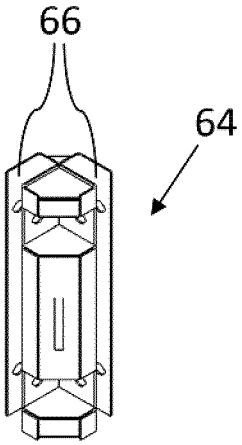
FIG. 25 is a perspective view of a corner bracket.
Figure 29:
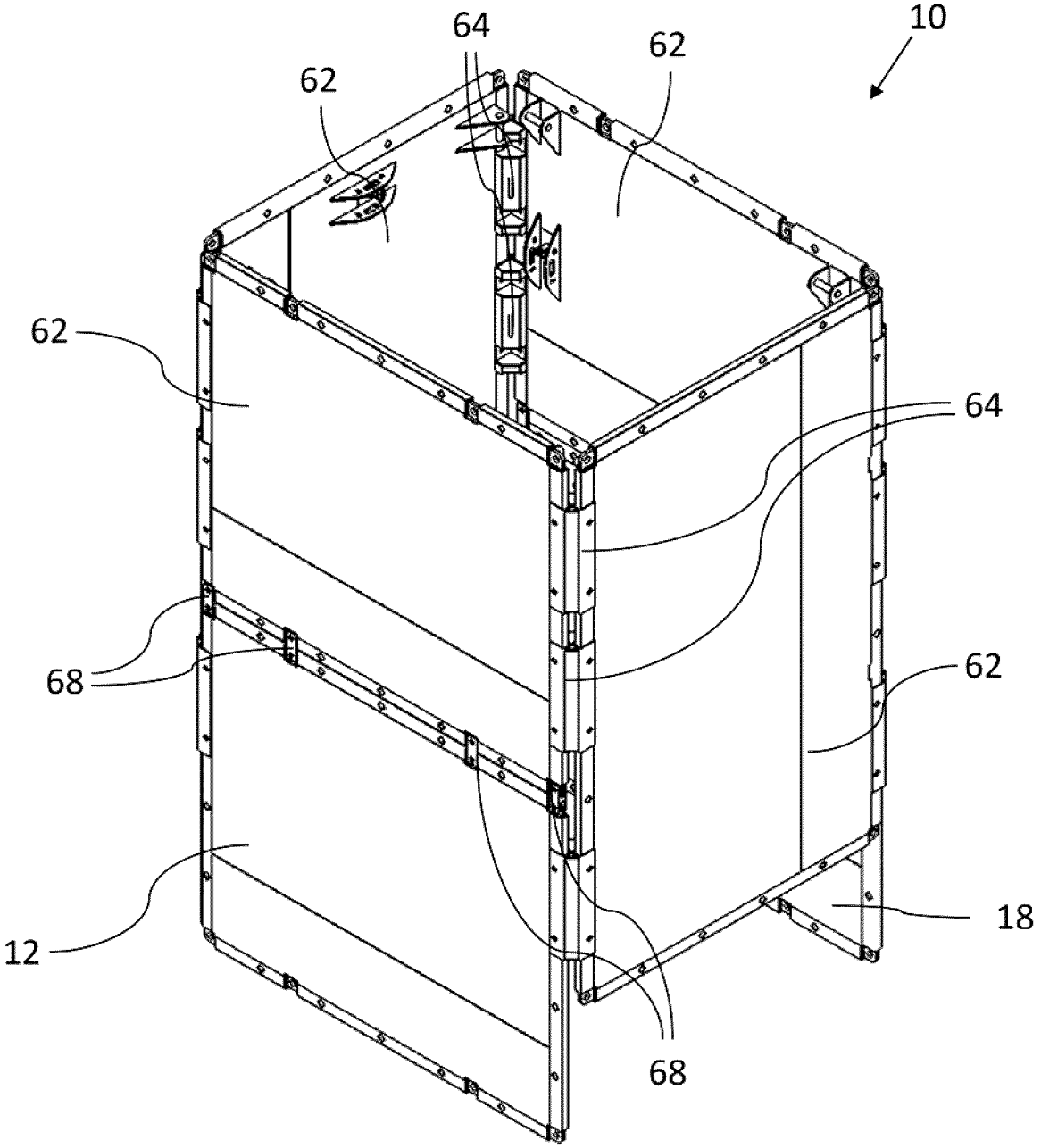
FIG. 29 is a perspective view of a trench box assembled using both corner and inline brackets.

Referring to FIG. 29, trench box 10 may be assembled with additional panels connected to first and second side panels 12 and 18. As shown in FIG. 24, trench box 10 may be assembled with one or more third side panels 62 that attach to and extend between first side panel 12 and second side panel 18. Additional side panels may be attached using a variety of means, as will be understood by those skilled in the art. In the depicted embodiment, third side panel 62 is attached using a corner engagement member 64, or bracket. Corner bracket 64 has perpendicular slots 66 as shown in FIG. 25 that engage first and second side panels 12 and 18, as well as third side panel 62. It will be understood that, rather than perpendicular slots 66, another type of engagement profile may be used, such as a pin connection against a flat surface or other clamping design that allows third side panel 62 to be held perpendicularly to first and second side panels 12 and 18.

Figure 26:
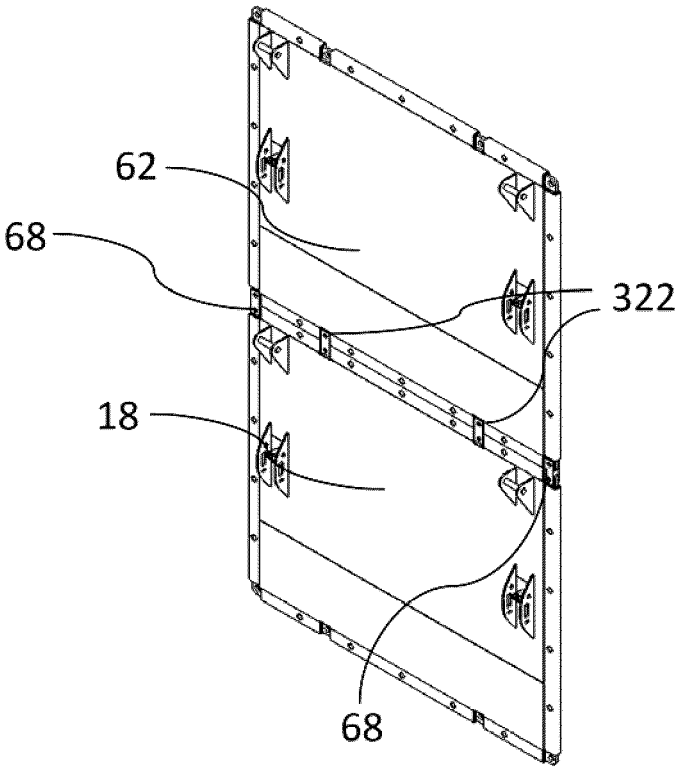
FIG. 26 is a perspective view of two side panels assembled using an inline bracket.
Figure 27:
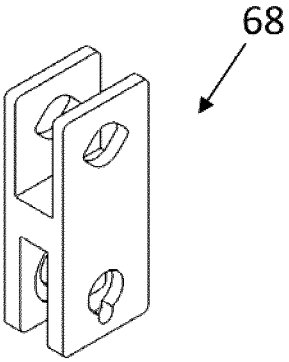
FIG. 27 is a perspective view of an inline bracket.

As shown in FIG. 26, third side panel 62 may also be attached to and extend above a top edge of one of the first and second side panels 12 and 18. Third side panel 62 may be attached using a variety of engagement methods known in the art. As shown, third side panel 62 is attached to the top edge of second side panel 18 using an H-shaped engagement member 68, or bracket, as shown in FIG. 27. Bracket 68 is described as being H-shaped because of the slots that receive the respective panels. It will be understood that bracket 68 may have a different type of engagement profile, as with corner bracket 64, that secures third side panel 62 in the desired orientation and position; in this case, in parallel and in plane with first or second side panel 12 or 18, as the case may be.

Figure 28:
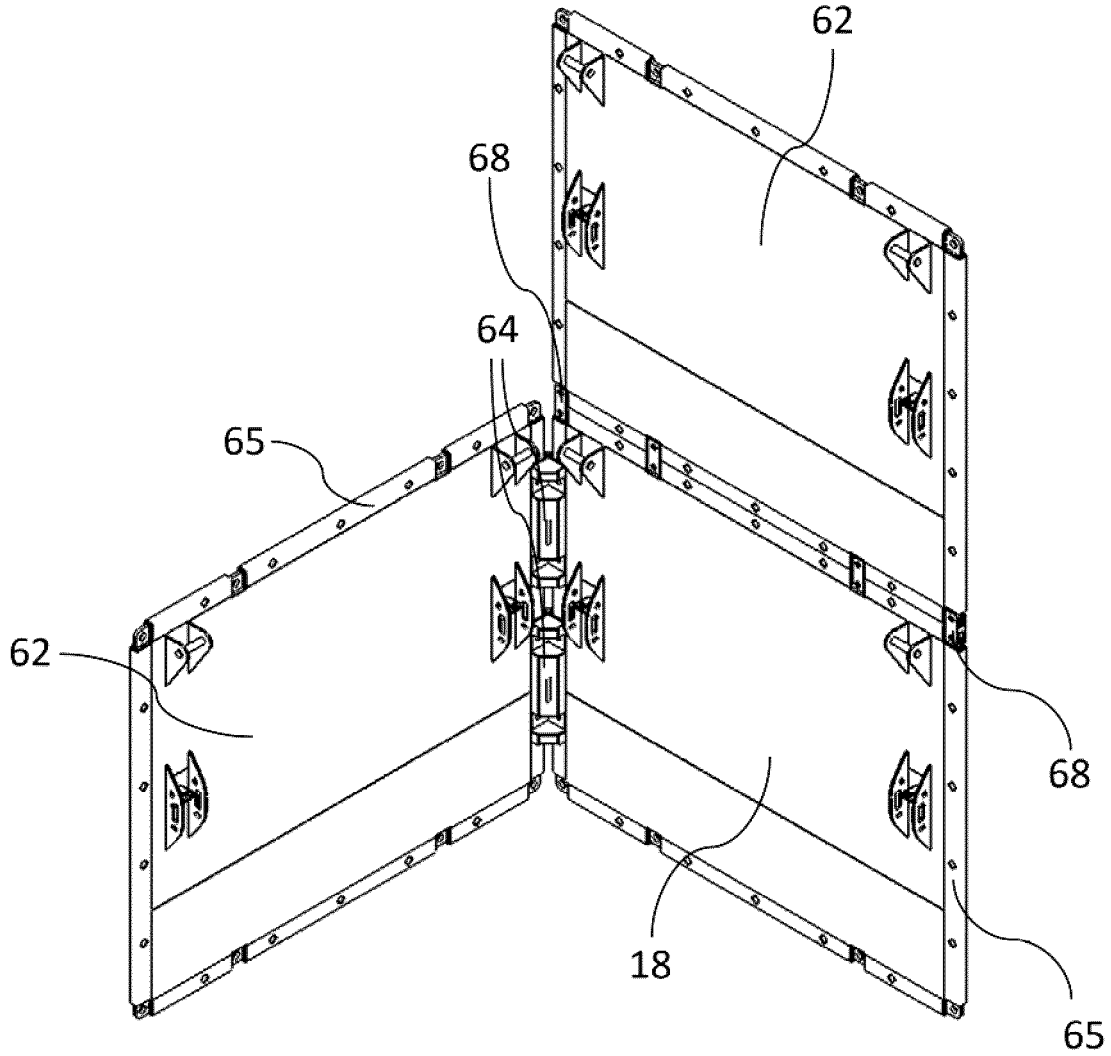
FIG. 28 is a perspective view of side panels assembled using both corner and inline brackets.

Referring to FIG. 28, first and second side panels 12 and 18 preferably have a universal engagement profile 65 on the perimeter of the panels that has a plurality of connection points that are evenly spaced along the outer peripheral edge of panels 12 and 18. Preferably, the connection points extend along the entire peripheral edge as shown, but the connection points may also be only on a portion of each side, or a portion of one or more sides, as the case may be. A removable connector (not shown) is provided that engages engagement profile 65 in a selected location. Engagement profile 65 and the connector are designed such that the connector may be connected at one or more connection points (depending on the size and shape of the connector) at any point along engagement profile 65. Engagement profile 65 allows panels 12 and 18 to have a universal connection system that allows a variety of connections to be made. For example, referring to FIG. 29, engagement profile 65 allows for trench box 10 to be assembled in a variety of configurations as needed using corner engagement member 64 or H-shaped engagement member 68 as shown. As shown, one panel is shown rotated 90 degrees to a portrait orientation as opposed to the landscape orientation. Engagement profile 65 also allows detachable connections to be made with other equipment, such as with accessories, safety devices, tools, sensors, etc. For example, referring to FIG. 30, first and second side panels 12 and 18 are shown as having a knife edge 100 attached using engagement profile 65, which is useful when installing trench box 10 during excavation. In the depicted examples, the universal connector may be part of brackets 64 and 66, or the universal connectors may mount to, or extend through, brackets 64 and 66.

Figure 18:
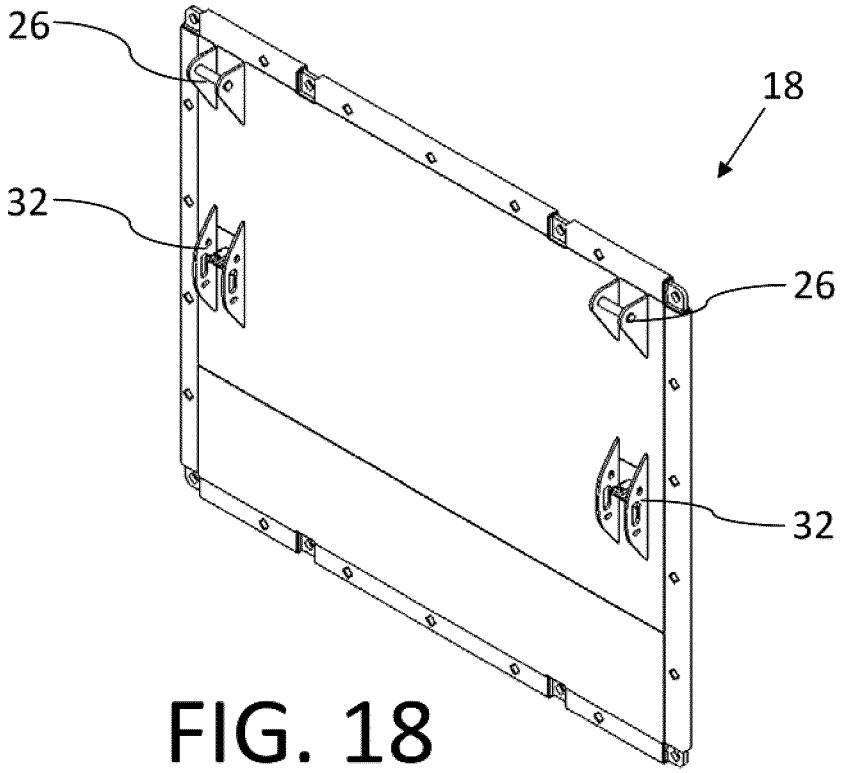
FIG. 18 is a perspective view of a side panel.
Figure 19:
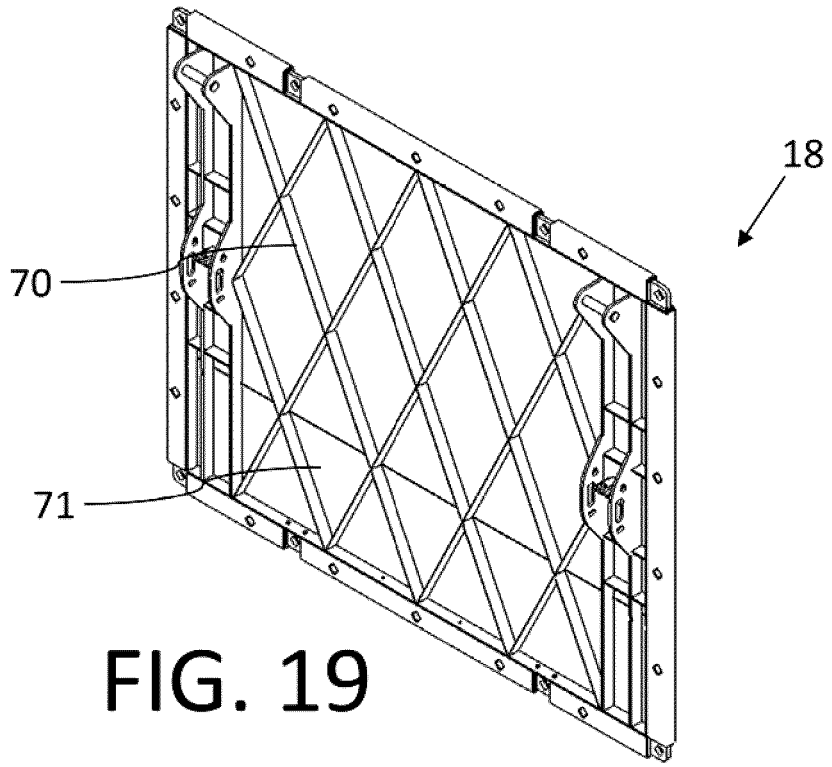
FIG. 19 is a perspective view of a side panel showing the interior structure.

Referring to FIG. 18 and FIG. 19, panels 12, 18, and 62 are preferably designed with a thin outer wall 71 and an internal lateral support 70, such as a diamond shape as shown in FIG. 19. This allows panels 12, 18, and 62 to be lighter, while still being able to withstand the necessary loads.

Method of Assembly—Smaller Format

Figure 3:
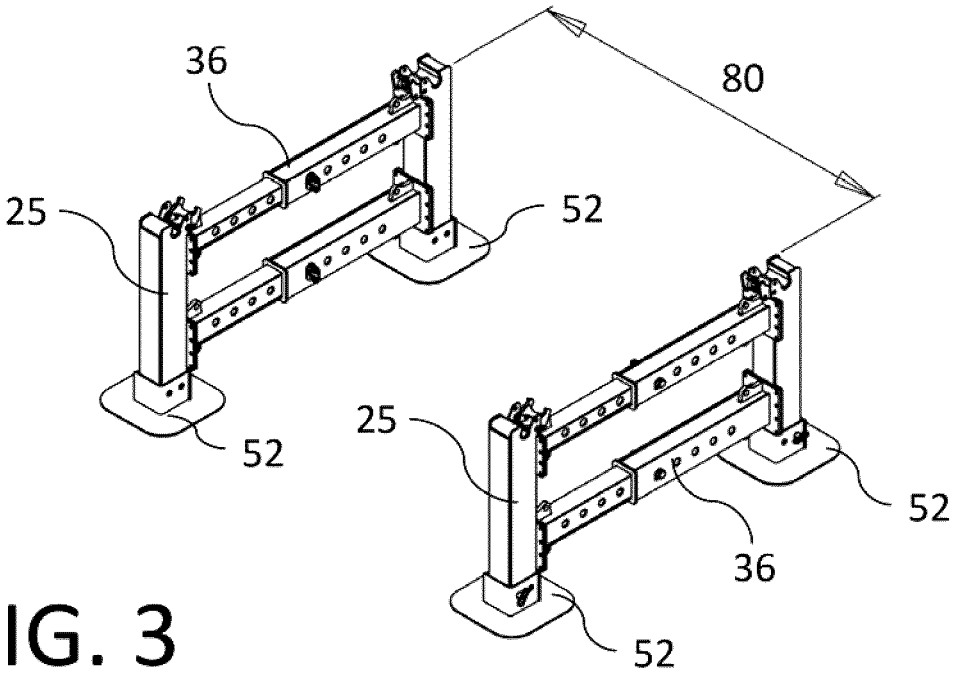
FIG. 3 is a perspective view of two support structures spaced apart from each other.
Figure 5:
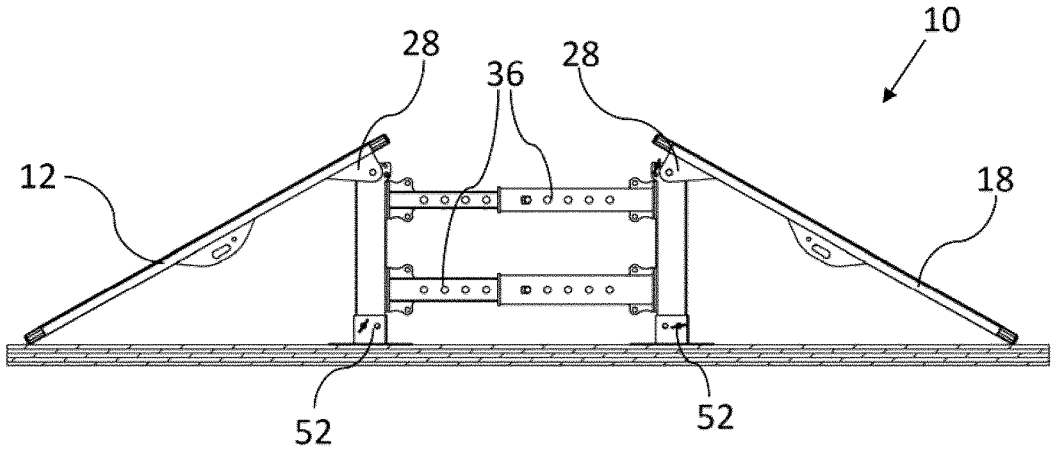
FIG. 5 is a side elevation view of the trench box of FIG. 1 with panels attached to upper attachments.
Figure 20:
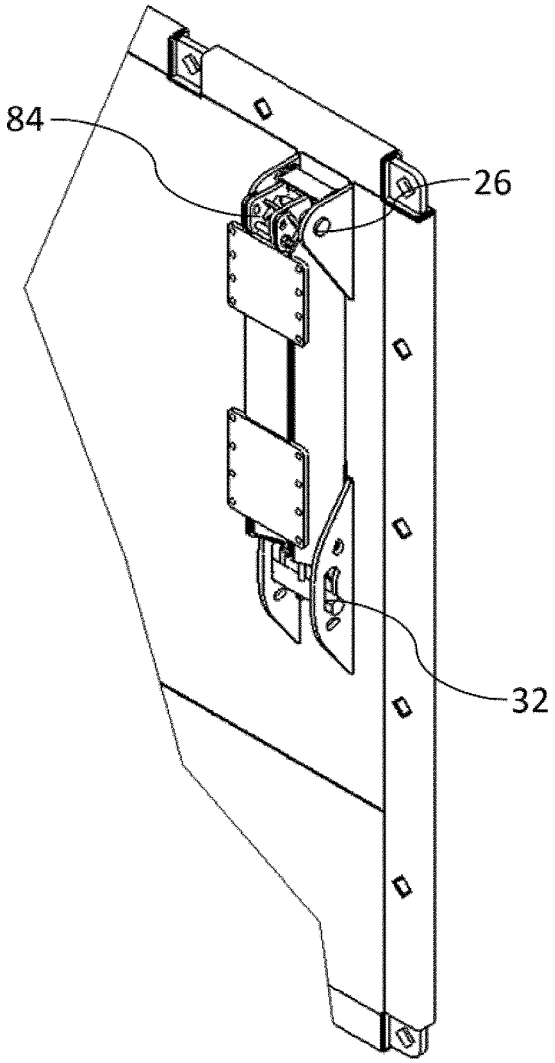
FIG. 20 is a perspective view of a portion of a side panel showing an upper attachment with a closed safety latch.
Figure 21:
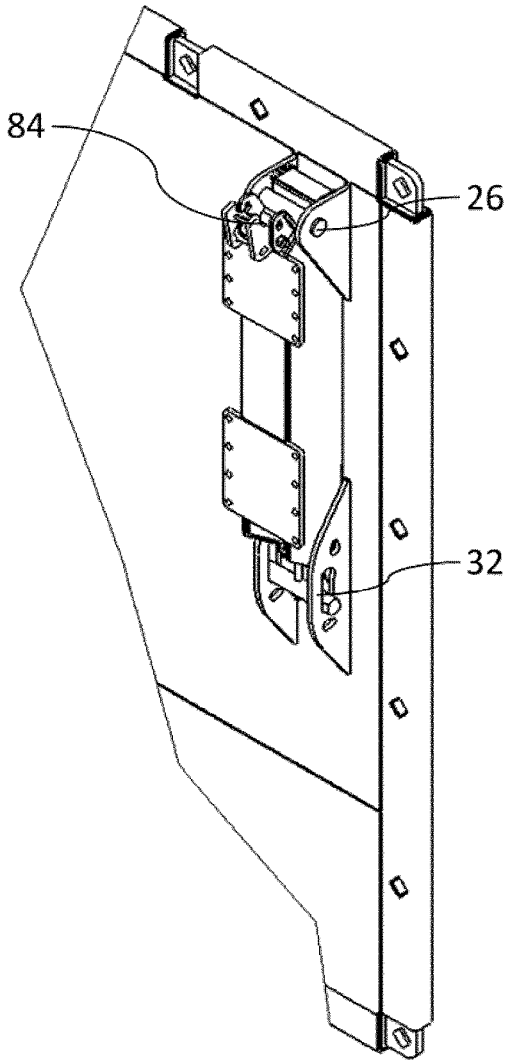
FIG. 21 is a perspective view of a portion of a side panel showing an upper attachment with an open safety latch.

Referring to FIG. 2 through FIG. 8, a method of assembling trench box 10 will be described. Lateral supports 36 are assembled, as required, and in the case that lateral supports 36 have length-adjustable lateral supports 36, lateral supports 36 are adjusted to provide the required separation between first and second side supports 38 and 40. Lateral supports 36 may be adjusted with a pin connection as shown, or with any other length-adjustable connection known in the art, such as threadably adjustable connections, hydraulically adjustable connections, etc. Lateral supports 36 are installed into stands 52, which may be formed with lateral supports 36, or, as shown, may be removably connected. As shown, stands 52 are secured to lateral supports 36 with lock pins 78. Referring to FIG. 3, lateral supports 36 are positioned in spaced relation with a spacing 80, as required for the application, and in a vertical orientation on stands 52. Spacing 80 will be determined by the dimensions of the first and second side panels 12 and 18, and specifically, by the distance between upper attachment points 24 and 26, as well as the distance between lower attachment points 30 and 32. Referring to FIG. 4, side panels 12 and 18 are then set against lateral supports 36 such that upper attachment points 24 and 26 engage with upper attachment points 44 and 46 to form upper attachments 28. Panels 12 and 18 may need to be manipulated by a crane or other lifting device, or may be light enough to be manipulated manually by workers. When connected, upper attachments 28 form a pivotal attachment 82, as shown. Pivotal attachment 82 may be formed by inserting a pin connector 90 into a pin receiver 92, or upper attachments 28 may be otherwise designed with a hinge, and has sufficient movement to allow panels 12 and 18 to be at an angle that still allows lateral supports 36 to rest on the ground. Upper attachments 28 are positioned toward the top of each of the first and second panels 12 and 18 and toward the top of the lateral supports 36. As shown in FIG. 4 and FIG. 5, when attached, first and second side panels 12 and 18 are angled down and away from lateral supports 36 and rest on the ground surface. Upper attachments 28 preferably have a safety latch 84 in addition to pivotal attachment 82, and safety latch 84 preferably has a lock pin 86 to prevent accidental disengagement of safety latch 84 and pivotal attachment 82. FIG. 20 and FIG. 21 show one embodiment of a safety latch 84 in a closed positon and an open position, respectively.

Figure 7:
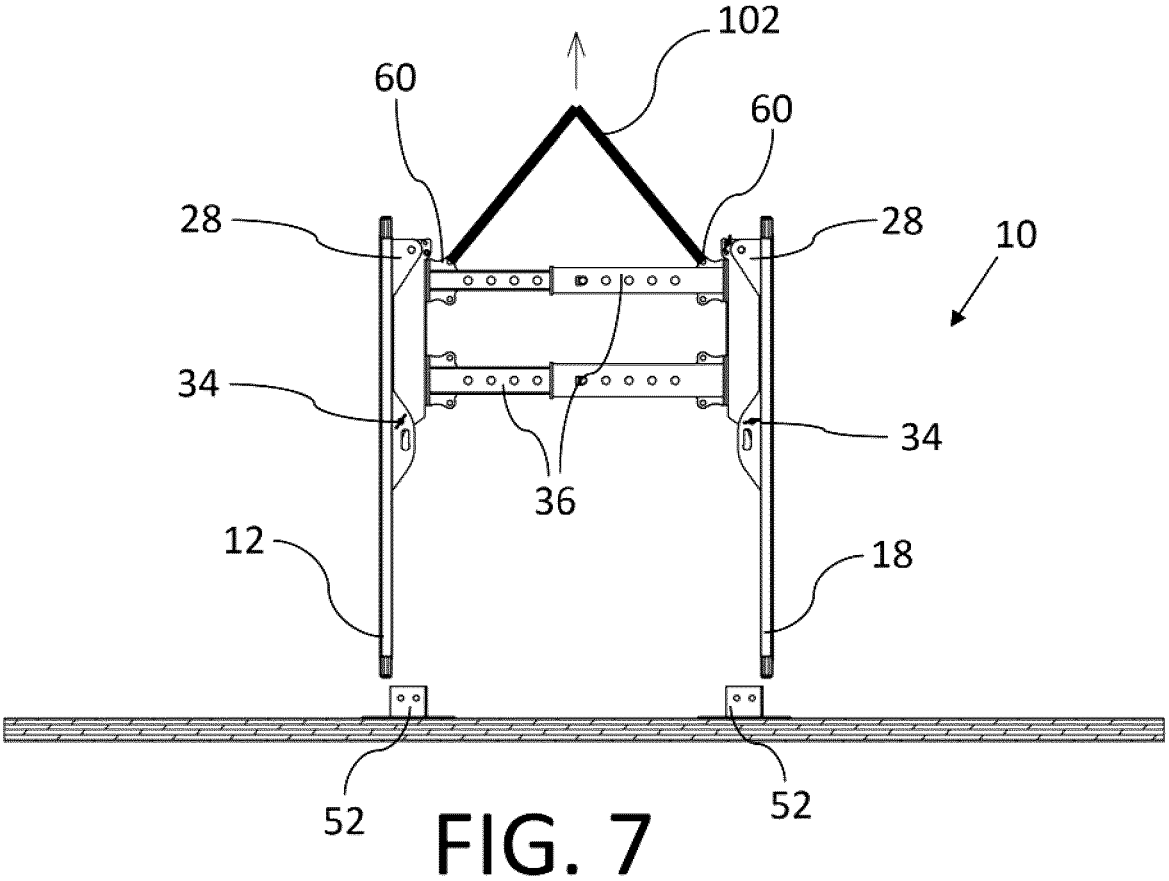
FIG. 7 is a side elevation view of the trench box of FIG. 1 with panels attached to the upper and lower attachments.
Figure 7A:
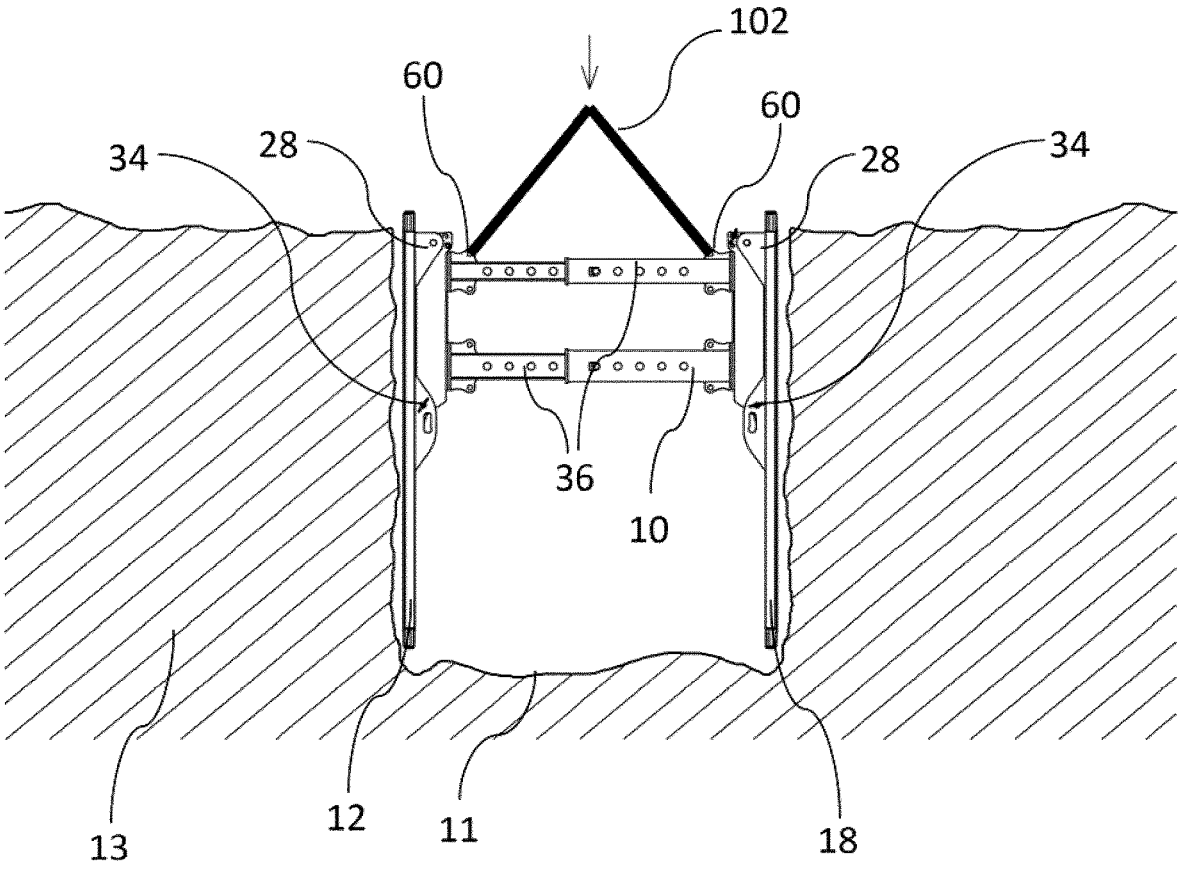
FIG. 7A is a side elevation view of the trench box of FIG. 1 being lowered into a trench.
Figure 8:
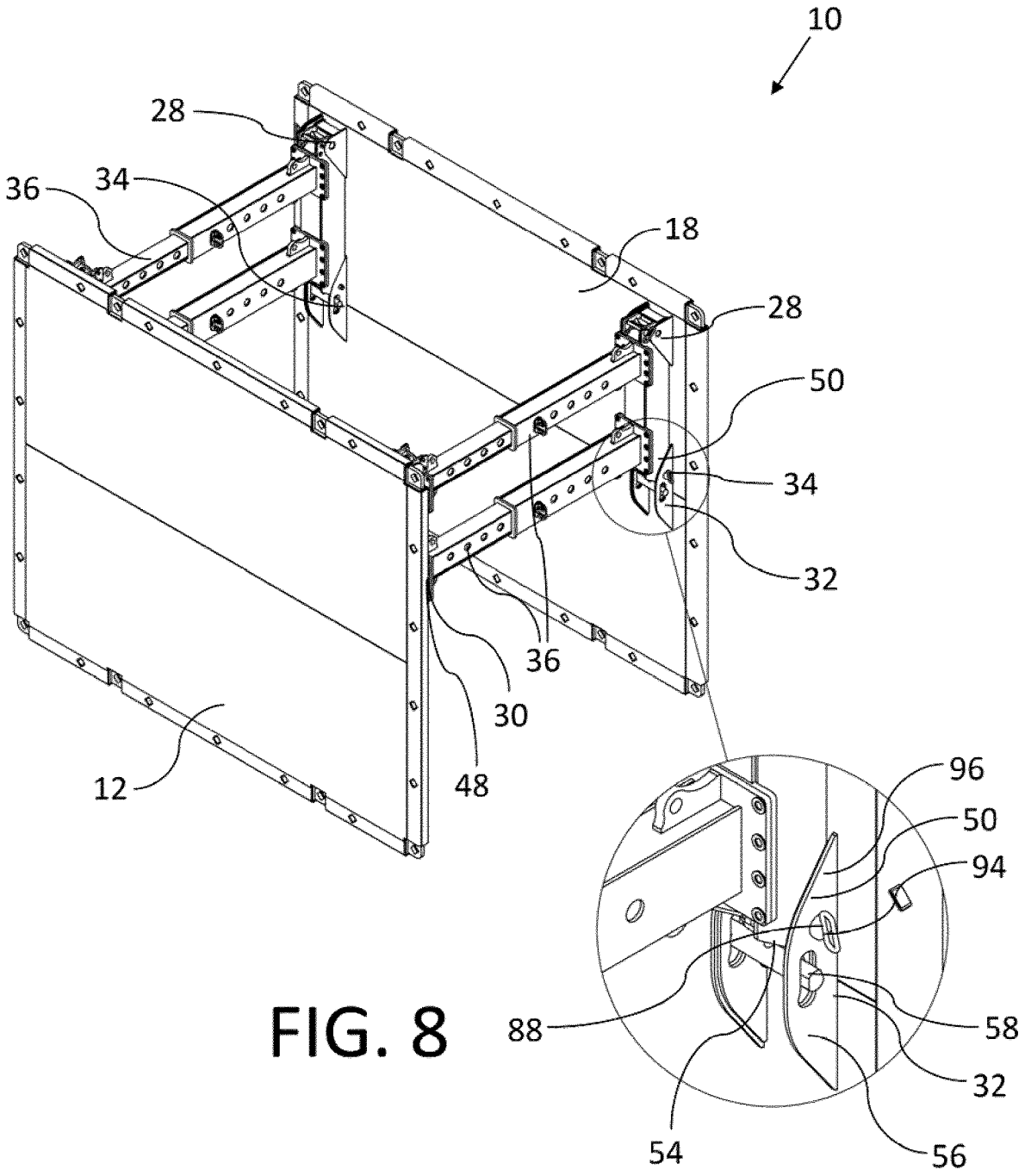
FIG. 8 is a perspective view of the trench box of FIG. 1 with panels attached to the upper and lower attachments showing a detailed view of a lower attachment.

Referring to FIG. 6, a lifting device, such as a crane, excavator bucket, or other device known in the art and represented by lifting sling 102, may then be attached using lifting lugs 60. When stands 52 are removably attached to lateral supports 36, the connection between lateral supports 36 and stands 52 are disengaged. As shown, lock pins 78 are removed from stands 52, and lateral supports 36 are lifted. As shown, this results in first and second panels 12 and 18 pivoting about upper attachments 28 toward the lateral supports 36. As shown in FIG. 7, when lateral supports 36 are lifted sufficiently, first and second panels will contact lateral supports 36 and will be vertically oriented. Stands 52 may be removed by disconnecting them once panels 12 and 18 are attached, such that lateral supports 36 are lifted out of stands 52 as sling 102 lifts trench box 10. Referring to FIG. 8, lower attachment points 30 and 32 of first and second panels 12 and 18 contact lower attachment points of 48 and 50 at a point below pivotal attachment 82. Receiver 56 of lower attachment points 30 and 32 receives angled surface 54 of lower attachment points 48 and 50. Pin 58 can be slid into receiver 46 and slides along angled surface 54 to provide a tight angled lock connection, retaining angled surface 54 within the retainer. Lower attachment 34 also preferably has a locking pin 88 to prevent accidental disengagement of lower attachment 34. Lower attachment 34 may initially be formed by inserting pin connector 94 into pin receiver 96. Pin connector 94 may be the same as locking pin 88, or separate pin connectors may be provided, depending on the requirement of the application. FIG. 20 and FIG. 21 also show one embodiment of an angled lock connection in a closed positon and an open position, respectively. Trench box 10 is then inspected to ensure that all attachments are secure, all safety pins and latches are properly installed, and the angled lock is tight. Trench box 10 may then be lowered into the trench 11 formed in ground surface 13, as shown in FIG. 7A.

Additional panels may also be installed on trench box 10, depending on the application. For example, one or more third side panels 62 may be attached by sliding corner engagement members 64 onto the sides of first side panel 12 and second side panel 18 and only third side panel 62, or by sliding H-shaped engagement member 68 onto the top edge first side panel 12 or second side panel 18 and inserting third side panel 62. This may be done to create an enclosed trench box 10, a box with higher sides, or even, by attaching panels of different sizes, an enclosed trench box 10 with access openings. As can be seen, the components described above allow for a modular trench box 10 design, where the ultimate size, shape and configuration can be designed according to the requirements of the situation.

Method of Disassembly—Smaller Format

Referring to FIG. 10 through 17, disassembly of trench box 10 will now be described with respect to a variation of lateral supports 36. It will be understood that the assembly procedure described above and the disassembly procedure described below are applicable to these and other possible variations of lateral supports 36. It will also be understood that other methods of assembly and disassembly may also be used, according to the preferences of the user, and the ultimate design of trench box 10 and its component parts. In particular, the attachment points described above and below are those provided at convenient locations for manipulating trench box 10, however it will be understood that other attachment points or lifting strategies may be used.

Figure 10:
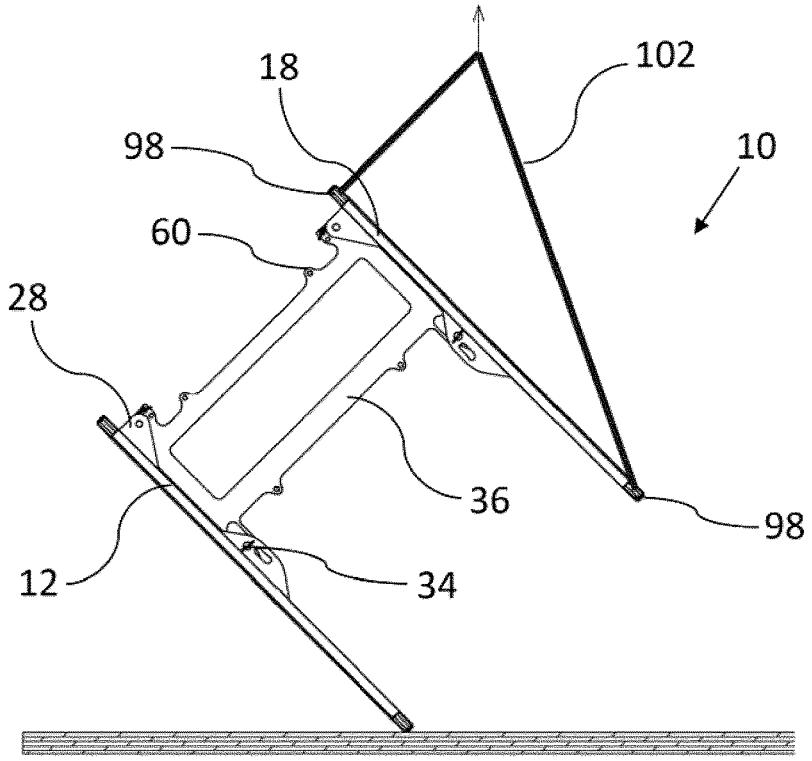
FIG. 10 is a side elevation view of the trench box of FIG. 9 being rotated for disassembly.
Figure 11:
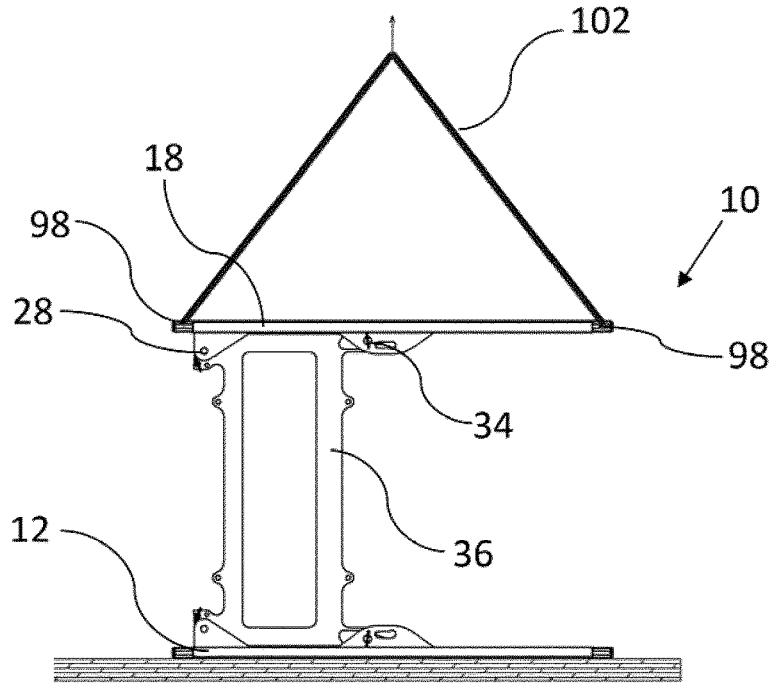
FIG. 11 is a side elevation view of the trench box of FIG. 9 on its side.
Figure 12:
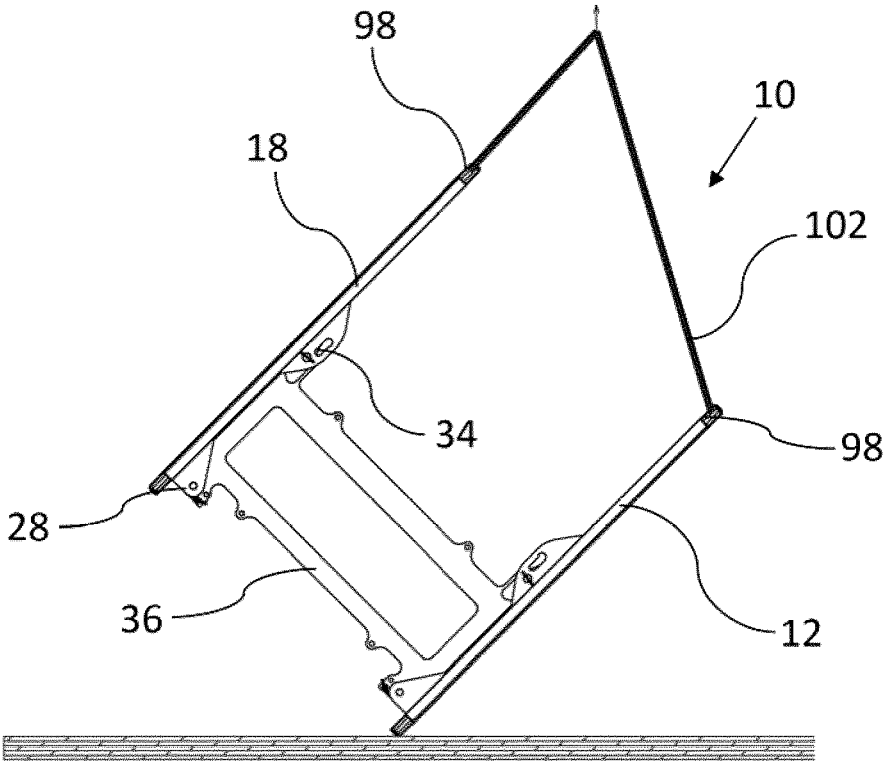
FIG. 12 is a side elevation view of the trench box of FIG. 9 being rotated further for disassembly.
Figure 13:
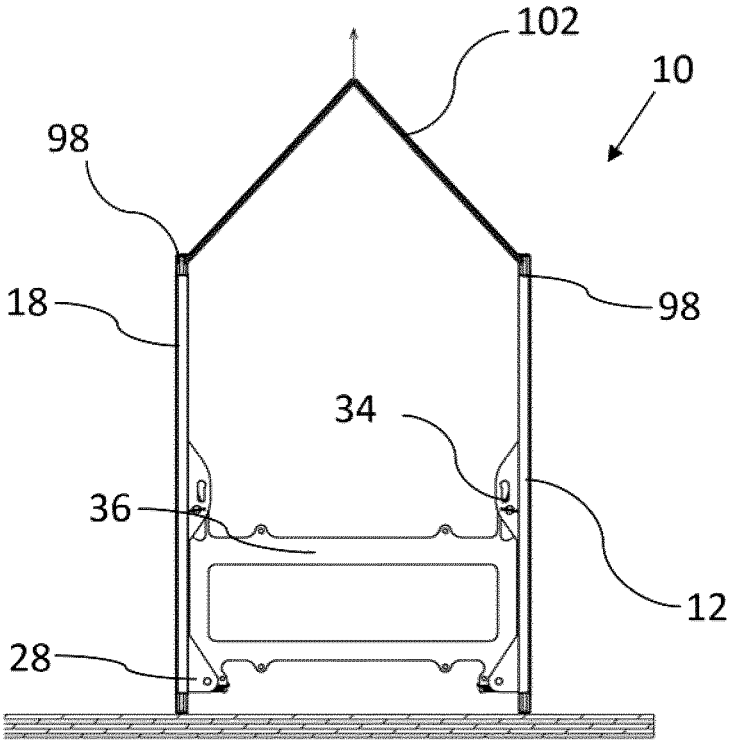
FIG. 13 is a side elevation view of the trench box of FIG. 9 that has been rotated upside down for disassembly.

Trench box 10 is lifted out from the trench using sling 102 attached to lifting lugs 60. Once trench box 10 is on a ground surface, trench box 10 is then rotated using corner lift points 98 as shown in FIG. 10. Alternatively, trench box 10 could also be rotated on its side using lifting lugs 60 or other attachment points, according to the preferences of the user. Trench box 10 is first positioned on one side, as shown in FIG. 11, and the corner lift points 98 are changed, as shown in FIG. 12, allowing trench box 10 to be placed upside-down as shown in FIG. 13. After placing trench box 10 upside down, corner lift points 98 are detached from the lifting device.

Figure 14:
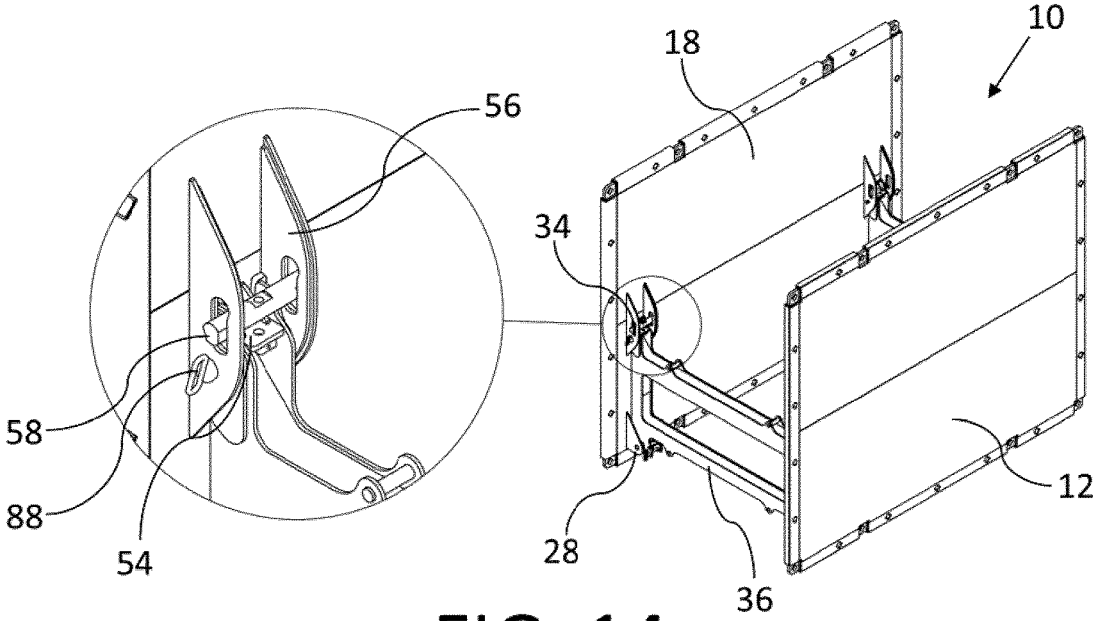
FIG. 14 is a perspective view of the trench box of FIG. 9 showing a detailed view of a lower attachment.
Figure 15:
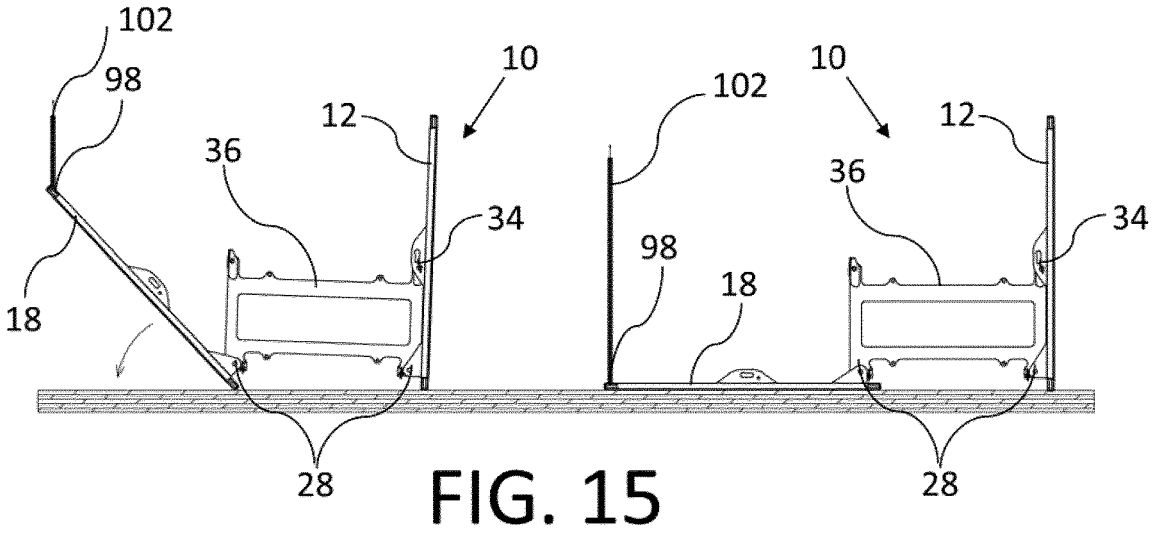
FIG. 15 is a side elevation view of the trench box of FIG. 9 showing the process of a side panel rotating about a lower attachment to lay flat.
Figure 16:
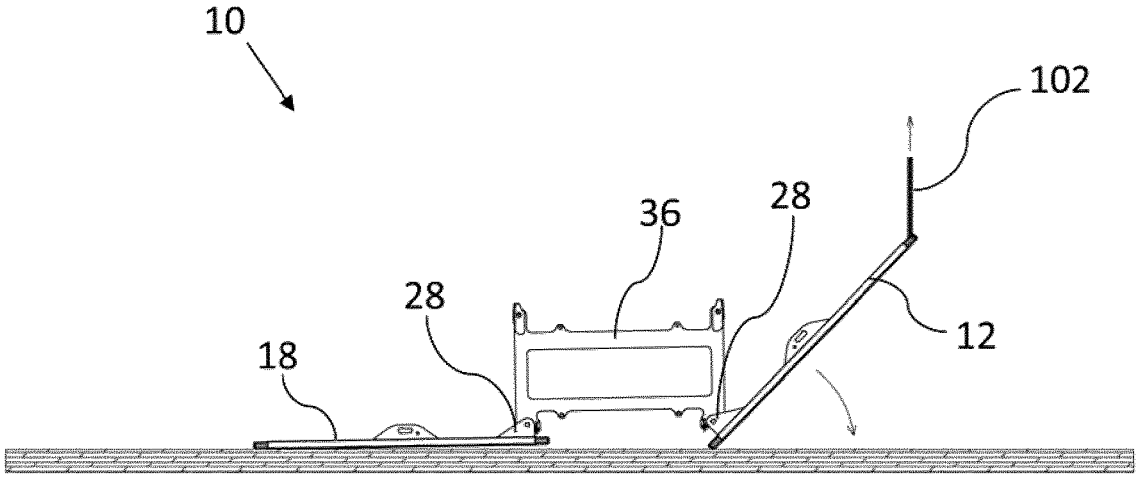
FIG. 16 is a side elevation view of the trench box of FIG. 9 showing the second side panel rotating about a lower attachment such that both panels lay flat.
Figure 17:
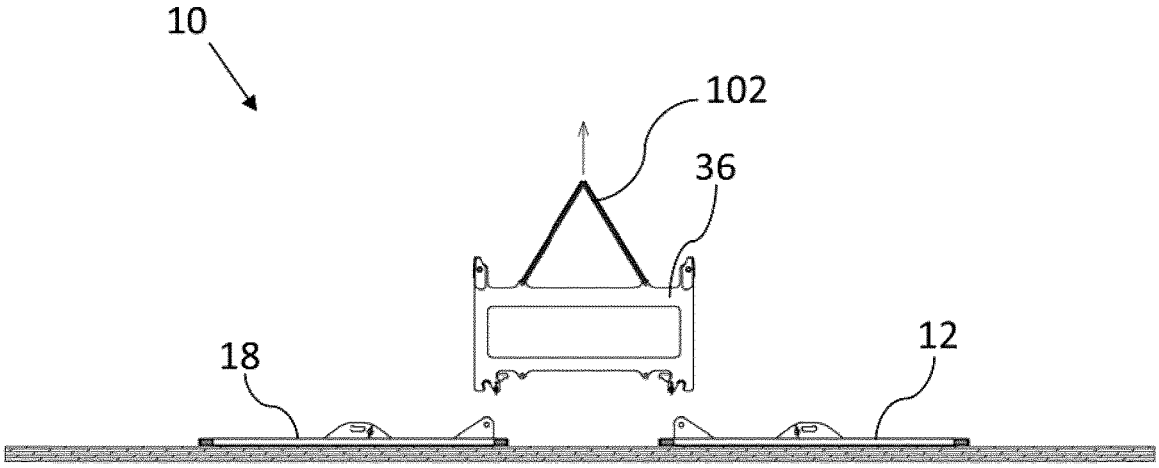
FIG. 17 is a side elevation view of the trench box of FIG. 9 showing the support structures being lifted away from the side panels.

Referring to FIG. 14, pin 58 is then slid away from angled surface 54, allowing the angled lock connection to be disengaged. Next, locking pin 88 can be removed, allowing lower attachment 34 to be detached. Referring to FIG. 15 and FIG. 16, this allows first and second panels 12 and 18 to pivot about upper attachments 28 and be laid flat onto the ground surface. This may be accomplished through the use of the lifting device and the corner lift points 98 in order to control the decent of first and second panels 12 and 18. Referring to FIG. 17, lock pins 86 may then be removed, and safety latch 84 may be disengaged, such that upper attachments 28 are disconnected, and lateral support 36 may be lifted away from first and second panels 12 and 18. In all cases above, lock pins may be reinserted after the connections are detached for storage of the lock pins.

Referring to FIG. 31 through 36, an alternative method of disassembly of trench box 10 will now be described. The variation will be described with respect to spring loaded upper attachment 28 and lower attachment 34, however, it will be understood that the method of disassembly may be used with other forms of upper and lower attachments 28 and 34 as described, such as a manually operated attachment as described below with respect to the large format trench box 200.

Figure 31:
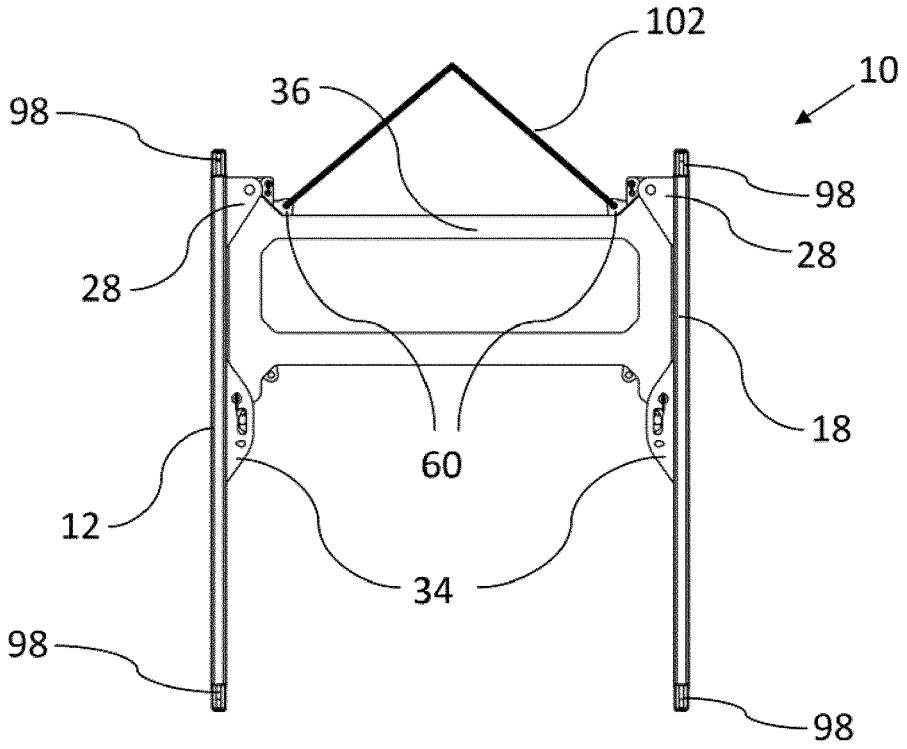
FIG. 31 is a side elevation view of the trench box of FIG. 22 with a lifting sling attached.
Figure 32:
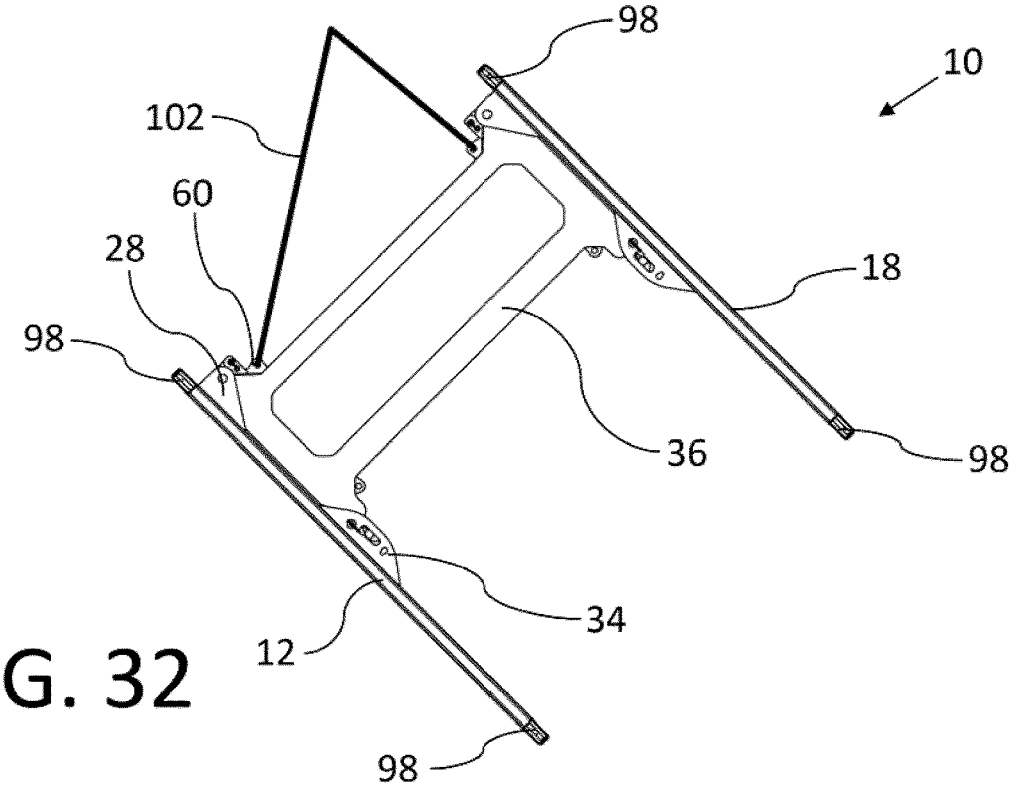
FIG. 32 is a side elevation view of the trench box of FIG. 22 being rotated for disassembly.
Figure 35:
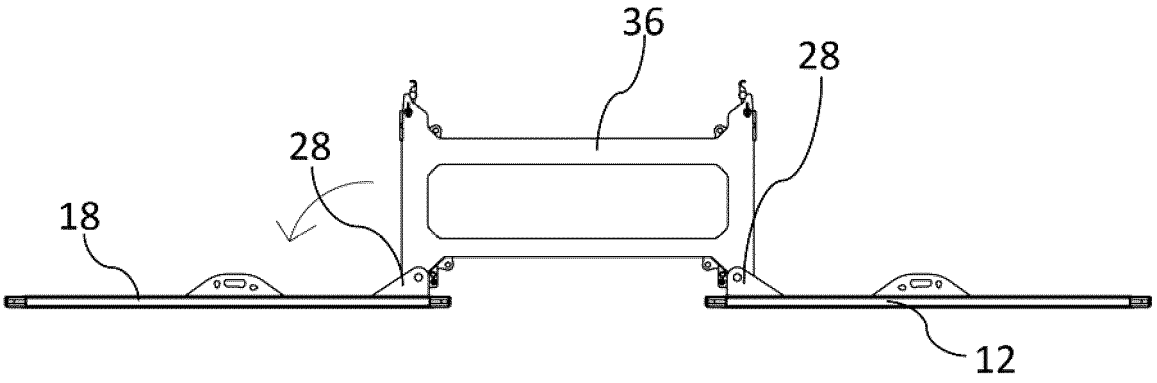
FIG. 35 is a side elevation view of the trench box of FIG. 22 showing the second side panel rotating about a lower attachment such that both panels lay flat.
Figure 36:
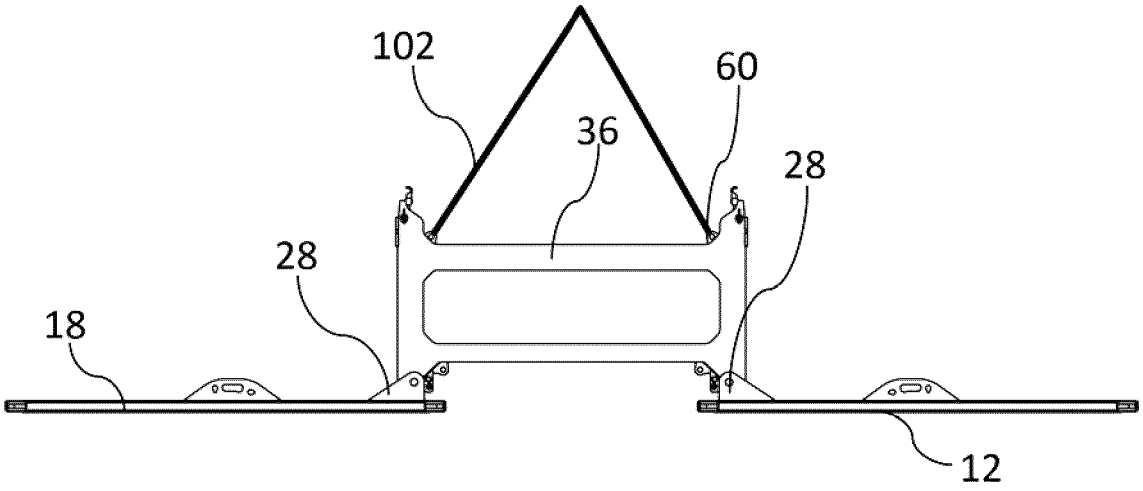
FIG. 36 is a side elevation view of the trench box of FIG. 22 showing the support structures being lifted away from the side panels.

Referring to FIG. 31, trench box 10 is lifted out from the trench using sling 102 attached to lifting lugs 60. Referring to FIG. 32, once trench box 10 is on a ground surface, trench box 10 is rotated using lifting lugs 60 to be placed on its side as shown in FIG. 33. Sling 102 may then be attached to corner lift points 98, and safety pins 108 may be removed from openings 112 of lower attachment 34, and the spring loaded connector 106 of lower attachment 34 can be released. Using sling 102 or other means, side panels 12 and 18 may then be released to pivot about upper attachments 28 and be laid flat on the ground as shown in FIGS. 34 and 35. Sling 102 may be attached to lifting lugs 60, safety pins 108 may be removed from openings 110 of upper attachment 28, and the spring loaded connector 106 of upper attachment 28 can be released to allow lateral support 36 to be lifted away from first and second panels 12 and 18 as described above. It will be understood that different assembly and disassembly methods will be used depending on the circumstances and the needs of the user. For example, the second described disassembly method may be preferred when the spacing between side panels 12 and 18 is small enough that lower connections 34 may be disengaged from ground level, while the first described disassembly method may be preferred when the spacing between side panels 12 and 18 is larger and it is preferred to turn the trench box 10 entirely upside down.

Larger Format Trench Box

In some circumstances, a larger trench box is required than those depicted and discussed above, such as one that may have a high arch that has sufficient clearance to allow vehicles or equipment to pass below. However, an increase in size results in an increase in weight and safety requirements for assembly and disassembly. A variation on the smaller format trench box 10 will now be described. It will be understood that a larger format trench box 200 may be designed that incorporates various features described above with respect to smaller format trench box 10, and that various features described below with respect to larger format trench box 200 may also be incorporated into smaller format trench box 10.

Referring to FIG. 37-41, setting aside size, the main differences in design between trench box 200 and trench box 10 discussed above are the design of connection points 25 and the use of snubbers 226. With trench box 10, connection points 25 are between lateral support 36 and side panels 12 and 18, via side supports 38 and 40, which are fixedly mounted to lateral supports 36 such that side panels 12 and 18 pivot relative to lateral supports 36 and side supports 38 and 40. With respect to trench box 200, connection points 25 are between lateral support 36 and side supports 38 and 40. In each case, side supports 38 and 40 are removably attached to, and extend alongside panels 12 and 18 in a direction perpendicular to the pivot axis of pivot connections 28.

Figure 40:
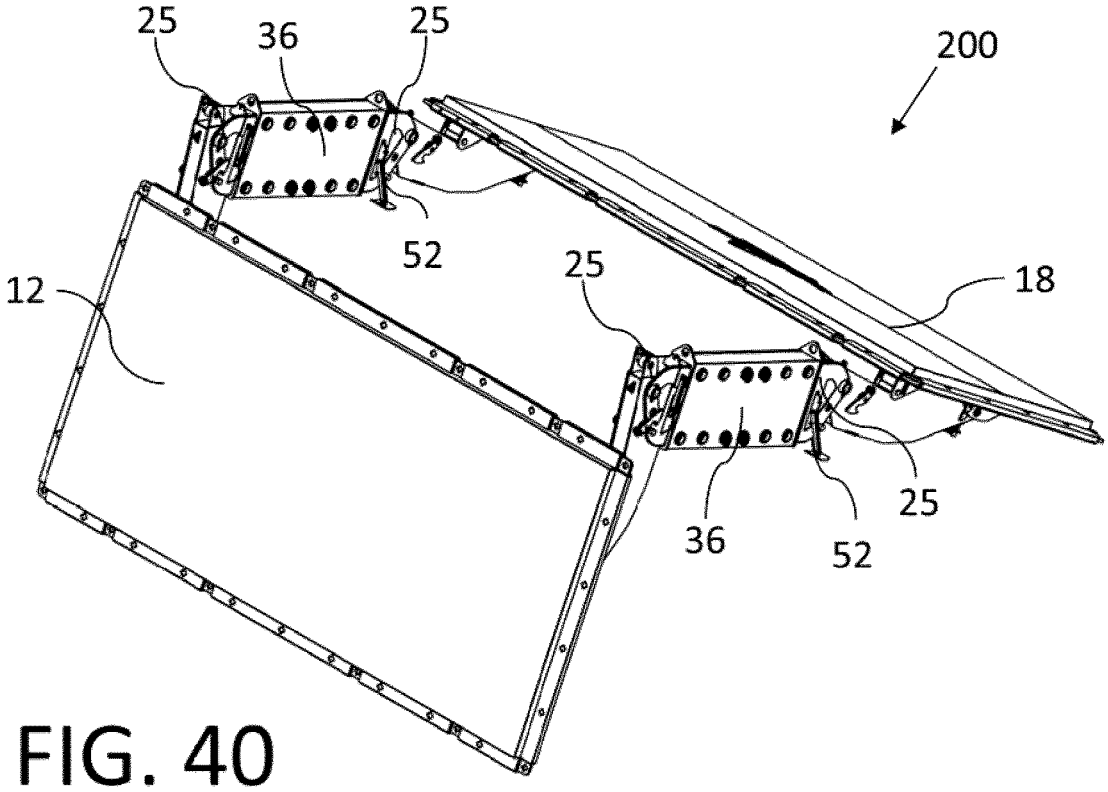
FIG. 40 is a perspective view of one side panel in an operational position relative to the lateral supports.
Figure 42:
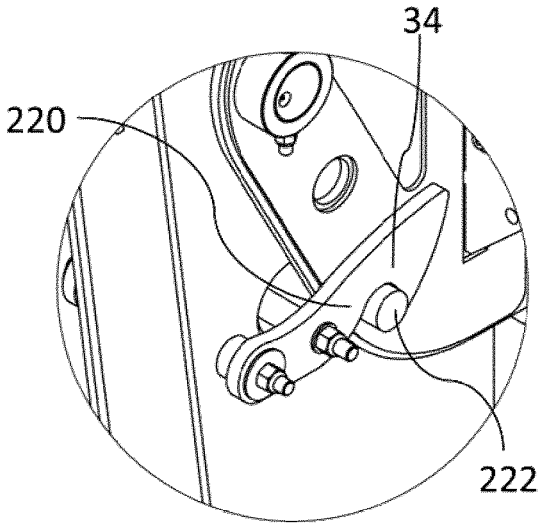
FIGS. 42 and 43 are detailed perspective views of a releasable connection.
Figure 43:
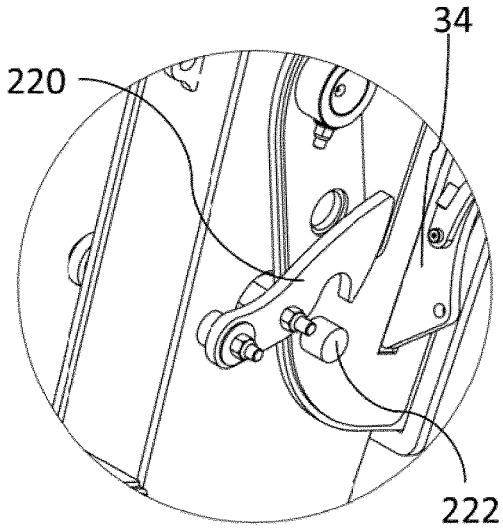
Figure 48:
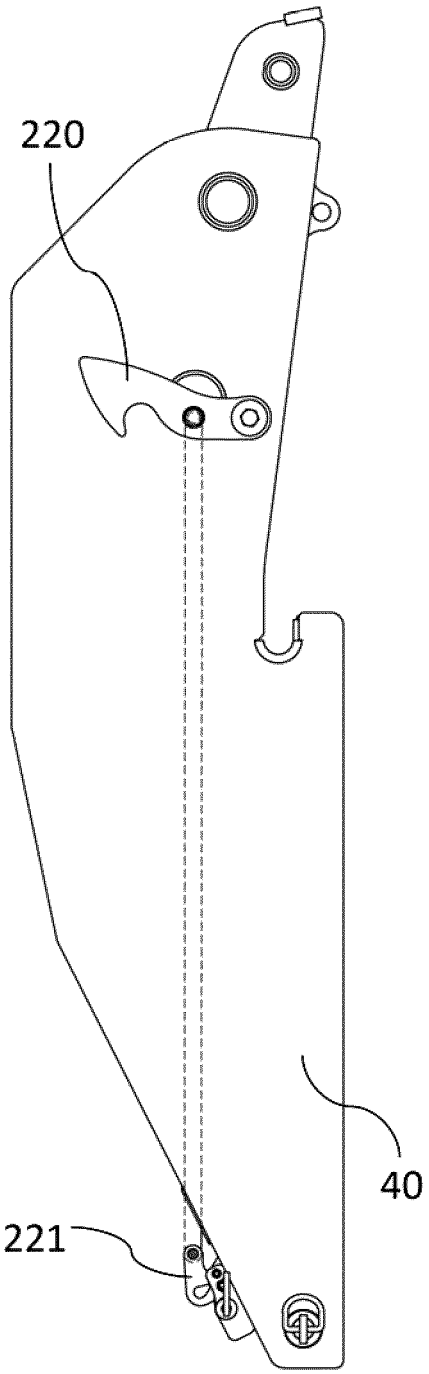
FIG. 48 is a detailed side elevation view of a side support with a latch in a latched position.
Figure 49:
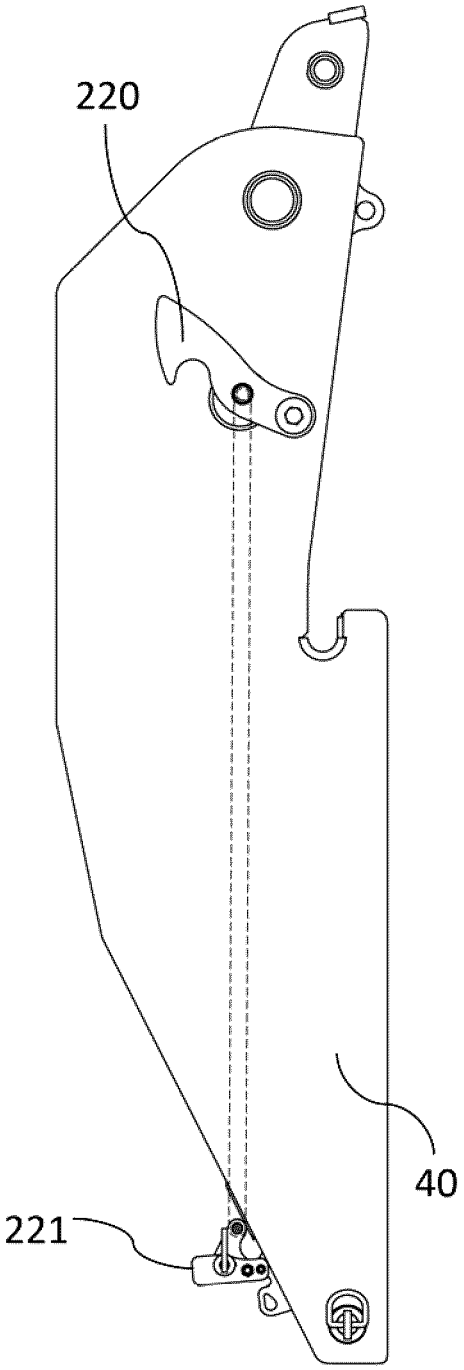
FIG. 49 is a detailed side elevation view of a side support with a latch in an unlatched position.

Referring to FIGS. 48 and 49, releasable connection 34 is depicted as a manually operated latch 220 that is operated by a lever 221, as shown in FIGS. 42 and 43 engages a pin 222. As latch 220 engages pin 222, side panels 12/18 are locked in position, and when latch 220 is lifted out of engagement with pin 222, side panels 12/18 are permitted to rotate, as shown in FIG. 40. Latch 220 may also be spring-loaded, depending on the preferences of the user.

Figure 37:
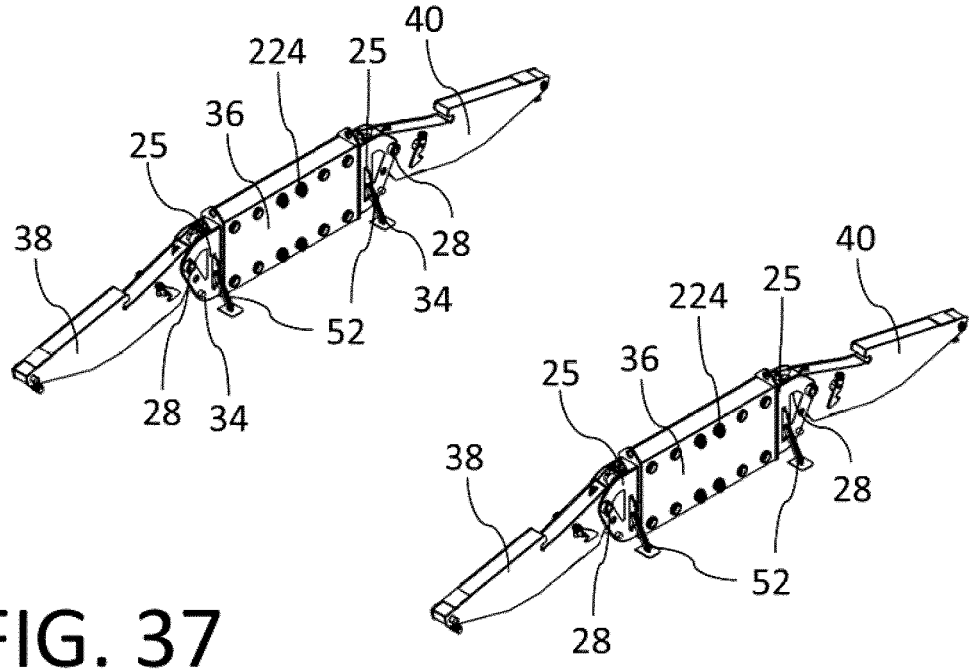
FIG. 37 is a perspective view of lateral supports for a larger format trench box.

Referring to FIG. 37, lateral supports 36 are preferably length adjustable, which may be accomplished by removing pins 224 or bolts, sliding the sections of lateral supports 36 apart, and replacing pins 224 in the desired openings once the desired size has been reached.

Figure 46:
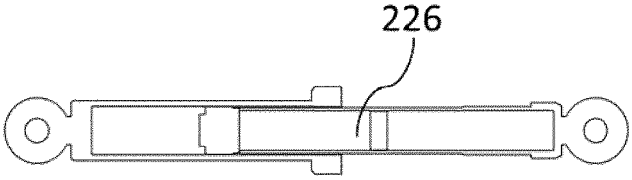
FIG. 46 is a side elevation view in section of a snubbing device.
Figure 47:
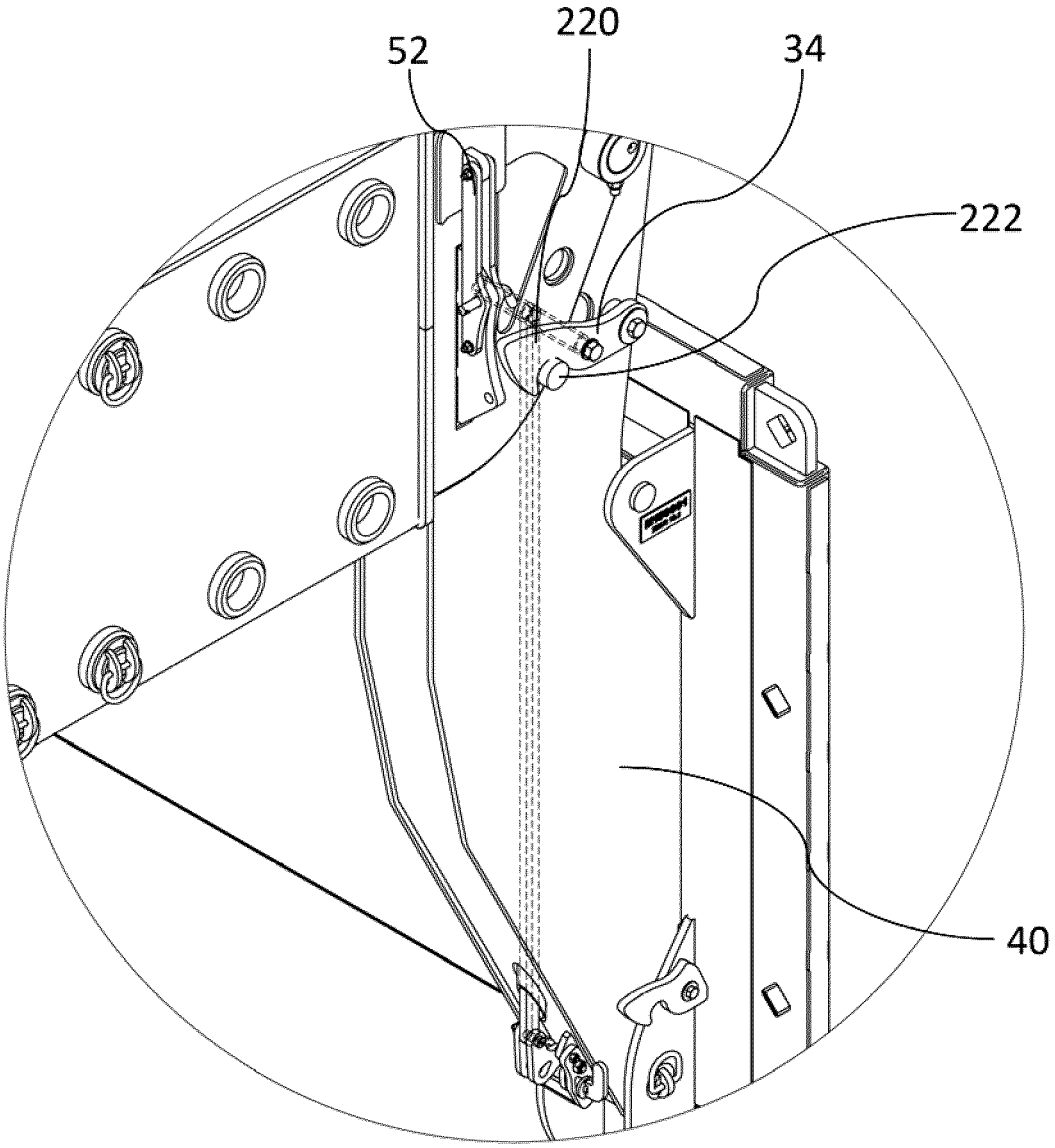
FIG. 47 is a detailed perspective view of a side support with a latch in a latched position.

Referring to FIGS. 44 and 45, trench box 200 is also provided with a snubber 226 at each connection point 25, which is used to control the pivotal movement of panels 12 and 18 relative to lateral supports 36. Snubbers 226 are positioned between lateral supports 36 and side panels 12. Snubbers 226 may be directly between lateral supports 36 and side panels 12, or between lateral supports 36 and side supports 38/40. As trench box 200 is designed to be larger and heavier, snubbers 226 are used to reduce the speed at which panels 12 and 18 will pivot to reduce the risk of damage or injury during disassembly. Snubbers 226 are generally not required for assembly due to the decrease in risk, although there may be some designs in which that could be useful. As shown in FIG. 46, snubbers 226 are hydraulic cylinders with a flow restrictor that only allows a certain flow rate, which slows the motion of panels 12 and 18 relative to lateral supports 36. As used herein, the term "snubber" refers to any type of device that can be used to control or slow the movement. Other types of snubbers may include different types of hydraulic snubber designs, mechanical snubbers, magnetic snubbers or electrically powered snubbers, etc. Alternatively, in other embodiments, snubbers 226 may be controlled by an external power source, and may be used as actuators that assist in the assembly and disassembly of trench box 220 by applying a force to pivot panels 12 and 18 relative to lateral supports 36 toward and away from the assembled position. This may avoid or reduce the need for other lifting equipment.

Method of Assembly—Larger Format

Figure 38:
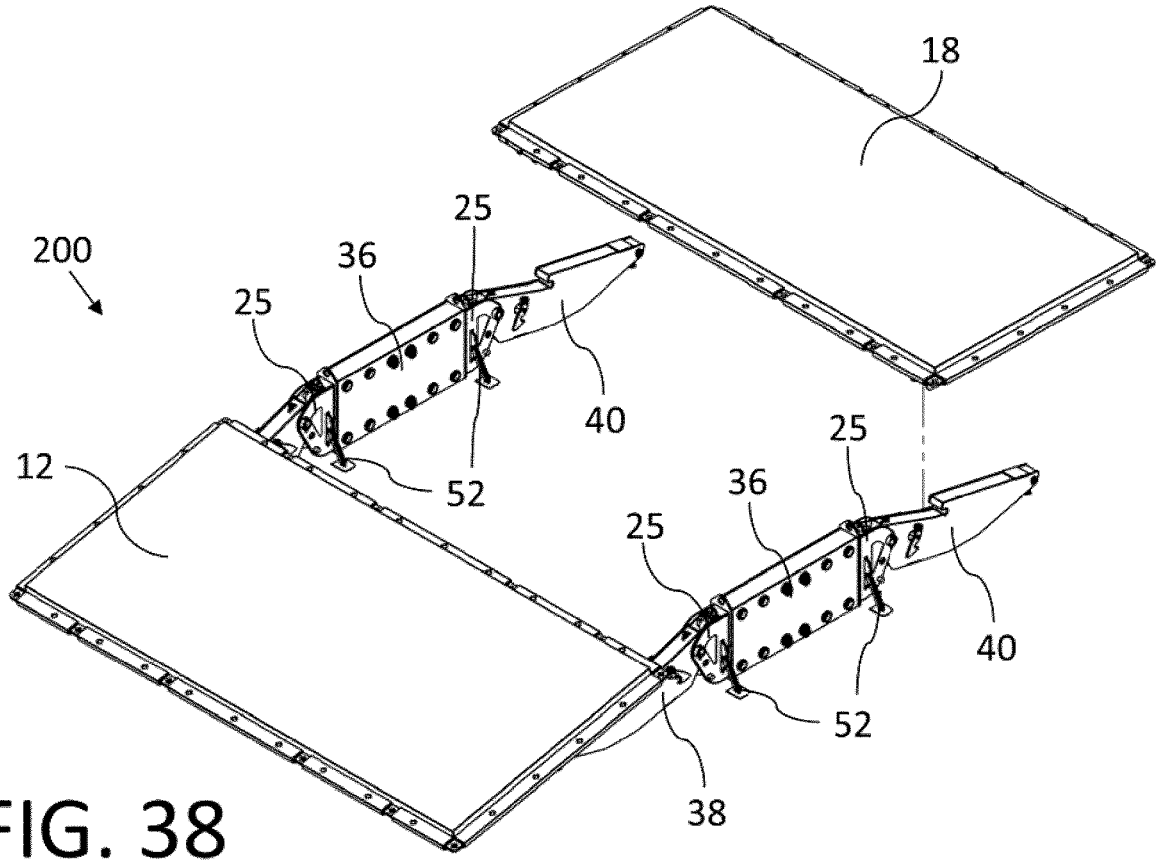
FIG. 38 is a perspective view of side panels being installed on the lateral supports of FIG. 37.
Figure 39:
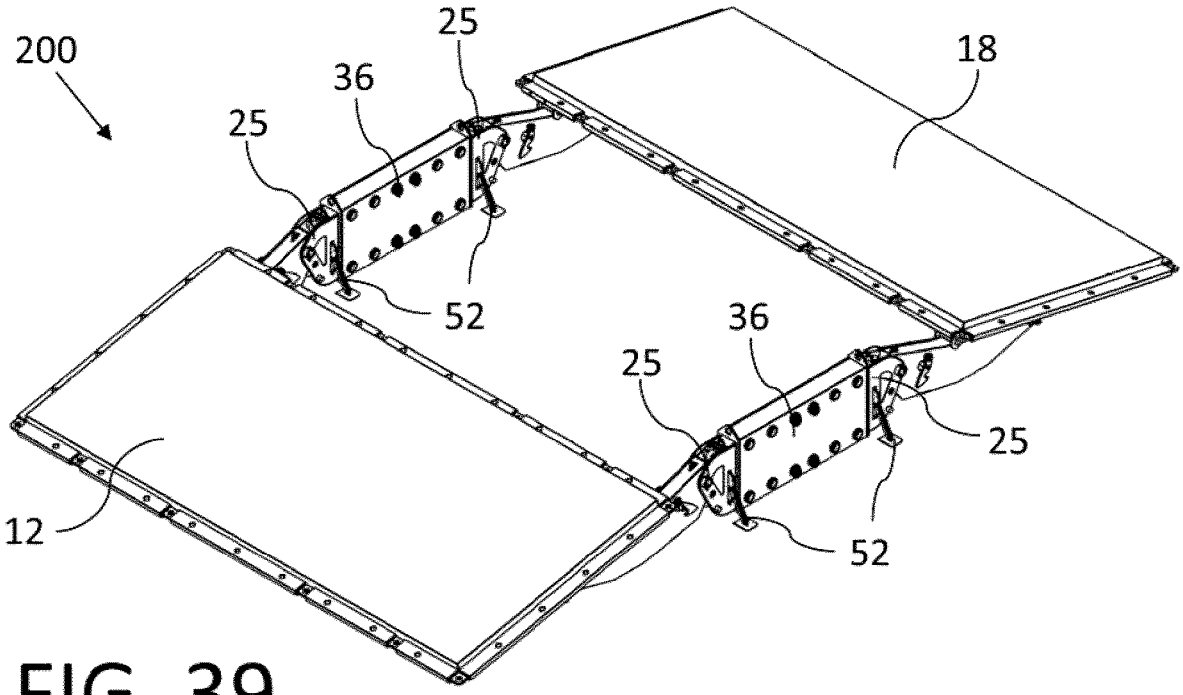
FIG. 39 is a perspective view of side panels installed on the lateral supports of FIG. 37.

Referring to FIG. 37-41, the steps in the assembly of trench box 200 is shown. The steps are similar to the method of assembling the smaller format trench box 10, except that panels 12 and 18 are first mounted to side supports 38 and 40 as shown in FIGS. 38 and 39, and connection points 25 are connected between side supports 38/40 and lateral supports 36 as trench box 200 is lifted. Given the weight and size of trench box 200, it may be preferable to lift one side at a time, as shown in FIG. 40, rather than both at the same time as described above, to reduce any possibility of damage or injury. As with smaller format trench box 10, this will depend on the available equipment and the preferences of the user. Once no longer required, stands 52 are pivoted up and out of the way, as shown in FIGS. 44 and 45, at a convenient time during the process.

Method of Disassembly—Larger Format

The method of disassembling larger format trench box 200 is different than the method described with respect to smaller format trench box 10. Rather than lifting one side panel 12 or 18 and essentially rolling trench box 10 upside down, the steps of assembling trench box 200 is merely reversed, where side panel 18 (or 12) is released and lowered to the position shown in FIG. 40. This may be done by releasing releasable connection 34, and applying a force on side panel 18, such as a pulling force, a lifting force, or combination thereof to cause the bottom edges of panels 12/18 to move away from each other such that panels 12/18 extend at an angle downward and away from lateral support 36. The other side panel 12 (or 18) may then be released and lowered to the position shown in FIG. 39. Side panels 12 and 18 can then be disconnected and removed from lateral supports 36. Side panels 12 and 18 may be pivoted outward individually, or at the same time.

Universal Connection System

Referring to FIGS. 24-30 and FIGS. 50-65, a universal connection system for both the smaller format and larger format trench box will be described. It will be understood that elements of this connection system may be incorporated into any of the trench boxes described above, and that the universal system may also be used with other styles of trench boxes that do not operate as above.

As discussed above, referring to FIGS. 24-30, trench box 10 may be assembled with additional panels connected to first and second side panels 12 and 18, and may have one or more third side panels 62. It will be understood from the description above, and from the details provided below, that the side panels may be provided in a variety of different configurations, and may not be assembled or disassembled as described above. The description below will refer to side panels 300 generally, which may include first and second side panels 12 and 18, third side panels 62, or other side panels as desired. As depicted, side panels 300 are preferably planar. Side panels 300 are connected together using a universal engagement profile 302, having equally spaced connection points 316 positioned around the outside perimeter of side panels 300. This type of engagement profile 302 was described above with respect to universal engagement profile 65. While the connection points 316 are provided on the four sides of panels 300, side panels 300 may also be provided with additional attachment points 322 as discussed further below. Trench box 10 is then assembled with the use of connecting brackets 304.

Figure 50:
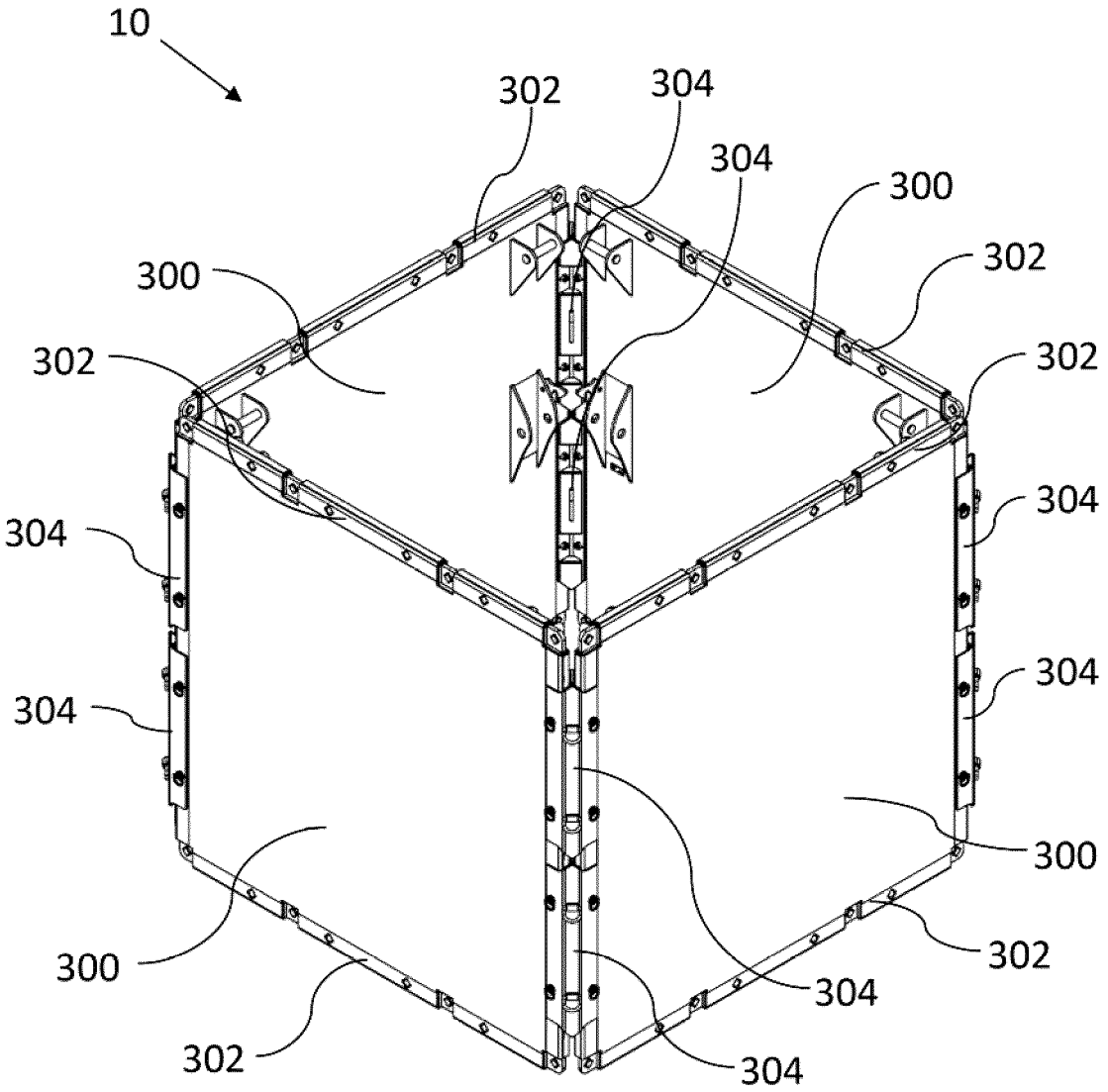
FIG. 50 is a perspective view of four side panels assembled into a box using corner brackets.

Referring to FIG. 50, trench box 10 is shown with four side panels 300 connected with ninety degree angled connecting brackets 304, as shown in FIG. 25. It will be understood that similar structures can be formed using other angles between the receiving slots 306 (FIG. 64) of the connecting brackets 304. For example, receiving slots 306 may be angled to form triangular trench boxes having three sides 300, or to form trench boxes having five, six, or eight sides 300. It will be understood that the number of sides 300 will be determined based on the particular application and the needs of the user. As shown in FIG. 50, trench box 10 has two vertically spaced connecting brackets 304 on each corner of trench box 10. However, it will be understood that trench box 10 may be connected by a single connecting bracket 304 on each corner, or with multiple connecting brackets 304 on each corner, depending on the application.

Figure 51:
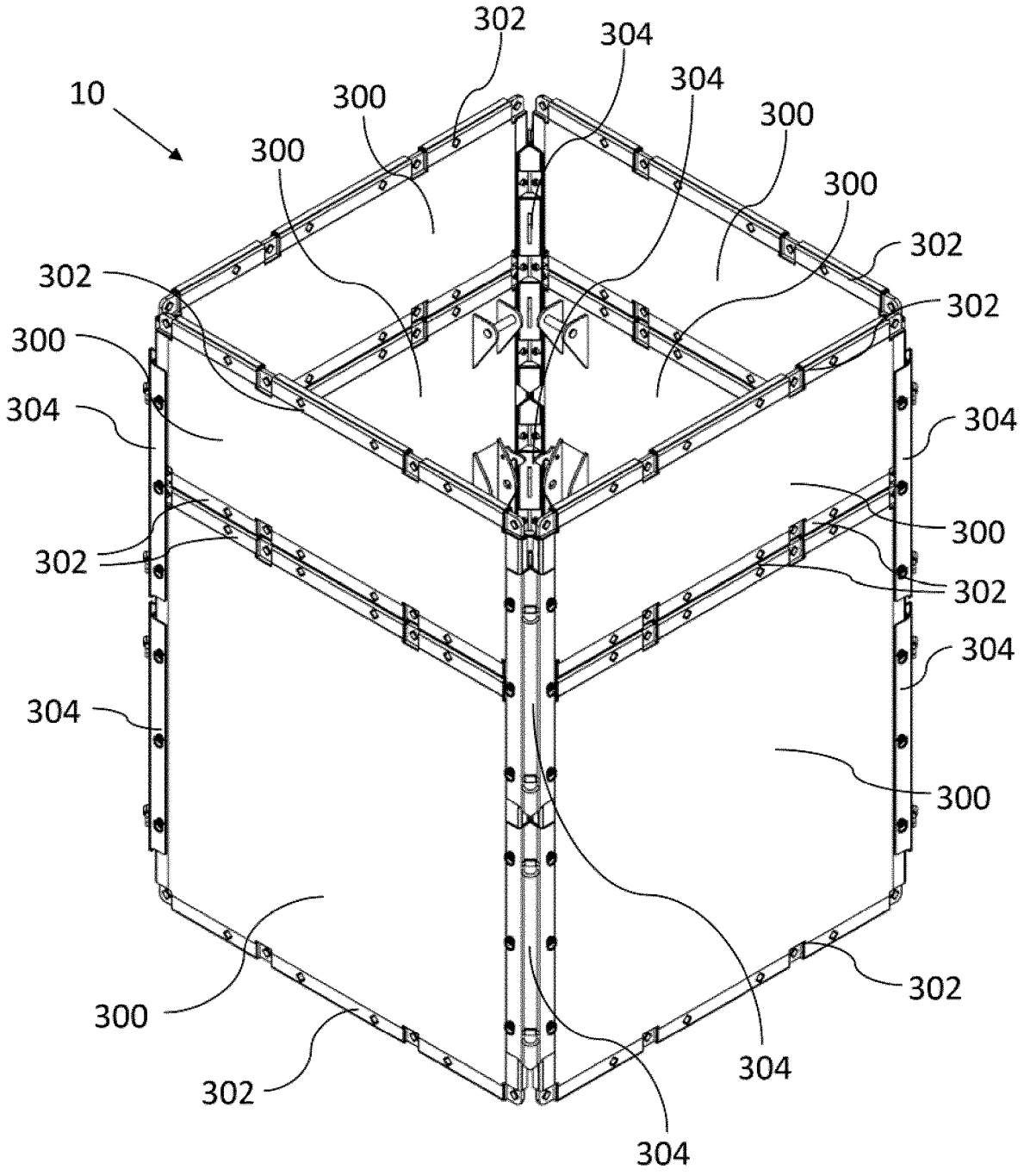
FIG. 51 is a perspective view of eight side panels assembled into a vertically extended box using corner brackets.
Figure 53:
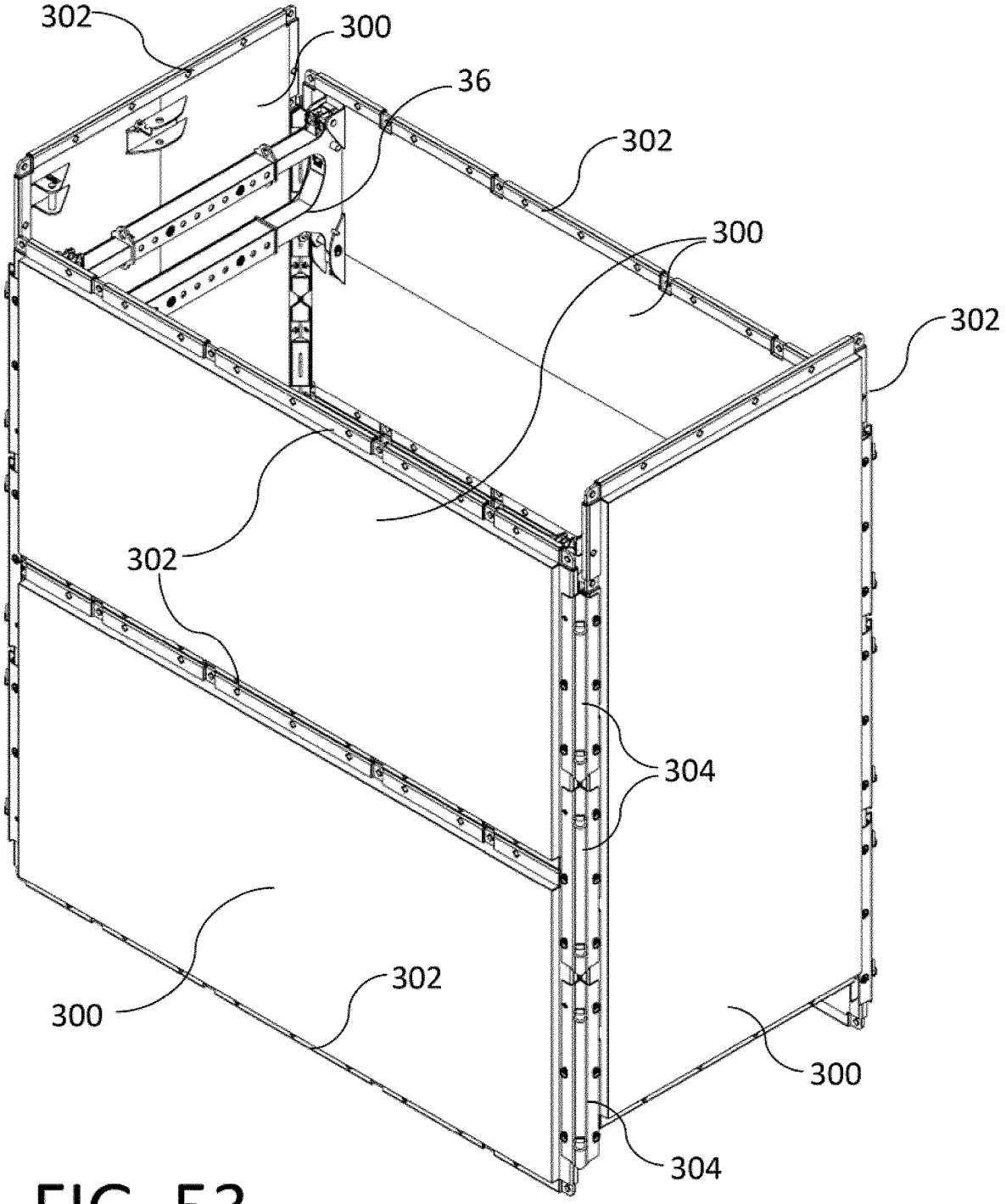
FIG. 53 is a perspective view of six side panels of equal size assembled into a box by varying the orientation and using corner brackets.

Referring to FIG. 51, trench box 10 is shown with connecting brackets 304 spanning between lower and upper side panels 300. Placing the bracket 304 between side panels 300 both vertically and horizontally results in a connection between a single bracket 304 and four side panels 300. This allows trench box 10 to be built up vertically as high as may be needed for the application, and provides structural strength to the connection as connecting bracket 304 spans a portion of each of the panel. Referring to FIG. 53, providing engagement profile 302 on the four sides of side panels 300 also allows for the orientation of side panels 300 to be varied, while still attaching with connecting bracket 304. The panels shown making up trench box 10 are all the same size, with two horizontally oriented panels making up each of the long sides of trench box 10, and one vertically oriented panel making up each of the short sides of trench box 10. As shown, the two end panels on the short sides are vertically offset from the panels of the short sides. Engagement profile 302 allows for panels to be connected at any of the points along engagement profile 302, which permits vertical and horizontal offsets of panels.

Figure 52:
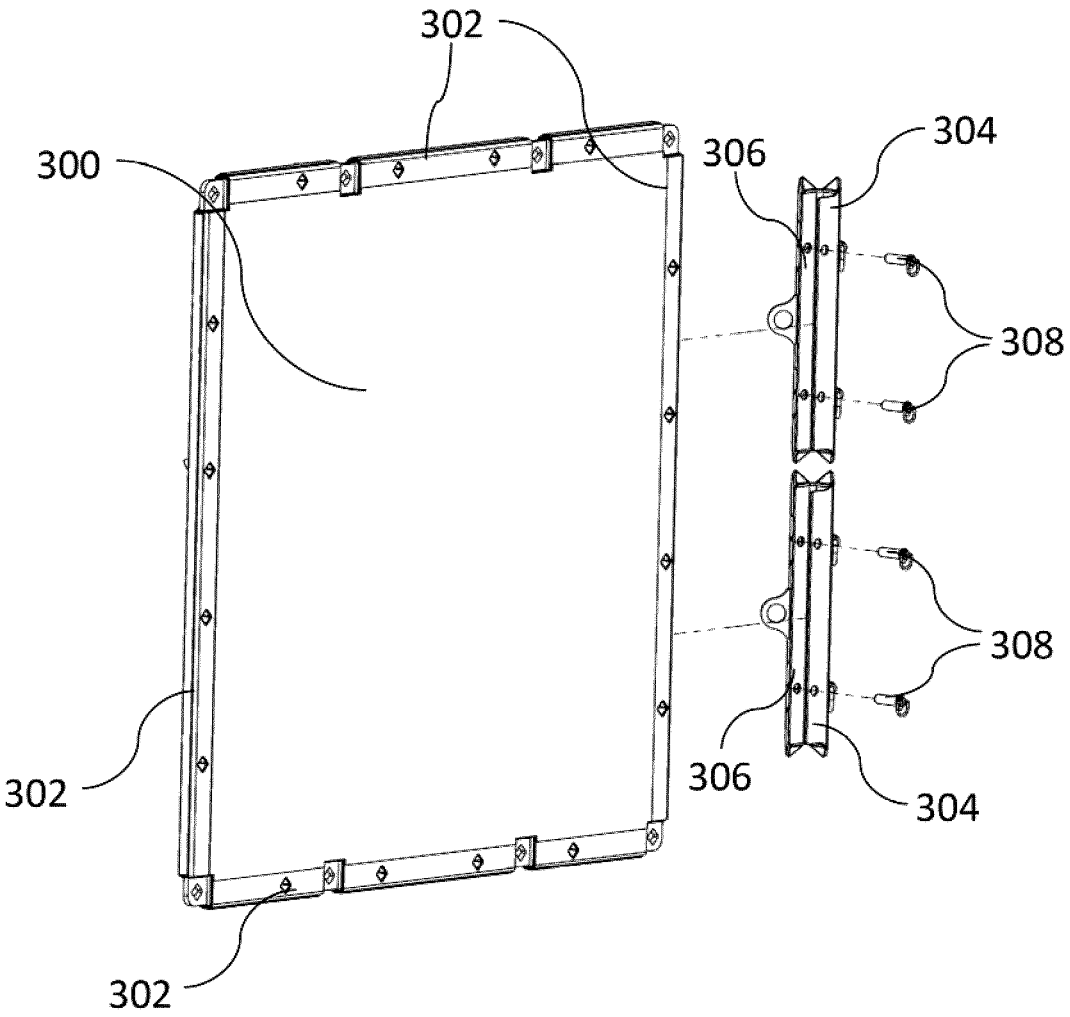
FIG. 52 is a perspective view of a corner connector being attached to one side of a panel.
Figure 54:
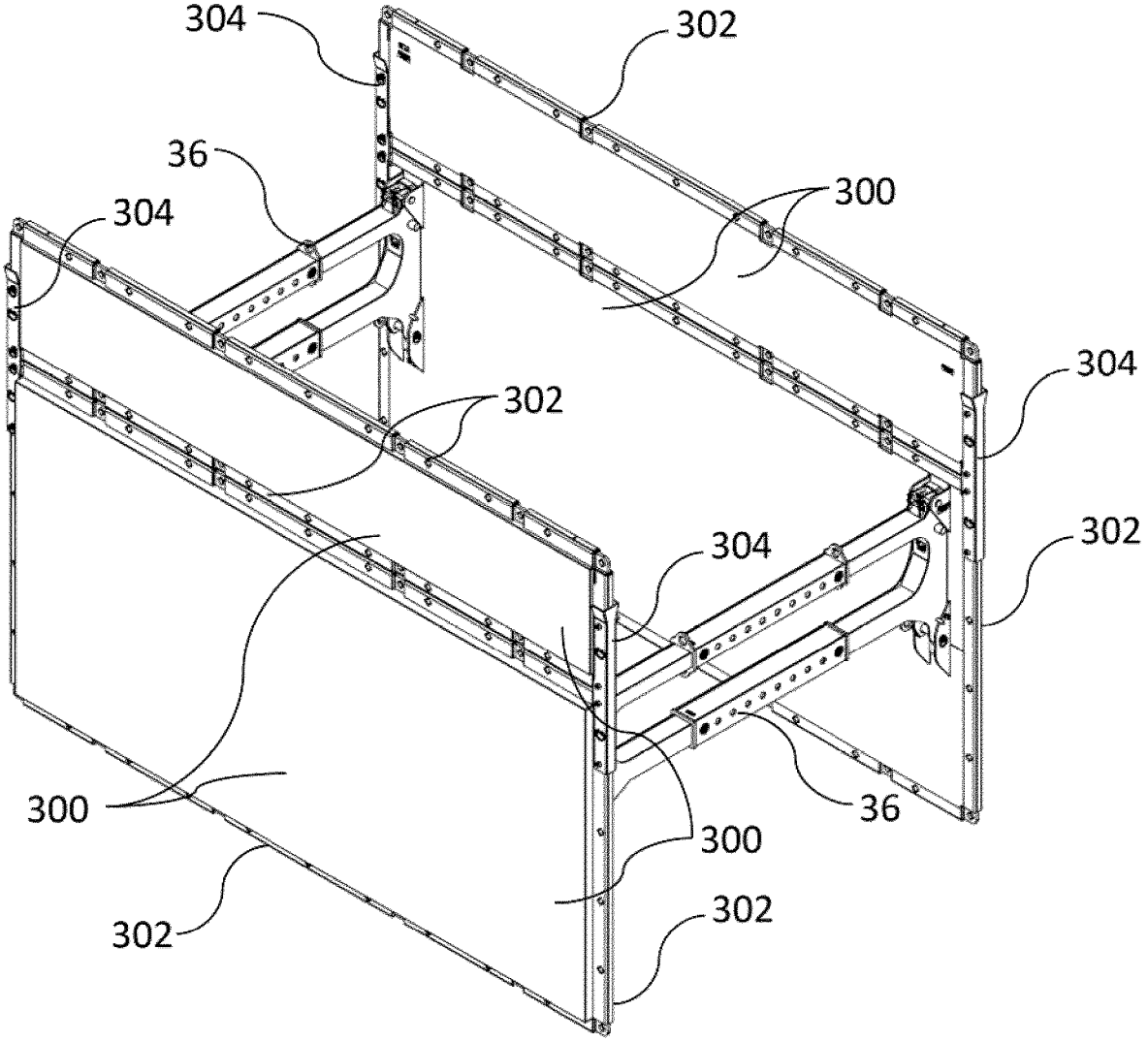
FIG. 54 is a perspective view of a trench box vertically extended using edge brackets.
Figure 55:
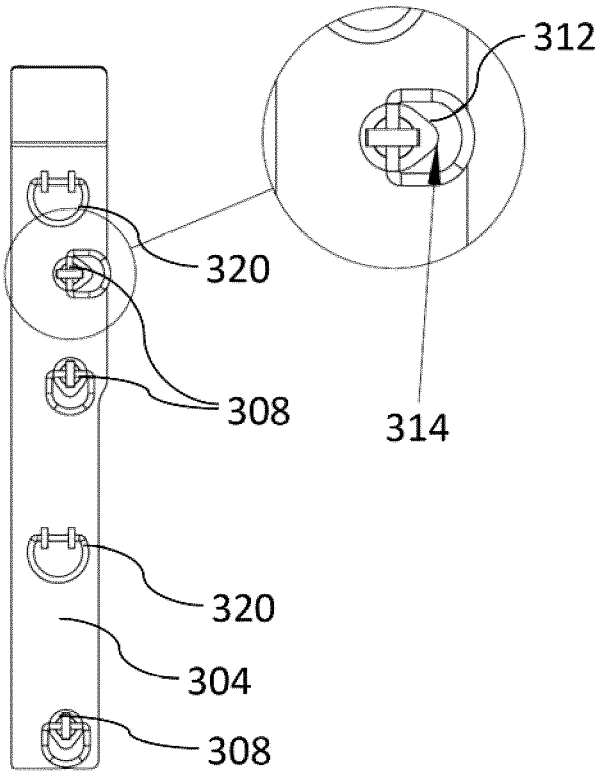
FIG. 55 is a side elevation view of a locking pin on a connecting bracket showing detail of a pin keeper.
Figure 56:
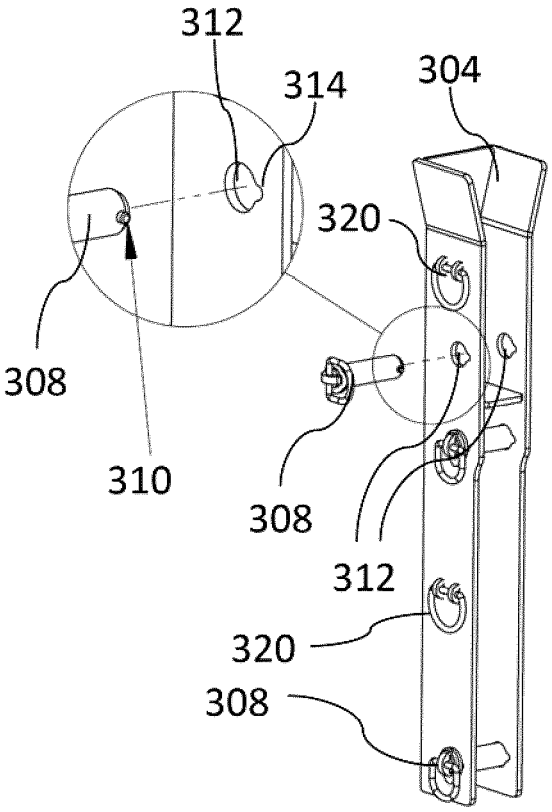
FIG. 56 is a perspective view of a locking pin being installed on a connecting bracket showing detail of a locking slot.
Figure 57:
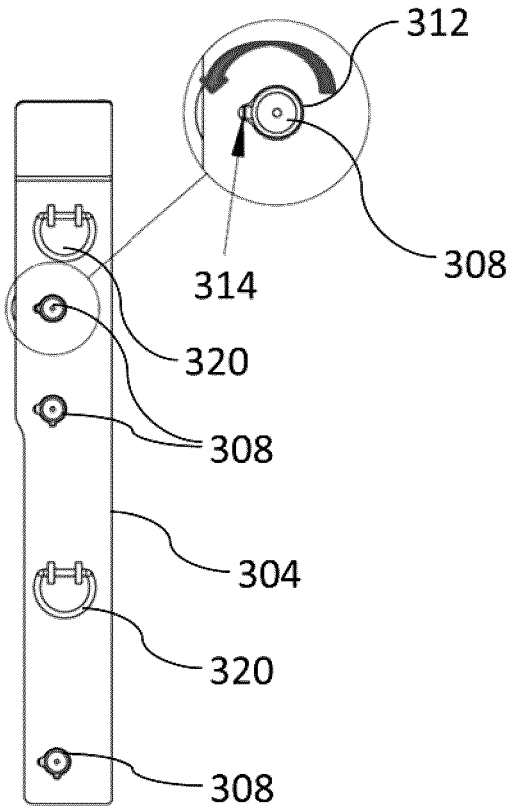
FIG. 57 is a side elevation view of a locking pin being installed on a connecting bracket showing the pin in an unlocked position.
Figure 58:
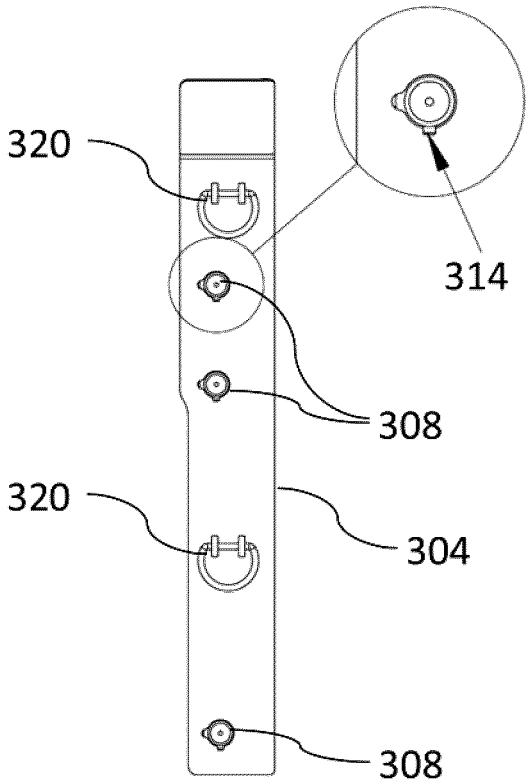
FIG. 58 is a side elevation view of a locking pin being installed on a connecting bracket showing the pin rotated to a locked position.
Figure 59:
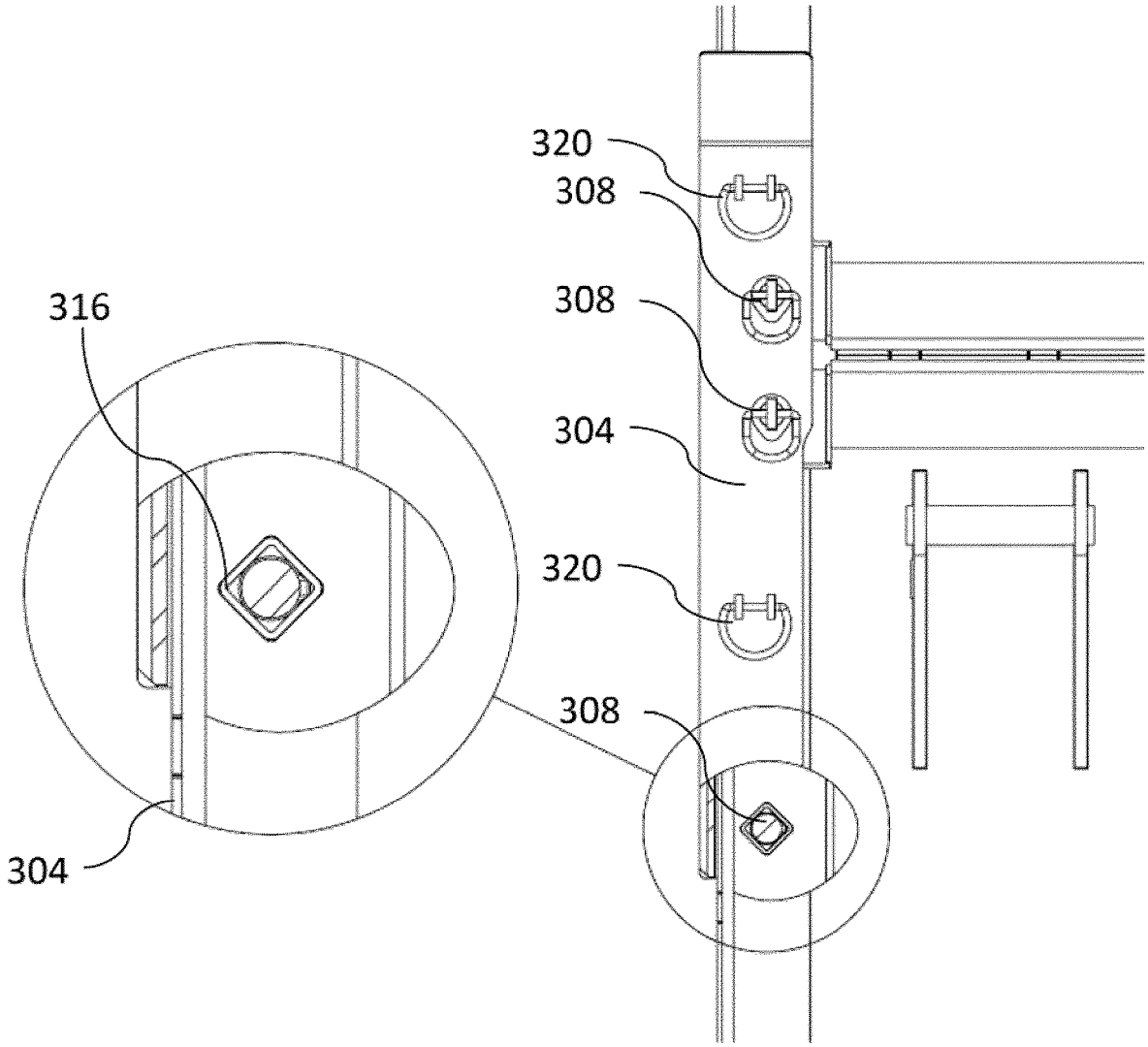
FIG. 59 is a side elevation view showing details of a diamond shaped pin receiver for locking pins.

Referring to FIG. 52, the details of connecting bracket 304 connecting to engagement profile 302 is shown. Connecting bracket 304 has a receiving slot 306 that receives engagement profile 302. Pins 308 are then inserted into the openings of engagement profile 302. Referring to FIG. 54, connecting bracket 304 may also be provided with one receiving slot 306 to connect vertically stacked panels 300 together. This allows multiple side panels 300 to be stacked when trench box 10 is formed with only first and second side panels 12 and 18 as described above. FIG. 55 through 58 depict an example of a connecting bracket 304 having only one receiving slot 306 and pin connectors 308. Pin connectors 308 may be provided with a locking engagement, such as a spring-biased pin or locking dowel 310. Also depicted in FIG. 55-FIG. 59 is lifting lug 320, which may be used to move panels 300 or trench box 10 as described further below. As shown in FIG. 55, where pin connectors 308 are provided with a locking dowel 310, a profile may be provided on the pin receiving opening 312 of the connecting bracket 304. Locking dowel 310 can be oriented such that it faces towards the point 314 of the profile. Referring to FIG. 56, point 314 may also be a slot as shown instead of a smooth profile. Locking dowel 310 may be inserted such that locking dowel 310 of pin 308 faces towards slot 314. Referring to FIGS. 57 and 58, once locking dowel 310 is passed through bracket 304 it can be rotated to no longer line up with slot 314, thereby preventing removal of pin 308, as shown in FIG. 58. Referring to FIG. 59, engagement profile 302 of side panels 300 may be provided with diamond shaped openings 316 that allow locking dowel 310 to pass through openings 316 in different orientations, allowing for different connections to be formed with engagement profile 300.

Figure 30:
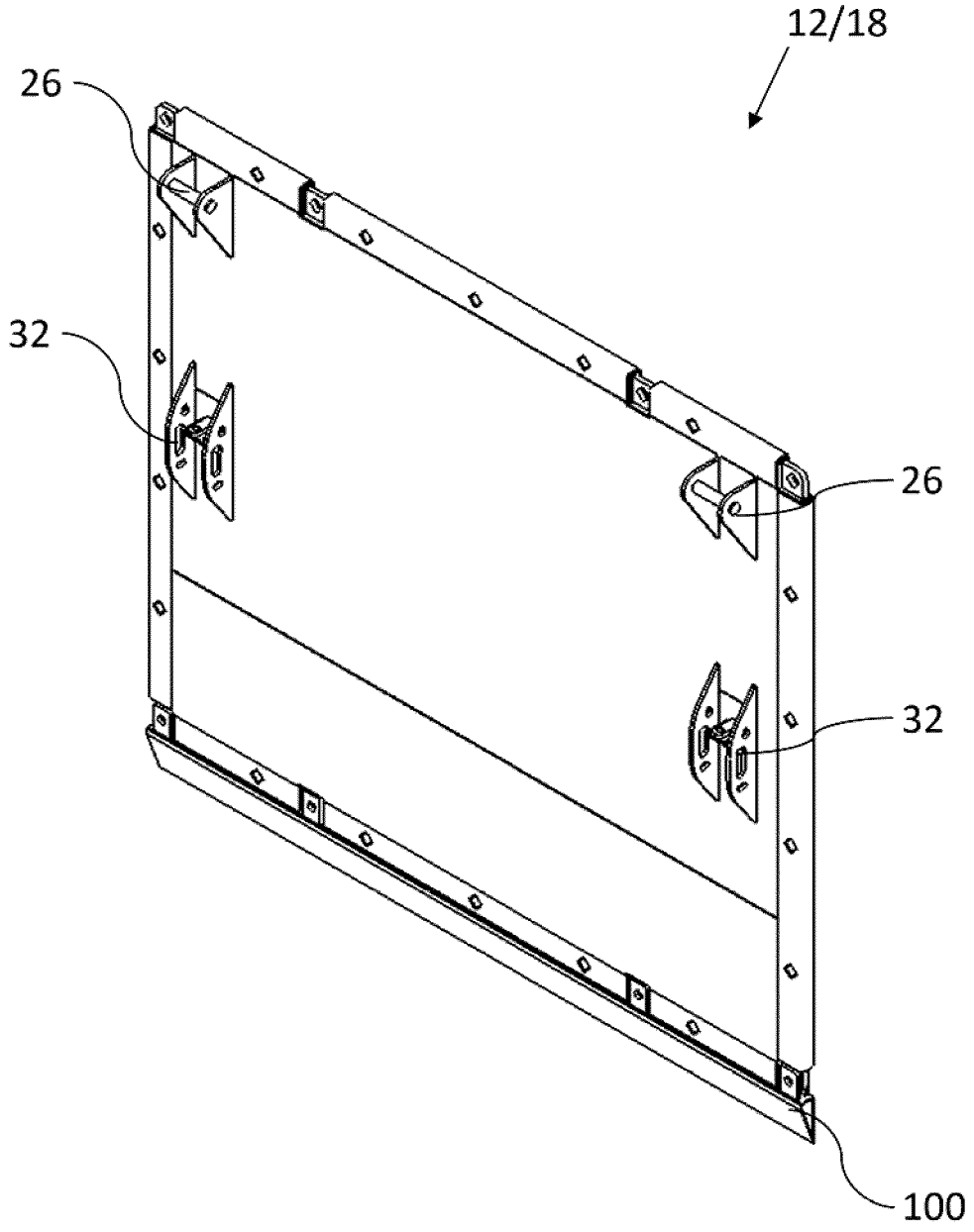
FIG. 30 is a perspective view of a side panel having a knife edge component.
Figure 60:
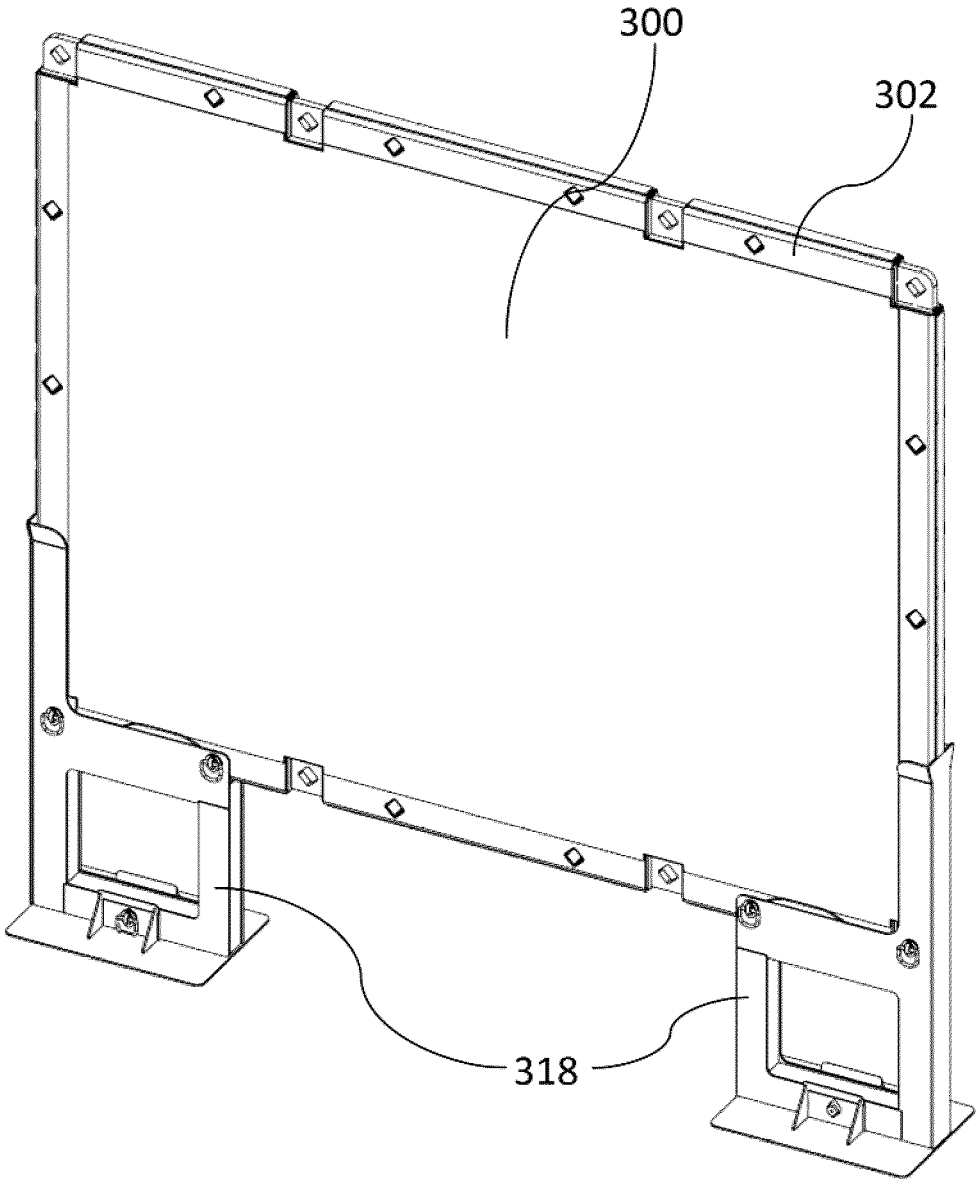
FIG. 60 is a perspective view of a side panel having attached extension feet.
Figure 61:
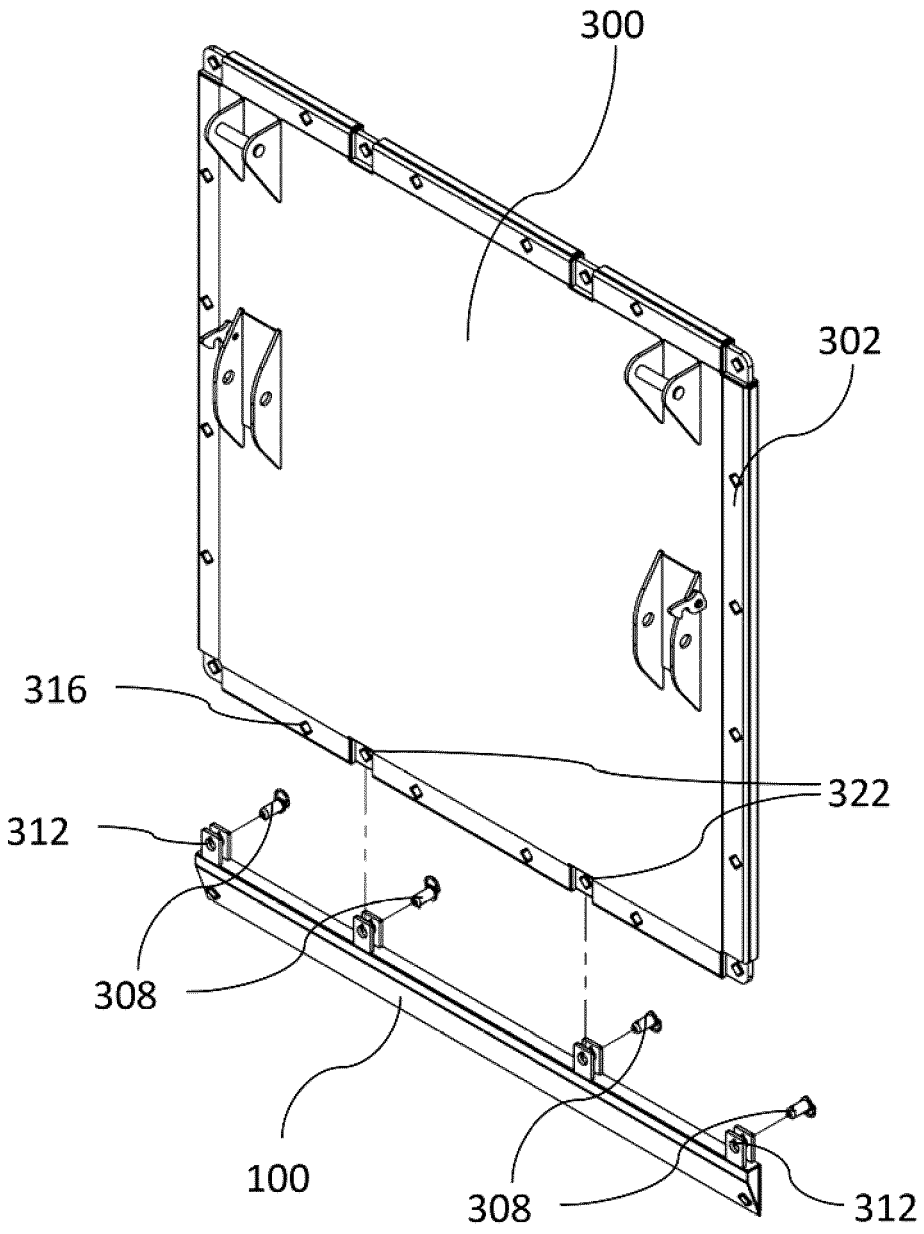
FIG. 61 is a perspective view of a knife edge component being installed on a side panel.
Figure 62:
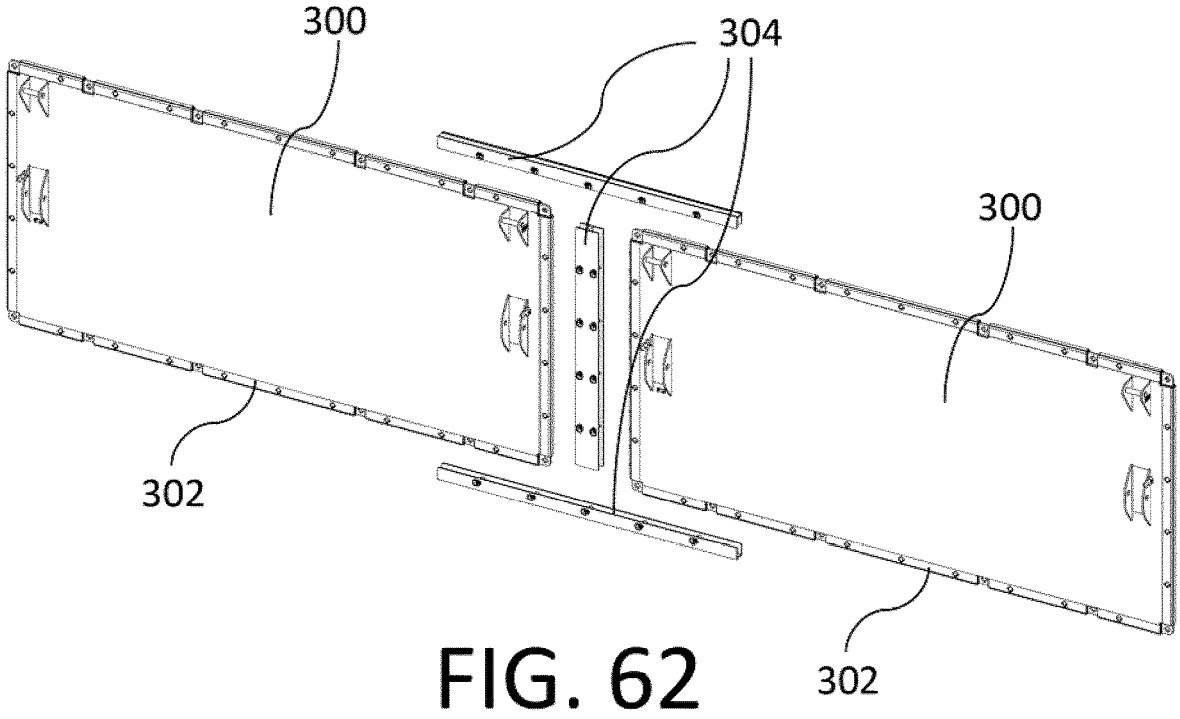
FIG. 62 is a perspective view of two side panels being connected inline using edge brackets.
Figure 63:
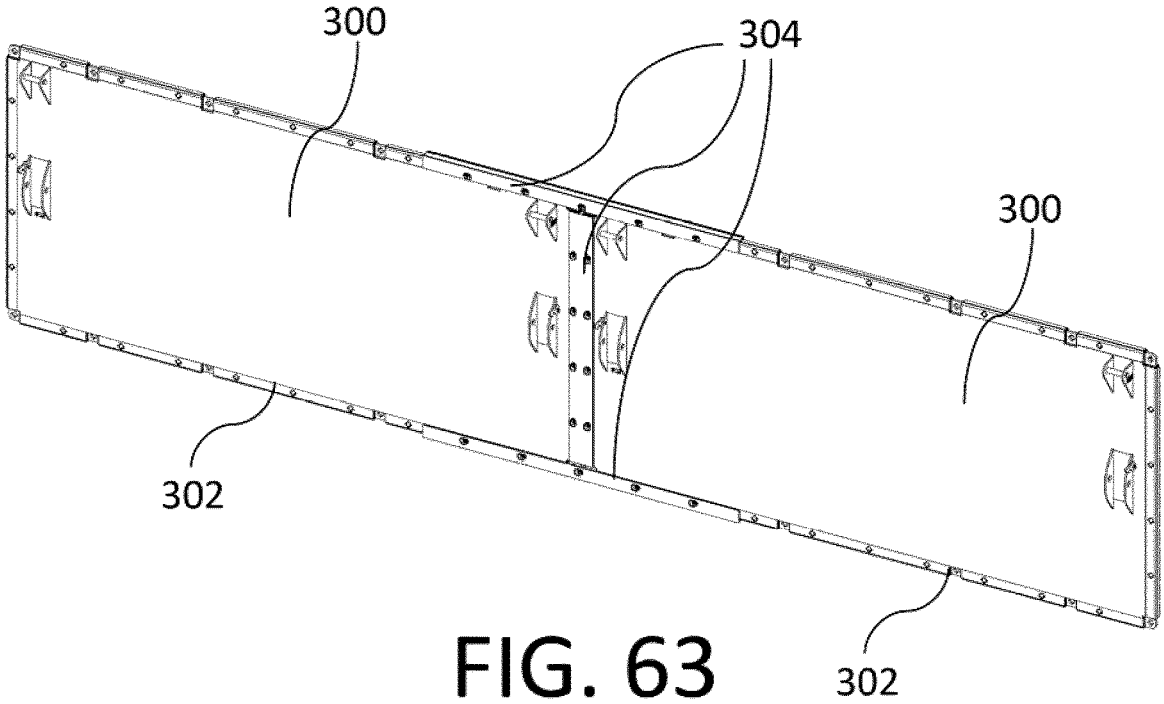
FIG. 63 is a perspective view of two side panels connected together inline using edge brackets.

Referring to FIG. 60 and FIG. 61, engagement profile 302 may be used to form detachable connections with other equipment, such as with accessories, safety devices, tools, sensors, etc., as described above. FIG. 60 shows a side panel 300 having extension feet 318. Extension feet 318 may be used, for example, to lift side panel 300 off of the ground surface, or to allow passage of tubes or cables underneath side panel 300. FIG. 61 shows the attachment of a knife edge 100 as shown in FIG. 30. Knife edge 100 is attached using pins 308 as shown. In the depicted example knife edge 100 is attached to additional attachment points 322, although it will be understood that knife edge 100 may also be attached to connection points 316. As shown, additional attachment points 322 are provided along two sides of panel 300. However, they may also be provided on all four sides, or on only one side, etc., as required by the application. Additional attachment points 322 may be provided for the connection of other accessories, as discussed above. Referring to FIG. 62 and FIG. 63, connecting bracket 304 may have two receiving slots 306 in parallel as shown, allowing for panels 300 to be connected inline in order to provide longer panels. As shown, two panels 300 are connected together using one h-shaped connecting bracket 304 that receives the engagement profile 302 on the end of each panel 300, and top and bottom connecting brackets 304 that receive a portion of the top engagement profile 302 and span the two panels.

Figure 64:
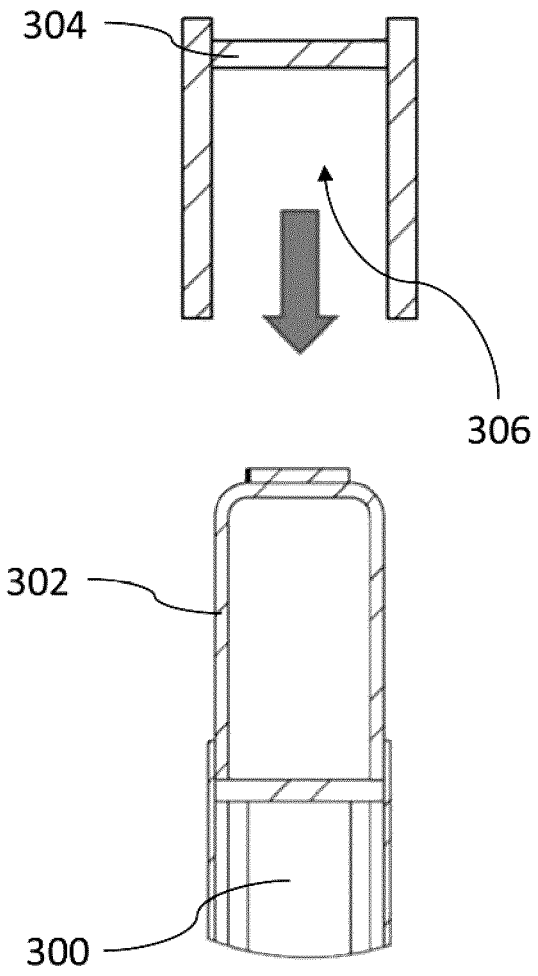
FIG. 64 is a detailed top plan view of an edge bracket being connected to a connection profile on a side panel.
Figure 65:
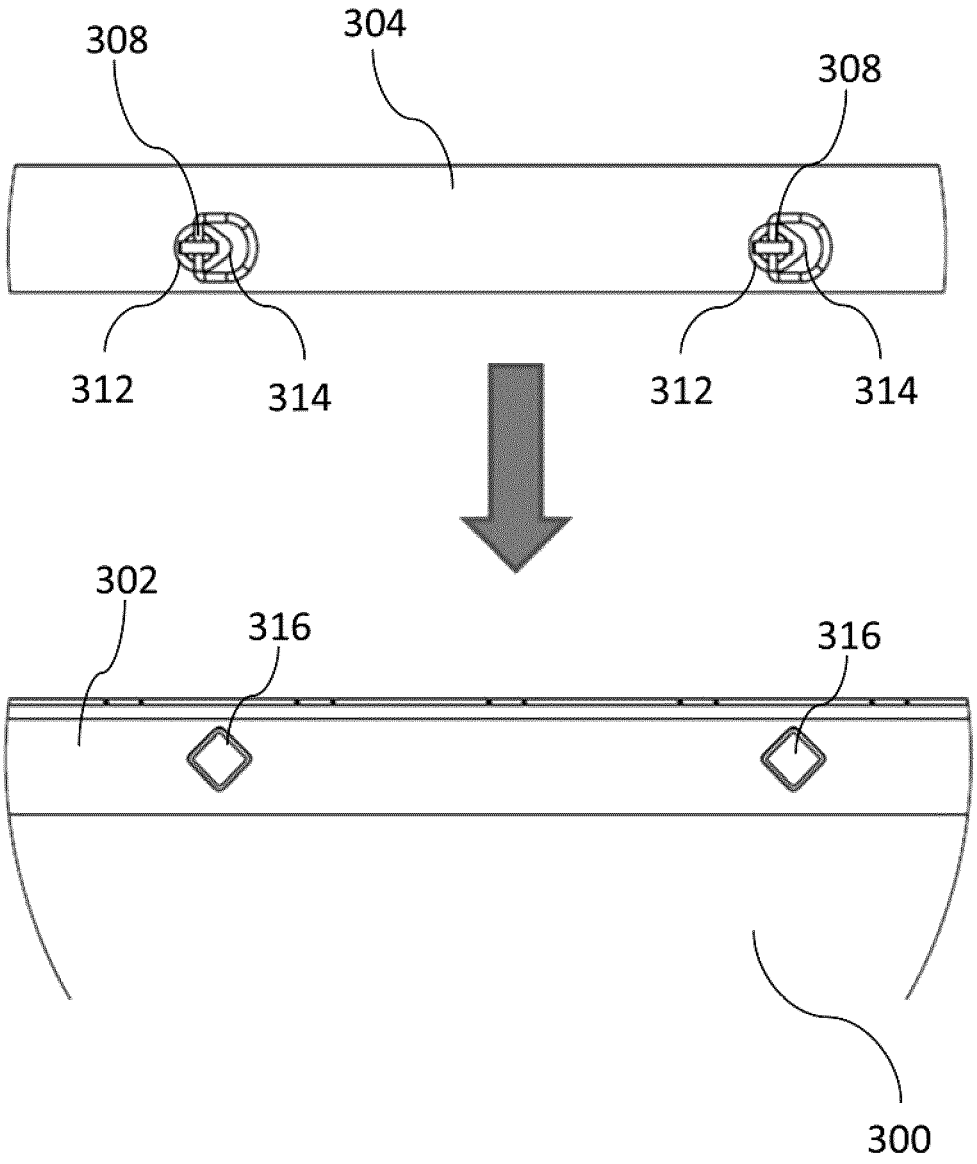
FIG. 65 is a detailed side elevation view of an edge bracket being connected to a connection profile on a side panel.

Referring to FIG. 64 and FIG. 65, further details of the connection between receiving slots 306 of connecting bracket 304 and engagement profile 302 are shown. Referring to FIG. 64, engagement profile 302 is received within receiving slot 306 as shown. Referring to FIG. 65, pins 308 engage with pin receiving openings 312 on connecting bracket 304, as well as openings 316 of engagement profile 302 on side panel 300. The U-shaped receiving slot 306 of connecting bracket 304 engages with both sides of engagement profile 302 of side panel 300, providing structural strength to the connection and supporting against forces applied to side panel 300 from either direction. Additional connection points 322 may also be provided in order to stabilize side panels 300 using additional connectors, such as bracket 68, shown in FIG. 26 and FIG. 27, and previously described.

Assembly and use of trench box 10 will now be described with reference to FIG. 51. It will be understood that the principles described here may also be applied to the small format and large format trench boxes as described above, and any combination of assembly techniques may be used. Trench box 10 may be assembled without the use of lateral supports and pivoting attachments for some applications, such as where the required trench box 10 is relatively small, and lightweight side panels 300 may be used, which can be assembled by hand. Trench box 10 may be assembled by attaching connecting brackets 304 to the engagement profile 302 of a first side panel 300. Connecting brackets 304 are slid over engagement profile 302 such that engagement profile 302 is received within the receiving slot 306 of connecting bracket 304. The pin receiving openings 312 on connecting bracket 304 are aligned with openings 316 on engagement profile 302. Pins 308 are then inserted through openings 312 and 316, and may be locked in place using locking dowel 310, or other locking techniques, such as by applying a standard pin and receiver arrangement as is known in the art. The first side panel 300 may be vertical, or it may be placed horizontally on a ground surface with the outer face contacting the ground surface to allow connections to be formed without the requirement to support first side panel 300. Once connecting brackets 304 have been attached to first side panel 300, another side panel 300 may be connected to the connecting bracket 304 on any of the sides of first side panel 300. It will be understood that trench box 10 may be assembled while on an outer face of a side panel 300, or it may also be assembled while standing on an edge of engagement profile 302. Panels 300 may be assembled vertically on top of other panels 300 as shown in FIG. 51, or horizontally beside other panels 300 as shown in FIG. 62 and FIG. 63. Panels 300 may also be assembled in different orientations and alignments, as shown in FIG. 53. When manipulating panels 300 and trench box 10, lifting lugs 320 provided on connecting brackets 304 may be used. For example, after assembly of trench box 10, a crane or other lifting machinery may be connected to lifting lugs 320 to allow trench box 10 to be lifted and lowered into a trench 11, as shown in FIG. 7A, or other excavation to provide required shoring. Providing lifting lugs 320 on connecting bracket 304 allows connections to be formed on various positions on trench box 10, allowing different configurations of trench box 10 to be manipulated.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A trench box, comprising:

a first side panel connected to a first end of a lateral support by a first connector, the first connector comprising:

a pivotal connection that permits rotational movement of the first side panel relative to the lateral support about a pivot axis of the pivotal connection; and a releasable connection having a disengaged state in which the releasable connection permits rotational movement of the first side panel relative to the lateral support about the pivot axis, and an engaged state in which the releasable connection prevents relative movement of the first side panel and the lateral support;

wherein a portion of the releasable connection carried by the lateral support is in a fixed position relative to the lateral support and the pivotal connection when the releasable connection is in the disengaged state and the engaged state and as the first side panel rotates about the pivot axis relative to the lateral support and away from the portion of the releasable connection;

wherein, in use, the pivot axis of the pivotal connection is in a horizontal orientation; and wherein, in use, the trench box is adapted to support the sidewalls of an excavation.

2. The trench box of claim 1, further comprising a second side panel connected to a second end of the lateral support by a second connector, the second connector comprising:

a second pivotal connection that permits rotational movement of the second side panel relative to the lateral support about a pivot axis of the second pivotal connection; and a second releasable connection having a disengaged state in which the releasable connection permits rotational movement of the second side panel relative to the lateral support about the pivot axis, and an engaged state in which the releasable connection prevents relative movement of the second side panel and the lateral support;

wherein a portion of the second releasable connection carried by the lateral support is in a fixed position relative to the second pivotal connection when the releasable connection is in the disengaged state and the engaged state and as the first side panel rotates about the pivot axis relative to the lateral support.

3. The trench box of claim 1, further comprising a side support mounted between the first side panel and the lateral support, the side support extending along the first side panel in a direction perpendicular to the pivot axis.

4. The trench box of claim 3, wherein the pivotal connection and the releasable connection connect the lateral support to the side support.

5. The trench box of claim 4, wherein the first side panel is removably mounted to the side support.

6. The trench box of claim 3, wherein, when the releasable connection is released, the side support pivots sufficiently about the pivot axis to permit the lateral support to engage a ground surface.

7. The trench box of claim 3, wherein the side support is fixedly mounted to the lateral support such that the first side panel pivots relative to the lateral support and the side support.

8. The trench box of claim 1, wherein the lateral support further comprises one or more stands that support the lateral support when on a ground surface.

9. The trench box of claim 1, wherein the releasable connection is spring-loaded.

10. The trench box of claim 1, wherein the lateral support is length-adjustable.

11. The trench box of claim 8, wherein a height of the first side panel is greater than a height of the lateral support, such that, when the lateral support is supported by the one or more stands on the ground surface, the first and second side panels are angled downward and outward relative to the one or more lateral supports.

12. The trench box of claim 1, wherein the lateral support comprises lifting lugs that permit the one or more lateral supports to be suspended by a lifting device.

13. The trench box of claim 2, further comprising a third side panel that attaches to one or more of the first side panel and the second side panel.

14. The trench box of claim 13, wherein the third side panel attaches to the first side panel using a corner engagement member, the corner engagement member having an engagement profile that secures the third side panel perpendicularly to the first side panel.

15. The trench box of claim 14, wherein the third side panel attaches to a top edge of the first side panel using an engagement member, the engagement member having an engagement profile that secures the third side panel in a common plane with the first side panels.

16. The trench box of claim 1, wherein a perimeter of the first side panel comprises a universal engagement profile that is engaged by a universal engagement member.

17. The trench box of claim 1, wherein the first side panel comprises a snubber for controlling the rotational movement of the first side panel relative to the lateral support.

18. The trench box of claim 1, wherein the lateral support has a fixed length and is constructed as a single piece.

19. A method of assembling a trench box, comprising:

mounting a first side panel to a first end of a lateral support by a first connector, the first connector comprising:

a pivotal connection that permits rotational movement of the first side panel relative to the lateral support about a pivot axis of the pivotal connection; and a releasable connection having a disengaged state in which the releasable connection permits rotational movement of the first side panel relative to the lateral support about the pivot axis, and an engaged state in which the releasable connection prevents relative movement of the first side panel and the lateral support; and with the releasable connection in the disengaged state and the pivot axis of the pivotal connection in a horizontal orientation, pivoting the first side panel relative to the lateral support until the releasable connection enters the engaged state, and such that a portion of the releasable connection carried by the lateral support remains in a fixed position relative to the lateral support and the pivotal connection when the releasable connection is in the disengaged state and the engaged state;

wherein, in use, the pivot axis of the pivotal connection is in the horizontal orientation; and wherein, in use, the trench box is adapted to support the sidewalls of an excavation.

20. The method of claim 19, further comprising the steps of:

mounting a second side panel connected to a second end of the lateral support by a second connector, the second connector comprising:

a second pivotal connection that permits rotational movement of the second side panel relative to the lateral support about a pivot axis of the second pivotal connection; and a second releasable connection having a disengaged state in which the releasable connection permits rotational movement of the second side panel relative to the lateral support about the pivot axis, and an engaged state in which the releasable connection prevents relative movement of the first side panel and the lateral support; and with the second releasable connection in the disengaged state and the pivot axis of the second pivotal connection in a horizontal orientation, pivoting the second side panel relative to the lateral support until the second releasable connection enters the engaged state, and such that a portion of the second releasable connection carried by the lateral support remains in a fixed position relative to the lateral support and the second pivotal connection when the second releasable connection is in the disengaged state and the engaged state.

21. The method of claim 20, wherein the first side panel and the second side panel are pivoted simultaneously from a first position in which each of releasable connection and the second releasable connection are in the disengaged state to a second position in which each of releasable connection and the second releasable connection are in the engaged state, wherein:

in the first position, each of the first side panel and the second side panel are at an obtuse angle to the lateral support and the first side panel is at an obtuse angle relative to the second side panel; and in the second position, the first side panel is parallel to the second side panel.

* * * * *